US008096223B1

(12) United States Patent
Andrews

(10) Patent No.: US 8,096,223 B1
(45) Date of Patent: Jan. 17, 2012

(54) MULTI-LAYER COMPOSITE ARMOR AND METHOD

(76) Inventor: Mark D. Andrews, Petoskey, MI (US)

( * ) Notice: Subject to any disclaimer, the term of this patent is extended or adjusted under 35 U.S.C. 154(b) by 364 days.

(21) Appl. No.: 12/347,937

(22) Filed: Dec. 31, 2008

Related U.S. Application Data

(60) Provisional application No. 61/018,840, filed on Jan. 3, 2008, provisional application No. 61/068,886, filed on Feb. 13, 2008, provisional application No. 61/068,885, filed on Feb. 13, 2008, provisional application No. 61/119,023, filed on Dec. 1, 2008.

(51) Int. Cl.
*F41H 5/02* (2006.01)
*F41H 5/14* (2006.01)

(52) U.S. Cl. ..... 89/36.02; 89/36.09

(58) Field of Classification Search ..... 89/36.02, 89/36.09

See application file for complete search history.

(56) References Cited

U.S. PATENT DOCUMENTS

| | | | | |
|---|---|---|---|---|
| 315,077 | A | 4/1885 | Seale | |
| 952,877 | A * | 3/1910 | Cowper-Coles | 114/12 |
| 1,463,498 | A * | 7/1923 | Burgess | 109/81 |
| 2,922,483 | A * | 1/1960 | Harris | 181/290 |
| 3,324,768 | A * | 6/1967 | Eichelberger | 89/36.02 |
| 3,431,818 | A * | 3/1969 | King | 89/36.02 |
| 3,523,057 | A * | 8/1970 | Buck | 428/156 |
| 3,705,558 | A * | 12/1972 | McDougal et al. | 109/84 |
| 3,969,563 | A * | 7/1976 | Hollis, Sr. | 428/175 |
| 4,179,979 | A * | 12/1979 | Cook et al. | 89/36.02 |
| 4,665,794 | A * | 5/1987 | Gerber et al. | 89/36.02 |
| 5,134,725 | A * | 8/1992 | Yeshurun et al. | 2/2.5 |
| 5,200,256 | A * | 4/1993 | Dunbar | 428/212 |
| 5,361,678 | A * | 11/1994 | Roopchand et al. | 89/36.02 |
| 5,723,807 | A * | 3/1998 | Kuhn, II | 89/36.02 |
| 5,738,925 | A * | 4/1998 | Chaput | 428/101 |
| 5,866,839 | A * | 2/1999 | Ohayon | 89/36.08 |
| 6,112,635 | A * | 9/2000 | Cohen | 89/36.02 |
| 6,200,664 | B1 * | 3/2001 | Figge et al. | 428/178 |
| 6,203,908 | B1 * | 3/2001 | Cohen | 428/397 |
| 6,408,734 | B1 * | 6/2002 | Cohen | 89/36.02 |
| 6,635,357 | B2 * | 10/2003 | Moxson et al. | 428/548 |
| 6,892,623 | B2 * | 5/2005 | Benyami et al. | 89/36.02 |

(Continued)

FOREIGN PATENT DOCUMENTS

EP 41271 A1 * 12/1981

(Continued)

*Primary Examiner* — Troy Chambers

(74) *Attorney, Agent, or Firm* — Charles A. Lemaire; Jonathan M. Rixen; Lemaire Patent Law Firm, P.L.L.C.

(57) ABSTRACT

A multi-layer composite armor component that includes a plurality of layers of energy-dispersion objects including a first layer that includes a first plurality of energy-dispersion objects, wherein the first plurality of energy-dispersion objects in the first layer are held in place relative to one another in a closely-packed configuration; and a first layer of bonding material, wherein the first layer of bonding material has a first durometer value, and wherein the first plurality of energy-dispersion objects are held in place relative to one another via the first layer of bonding material. A method that includes providing a plurality of layers of energy-dispersion objects; arranging the first plurality of layers of energy-dispersion objects such that each of the first plurality of energy-dispersion objects are held in place relative to one another in a closely-packed configuration; and embedding the first plurality of energy-dispersion objects in a first layer of bonding material.

22 Claims, 27 Drawing Sheets

U.S. PATENT DOCUMENTS

| | | | | |
|---|---|---|---|---|
| 7,100,490 | B2 * | 9/2006 | Muller, Jr. | 89/36.02 |
| 7,238,730 | B2 | 7/2007 | Apichatachutapan et al. | |
| 7,383,762 | B2 * | 6/2008 | Cohen | 89/36.02 |
| 7,500,422 | B2 * | 3/2009 | Mazur | 89/36.02 |
| 7,543,523 | B2 * | 6/2009 | Hunn | 89/36.02 |
| 7,557,054 | B2 * | 7/2009 | Oda et al. | 501/90 |
| 7,681,485 | B2 * | 3/2010 | Neal | 89/36.02 |
| 7,694,621 | B1 * | 4/2010 | Ma | 89/36.02 |
| 7,776,773 | B2 * | 8/2010 | Horiuchi et al. | 501/87 |
| 7,827,897 | B2 * | 11/2010 | Magnusson et al. | 89/36.02 |
| 7,833,627 | B1 * | 11/2010 | Ferrando | 428/416 |
| 7,861,638 | B1 * | 1/2011 | Percival et al. | 89/36.02 |
| 7,866,248 | B2 * | 1/2011 | Moore et al. | 89/36.02 |
| 2005/0005762 | A1 * | 1/2005 | Lujan | 89/36.02 |
| 2005/0229771 | A1 * | 10/2005 | Lewis | 89/36.02 |
| 2006/0065111 | A1 * | 3/2006 | Henry | 89/36.02 |
| 2007/0017359 | A1 * | 1/2007 | Gamache et al. | 89/36.04 |
| 2007/0180981 | A1 * | 8/2007 | Tapp et al. | 89/36.02 |
| 2008/0264243 | A1 * | 10/2008 | Lucuta et al. | 89/36.02 |
| 2009/0090236 | A1 * | 4/2009 | Misencik et al. | 89/36.02 |
| 2009/0114082 | A1 * | 5/2009 | Hunn | 89/36.02 |
| 2009/0114083 | A1 * | 5/2009 | Moore et al. | 89/36.02 |
| 2009/0126557 | A1 * | 5/2009 | Hunn | 89/36.02 |
| 2009/0241764 | A1 * | 10/2009 | Cohen | 89/36.02 |
| 2009/0293710 | A1 * | 12/2009 | Vittoser et al. | 89/36.02 |
| 2009/0293711 | A1 * | 12/2009 | Altergott et al. | 89/36.02 |
| 2010/0071537 | A1 * | 3/2010 | Weber et al. | 89/36.02 |
| 2010/0077911 | A1 * | 4/2010 | Simovich | 89/36.02 |
| 2010/0275765 | A1 * | 11/2010 | LaGrotta et al. | 89/36.02 |
| 2011/0005378 | A1 * | 1/2011 | Warren et al. | 89/36.02 |

FOREIGN PATENT DOCUMENTS

FR 2632393 A1 * 12/1989

* cited by examiner

MULTI-LAYER COMPOSITE ARMOR AND METHOD

CROSS-REFERENCE TO RELATED APPLICATIONS

This application claims benefit under 35 U.S.C. §119(e) of U.S. Provisional Patent Application 61/018,840 filed on Jan. 3, 2008, titled "PASSIVE ARMOR APPARATUS AND METHOD," U.S. Provisional Patent Application 61/068,886 filed on Feb. 13, 2008, titled "MULTI-LAYERED COMPOSITE STRUCTURE AND METHOD OF MAKING AND USING," U.S. Provisional Patent Application 61/068,885 filed on Feb. 13, 2008, titled "MULTI-LAYERED COMPOSITE BELLY PLATE AND METHOD OF MAKING AND USING," and U.S. Provisional Patent Application 61/119,023 filed on Dec. 1, 2008, titled "MULTI-LAYER COMPOSITE ARMOR AND METHOD," each of which is incorporated herein by reference in its entirety.

FIELD OF THE INVENTION

The present invention provides a multi-layered composite structure and method of making and using, and in particular, various embodiments described herein relate to using the structure as passive armor for, e.g., land vehicles, ships and buildings.

BACKGROUND OF THE INVENTION

In combat vehicles, armor is generally placed on the vehicle to protect the occupants from injury or to lessen the type and severity of injuries received when an enemy hits the combat vehicle with a projectile.

In addition, combatants are constantly working to improve projectile apparatus and methods of deployment. In some instances, the projectiles are improved to increase their ability to pierce armor of various types. Similarly, other combatants seek to improve armor to defeat the latest in projectile technology. Therefore, combatants are constantly seeking to improve armor to protect the troops that operate combat vehicles.

SUMMARY OF THE INVENTION

In some embodiments, the present invention provides an apparatus comprising a first multi-layer composite armor component that includes a plurality of layers of energy-dispersion objects including a first layer that includes a first plurality of energy-dispersion objects and a second layer that includes a second plurality of energy-dispersion objects, wherein the first plurality of energy-dispersion objects in the first layer are held in place relative to one another in a closely-packed configuration; and a first layer of bonding material, wherein the first layer of bonding material has a first durometer value, and wherein the first plurality of energy-dispersion objects are held in place relative to one another via the first layer of bonding material.

In some embodiments, the present invention provides a method for making a defense against a ballistic projectile, the method including providing a plurality of layers of energy-dispersion objects including a first layer that includes a first plurality of energy-dispersion objects and a second layer that includes a second plurality of energy-dispersion objects; arranging the first plurality of layers of energy-dispersion objects such that each of the first plurality of energy-dispersion objects are held in place relative to one another in a closely-packed configuration; providing a first layer of bonding material, wherein the first layer of bonding material has a first durometer value; and embedding the first plurality of energy-dispersion objects in the first layer of bonding material.

Figure 1B:
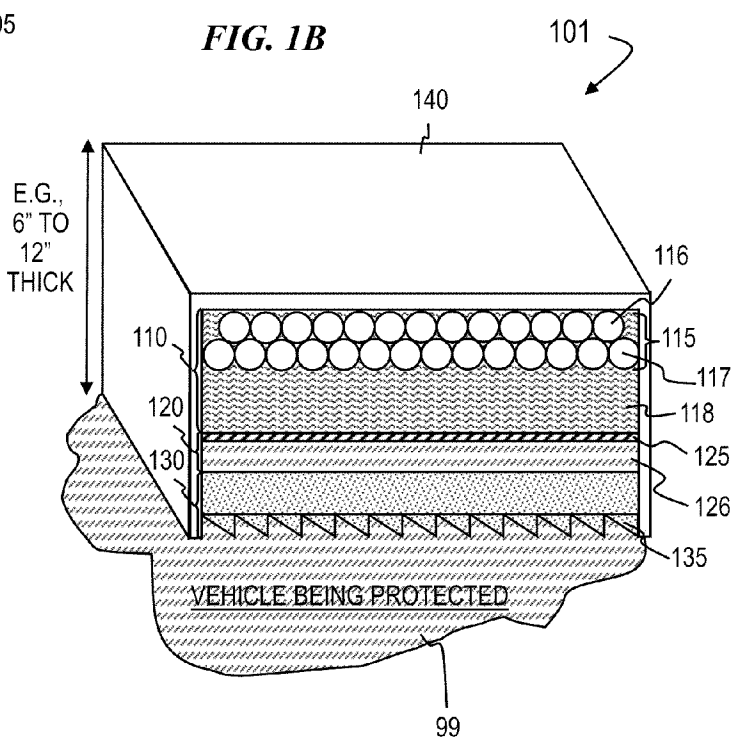
FIG. 1B is a perspective cross-section view of a multi-layered composite armor component 101, according to an example embodiment.

The description set out herein illustrates the various embodiments of the invention and such description is not intended to be construed as limiting in any manner.

DETAILED DESCRIPTION

Although the following detailed description contains many specifics for the purpose of illustration, a person of ordinary skill in the art will appreciate that many variations and alterations to the following details are within the scope of the invention. Accordingly, the following preferred embodiments of the invention are set forth without any loss of generality to, and without imposing limitations upon the claimed invention.

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component that appears in multiple figures. Signals and connections may be referred to by the same reference number or label, and the actual meaning will be clear from its use in the context of the description.

As used herein, a "ballistic projectile" is defined as an object fired through the air as a weapon against a vehicle or person. For example, an explosively-formed-penetrator (EFP) is a type of ballistic projectile used to penetrate armor effectively at stand-off distances.

As used herein, a "ballistic fiber" is defined as a woven fiber or other material (e.g., glass, acrylic, fiberglass, etc.) that absorbs substantially all of the impact from ballistic projectiles or shrapnel fragments from an explosion.

As used herein, a "composite layer" is defined as a layer that comprises at least two different materials. For example, a layer comprising polyurethane and fiber-reinforced steel is a composite layer.

As used herein, a "polymer" is defined as a large molecule (macromolecule) composed of repeating structural units connected by covalent chemical bonds. As used herein, "polyurethane" (also sometimes called "urethane") is defined as a class of polymers formed by reacting a monomer containing at least two isocyanate functional groups with another monomer containing at least two alcohol groups in the presence of a catalyst. Polyurethane formulations cover an extremely wide range of stiffness, hardness, and densities including low density flexible foam used in upholstery and bedding, low density rigid foam used for thermal insulation and e.g. automobile dashboards, soft solid elastomers used for gel pads and print rollers, and hard solid plastics used as electronic instrument bezels and structural parts.

As used herein, "durometer" (or "Shore durometer", as it is also known) is defined as a measure of the indentation resistance of elastomeric or soft plastic materials based on the depth of penetration of a conical indentor. Hardness values range from 0 (for full penetration) to 100 (for no penetration). Full penetration is between approximately 2.46 and 2.54 mm (0.097 and 0.100 inches) depending on the equipment used. There are two primary durometer scales: durometer A and durometer D. "Durometer A" is the durometer scale used for softer materials. The conical indentor for a durometer-A measuring device has a 0.79-mm-diameter indentor and a 35-degree conical shape. "Durometer D" is the durometer scale used for harder materials. The conical indentor for a durometer-D measuring device has a 0.1-mm-diameter indentor and a 30-degree conical shape.

As used herein, a "ceramic material" is defined as any material made essentially from a nonmetallic mineral by the action of heat. Ceramics include structural ceramics (e.g., bricks, pipes, floor and roof tiles), refractories (e.g., kiln linings, gas fire radiants, steel and glass making crucibles), whitewares (e.g., tableware, wall tiles, decorative art objects and sanitary ware), and technical ceramics (e.g., alumina, zirconia, carbides, borides, nitrides, silicides, and particulate reinforced combinations of oxides and non-oxides).

As used herein, a "bonding material" (also called "bonding agent") is defined as a compound or material that binds two or more items together (e.g., tar, concrete, casein glue, synthetic glue, plasters, putty, adhesives, ceramics, pastes, cellulosic fibers (e.g., paper), glass, clay, magnetized materials, resins, polymers such as polyurethane, etc.).

As used herein, the "strike-face" side of an armor configuration is defined as the side of the armor in which a ballistic projectile first comes into contact. For example, an explosively-formed-projectile (EFP) shot at an armor-protected vehicle from a position external to the vehicle will make first contact with the armor on the strike-face side of the armor. Similarly, the "vehicle side" of an armor configuration is herein defined as the side of the armor closest to the hull of the vehicle being protected.

Figure 1A:
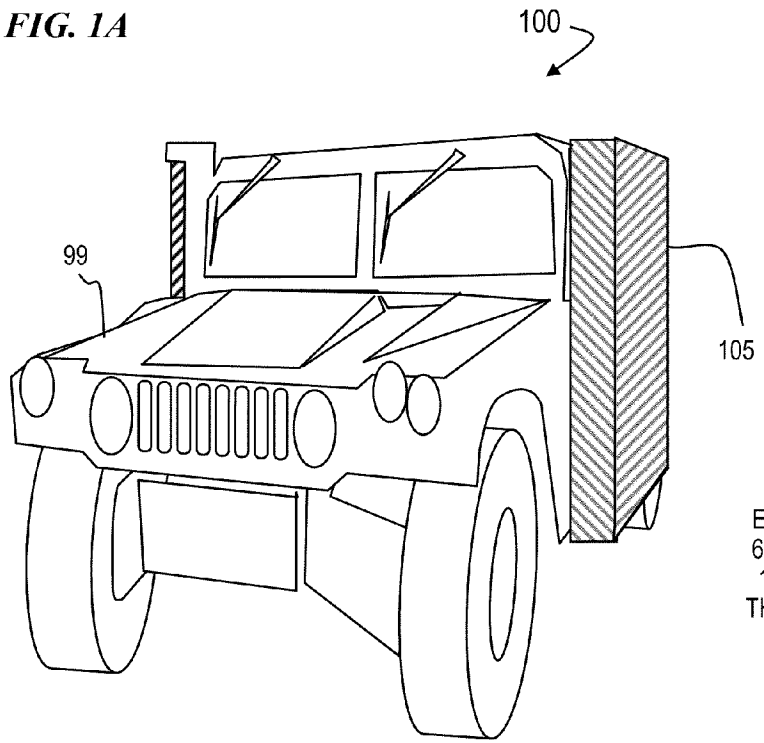
FIG. 1A is a perspective view of an armor-enhanced combat vehicle 100, according to an example embodiment.
Figure 14:
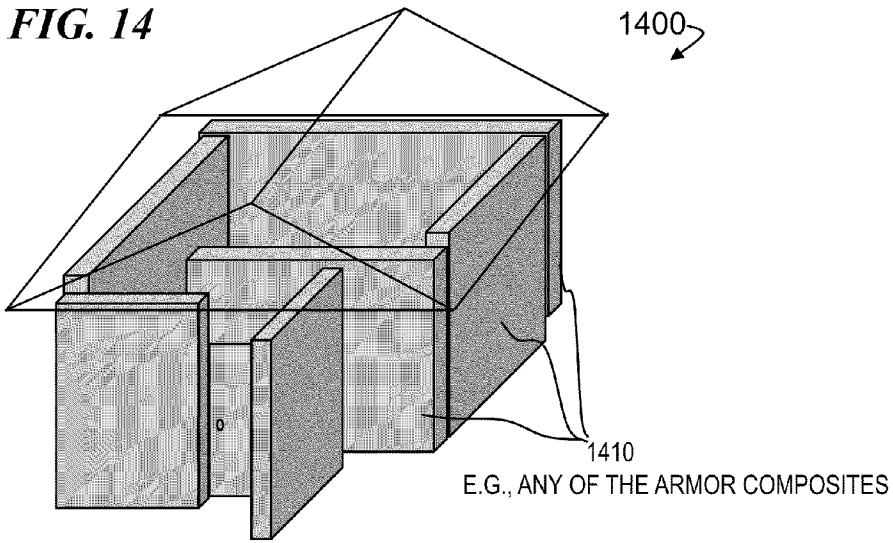
FIG. 14 is a perspective view of an armor-enhanced stationary structure 1400, according to an example embodiment.

FIG. 1A is a perspective view of an armored vehicle system 100, according to an example embodiment. As shown in FIG. 1A, in some embodiments, the left side and right side of combat vehicle 99 are covered with an armor panel 105 to protect from improvised explosive devices (IEDs) or rocket-propelled grenades (RPGs) that are often directed toward a vehicle from the sides. Armor panel 105 is provided so that passengers or troops within combat vehicle 99 are protected from explosions which may occur near combat vehicle 99 or for projectiles (e.g., such as from explosively formed projectile devices or "EFPs") that may strike or be directed at combat vehicle 99 from the side. In some embodiments, armor panel 105 can defend against projectiles (e.g., EFP's) in the 152-170 mm (outside diameter) range (this range is based on the size of oil pipes that are often used to create EFP's). In some embodiments, armor panel 105 can defend against projectiles in other suitable ranges. In some embodiments, additional armor panels 105 are provided on the back, front, underbelly, and/or top of vehicle 99 to protect from projectiles aimed at those aspects of vehicle 99. In some embodiments, vehicle 99 is a HMVVW (humvee)-type vehicle as shown. In other embodiments, vehicle 99 is a tank, ship, aircraft, limousine, or like vehicle. In still other embodiments, armor panel 105 is applied to a structure such as a house or bunker, such as shown in FIG. 14 below.

FIG. 1B is a perspective cross-section schematic view of a multi-layered composite armor (MLCA) component 101, according to an example embodiment. In some embodiments, component 101 and a plurality of other multi-layer composite armor components, each substantially similar to component 101, are affixed to combat vehicle 99 to form armor panel 101. In some embodiments, component 101 includes an outer layer 110 that includes a plurality of layers of energy-dispersion objects 115 bonded together with a first fiber reinforcement layer 118, a containment layer 120 (which, in some embodiments, includes a metal plate 125 and a second fiber reinforcement layer 126 (e.g., a ballistic fiber)), and a shock-absorbing layer 130 (which, in some embodiments, includes a contoured portion 135). In some embodiments, fiber reinforcement layers 118 and 126 include one or more materials such as basalt fibers, glass fibers (e.g., E-glass), steel fibers, elongated armor elements (e.g., high-strength steel or stainless-steel cables, for example as may be available through home-improvement stores such as Lowest® and Home Depot®), aramid/ballistic (e.g., Kevlar®, Pacific Bulletproof®, Strongwell®, etc.) fibers, and ceramic chips. As used herein, "elongated armor elements" are defined as lengths of at least somewhat bendable material used to form at least one layer of a multi-layer composite armor (MLCA) component (e.g., steel cables, stranded, woven or braided steel cables, lengths of solid steel, and any other suitable continuous lengths of material).

In some embodiments, MLCA component 101 is built from replaceable sub-layers, and component 101 can be repaired in a combat theater by replacing fewer than all of the sub-layers. For example, a side of a humvee could be protected by several overlapping and side-by-side sub-layers that could be individually replaced as needed. In some embodiments, for example, layer 110 could be made of a plurality of side-by-side panels that form the outer layer 110 of FIG. 1B, and those are laid offset to the joints of a plurality of side-by-side panels used to form the next inner layer 120 of FIG. 1B, and those in turn are laid offset to the joints of a plurality of side-by-side panels of the next layer and so on. In some embodiments, the strike face and body of MLCA component 101 are removable, replaceable, and interchangeable.

In some embodiments, MLCA component 101 includes a layer of ceramic material (not illustrated) on the strike face of the MLCA component 101. The goal of such a ceramic layer is to immediately deform/break apart an incoming projectile upon impact with the strike face such that the projectile forms smaller pieces that are easier to absorb by the rest of the layers making up the armor. In some embodiments, however, a ceramic layer does not provide much resistance to an incoming projectile, and, in fact, merely turns to powder upon being struck by a projectile (e.g., an explosively-formed-projectile). In some embodiments, MLCA component 101 includes a layer of ceramic material that includes a plurality of ceramic cylinders. In some embodiments, the ceramic material includes a plurality of hexagonal-shaped ceramic objects. In some embodiments, the ceramic material includes a ceramic panel. In some embodiments, the ceramic material includes an alumina. In some embodiments, the ceramic material includes a silicon carbide.

In some embodiments, MLCA component 101 includes a high-heat resistant layer (not illustrated) in order to prevent the MLCA component from being defeated by large amounts of heat released from an incoming projectile. The high-heat layer includes any material capable of insulating the layers below from heat (e.g., heat-resistant silicone adhesive, acrylic resin, polyimide adhesive tape, 3M® Heat Resistant Screen Tape, etc.).

Figure 1D:
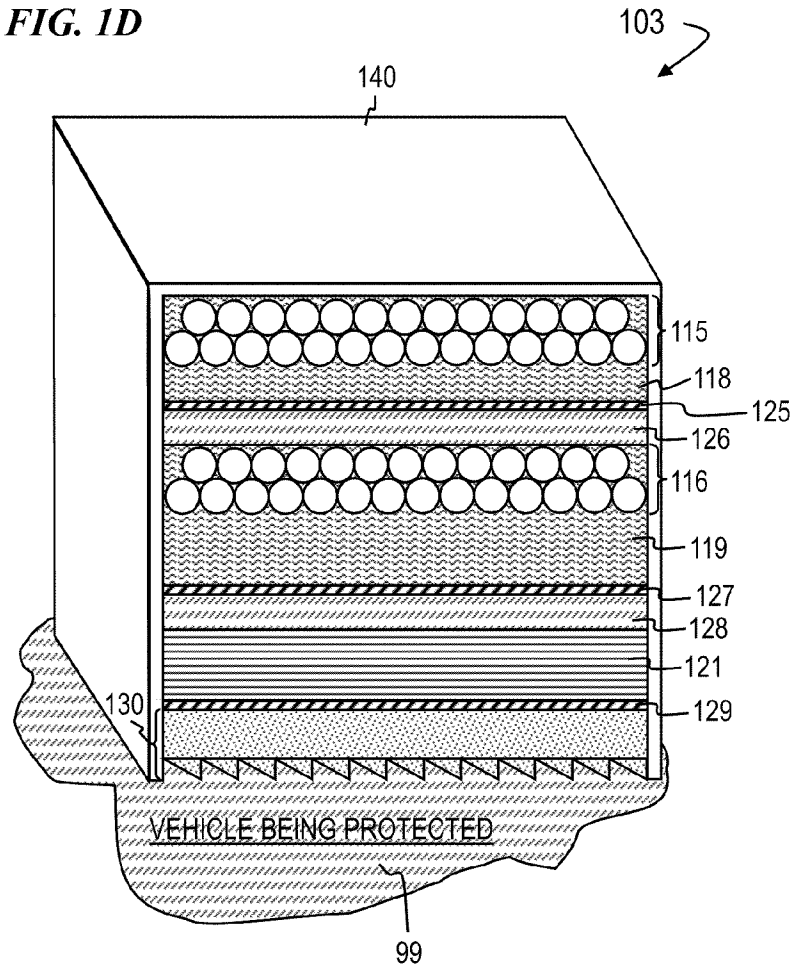
FIG. 1D is a perspective cross-section view of a multi-layer composite armor component 103.
Figure 1C:
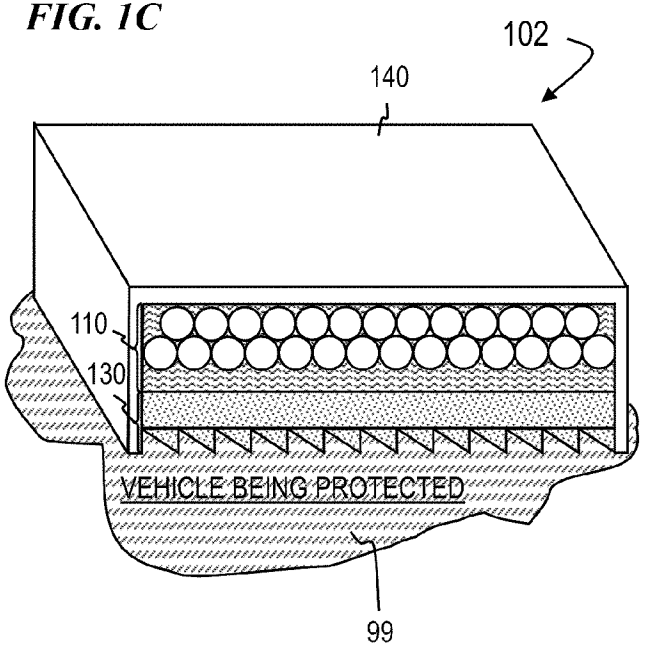
FIG. 1C is a perspective cross-section view of a light-weight multi-layer composite armor component 102.

It should be understood that component 101 does not necessarily need all the layers shown in FIG. 1B. In some embodiments, for example, outer layer 110 is placed directly onto shock-absorbing layer 130 to form a light-weight MLCA component 102 as illustrated in FIG. 1C. In some embodiments, MLCA component 102 also includes a ceramic layer (not illustrated) attached to the top of layer 110. Some current U.S. military standards require that light-weight armor (LWA) can withstand an approximately 12.7-mm (0.50-caliber) round, while keeping the density of the LWA less than approximately 98 kg-per-square-meter (twenty pounds-per-square-foot (20 lbs/ft$^2$)). Although LWA designed to these standards can defend against 12.7-mm (0.50-caliber) rounds, it is well-known in the art that the most prevalent ammunition currently seen in the field is a 14.5-mm round. In some embodiments, therefore, a light-weight armor like that illustrated in FIG. 1C provides a defense against heavy caliber man-portable weapons systems (e.g., a 14.5-mm round). In some embodiments, MLCA component 102 is one part of a multi-part armor system. In some embodiments, therefore, MLCA component 102 is attached to a vehicle as the first part to provide a LWA for the vehicle, and if heavier protection is needed for the vehicle (e.g., to defend against an explosively-formed projectile), an additional part armor component (that includes, for example, layer 120 from FIG. 1B) is attached directly to the strike face of MLCA component 102.

MLCA component 101 is not necessarily limited to the number of layers illustrated in FIG. 1B. For example, in some embodiments, component 101 includes multiples of layer 110, fiber reinforcement layers 118 and 126, and/or metal plates 125 (see, for example, FIG. 1D).

In some embodiments, MLCA component 103 (FIG. 1D) includes the following specifications: encapsulation layer 140 includes an approximately 0.254-mm-thick (0.1-inch-thick) ether polyurethane, energy-dispersion objects 115 include closely packed approximately 12.7-mm-diameter (½-inch-diameter) stainless-steel ball bearings, fiber reinforcement layer 118 includes a basalt fiber mat/mesh (10- to 27-micron-diameter fibers embedded in thermosetting or thermoplastic polymer), metal plate 125 includes an approximately 3.175-mm-thick (⅛-inch-thick) stainless-steel plate, fiber reinforcement layer 126 includes an approximately 12.7-mm-thick (½-inch-thick) ester polyurethane with aramid fiber reinforcement, energy-dispersion objects 116 include closely packed approximately 12.7-mm-diameter (½-inch-diameter) stainless steel ball bearings, fiber reinforcement layer 119 includes a basalt fiber mat/mesh (10- to 27-micron-diameter fibers embedded in thermosetting or thermoplastic polymer), metal plate 127 includes an approximately 3.175-mm-thick (⅛-inch-thick) stainless steel plate, fiber reinforcement layer 128 includes an approximately 12.7-mm-thick (½-inch-thick) deadened non-rebounding polyurethane with fiber reinforcement, fiber reinforcement layer 121 includes an approximately 25.4-mm-thick (1-inch-thick) basalt fiber cross-laid straight fiber mat, metal plate 129 includes an approximately 3.175-mm-thick (⅛-inch-thick) stainless steel plate, and shock-absorbing layer 130 includes an approximately 25.4-mm-thick (1-inch-thick) deadened non-rebounding polyurethane. In some embodiments, fiber layer 119 includes materials other than basalt fiber mat/mesh and diameters other than 10- to 27-micron-diameter.

In some embodiments, component 101 also includes multiples of shock-absorbing layer 130. Further, in some embodiments, the layers within component 101 do not necessarily need to be in the order illustrated in FIGS. 1B, 1C, and 1D. In some embodiments, for example, shock-absorbing layer 130 is placed above containment layer 120.

In some embodiments, the layers of MLCA component 101 are bonded together via a bonding material (e.g., a polymer). In some embodiments, the bonding material includes an ester polyurethane. Ester polyurethane works well as an interior bonding agent because it has a high overall strength, is lighter in weight, and less expensive than other types of polyurethane (e.g., ether polyurethane). In some embodiments, the bonding material includes an 83A-durometer polymer. In some embodiments, the bonding material includes other suitable durometer polymers. In some embodiments, the bonding material includes a thermoplastic or thermoset resin. In some embodiments, the bonding material includes deadened non-rebounding polyurethane (e.g., viscoelastic polyurethane such as provided by U.S. Pat. No. 7,238,730, titled "VISCOELASTIC POYURETHANE FOAM", issued Jul. 3, 2007). The sound-deadening properties of deadened non-rebounding polyurethane help reduce the sound blast to the protected compartment, thus reducing brain and ear damage of the occupants. In some embodiments, the bonding material includes high-tensile-strength polyurethane such as obtained using Andur 5 DPLM-brand prepolymer (Andur 5-DPLM is a polyester based, toluene diisocyanate terminated prepolymer. An elastomer with a hardness of 50 Shore D is obtained when this prepolymer is cured with Curene 442 [4,4'-methylene-bis(orthochloroaniline)]. Elastomers of lower hardness can be obtained by curing Andur 5-DPLM with polyols and their combination with Curene 442 and other diamines, or through the use of plasticizers), wherein 5 DPLM and Curene 442 are available through Anderson Development Corporation (www.andersondevelopment.com/sury bin.php?x={486D54-005531-7D34C9}&y=1).

In some embodiments, MLCA component 101 includes an outer polymer encapsulation layer 140. In some embodiments, an ether and/or ether/ester polymer is used (such as, for example, Andur 2-920 AP, which is a polyester/polyether TDI terminated coprepolymer suitable for the preparation of urethane elastomers. When cured with Curene 442 [4,4'-methylene-bis (orthochloroaniline)], an elastomer with 92 Shore A hardness will be produced. Elastomers of lower hardness can be obtained using blends of Curene 442 and polyols and other diamine curatives, or by the use of plasticizers. Typical elastomer properties of Andur 2-920AP cured with Curene 442 at 95% stoichiometry include Hardness, Shore A of 90-94.) In some embodiments, the encapsulation layer 140 is used to seal, reduce the radar signature and/or camouflage the panel. In some embodiments, the encapsulation layer 140 includes embedded radar-absorbing material and/or a strengthening fabric. In some embodiments, the encapsulation 140 includes a hard, fire-retardant polyurethane (e.g., 93A-durometer ether polyurethane with fire retardant material). In some embodiments, encapsulation layer 140 includes a black, 93A-durometer ether polyurethane (e.g., with carbon black or other coloring or ultra-violet (UV) protection agent). In some embodiments, encapsulation layer 140 includes another ether polyurethane having a suitable durometer value. Use of ether polyurethane in the outer encapsulation layer 140, rather than ester polyurethane, is advantageous, in some embodiments, because suitable ether polyurethanes are much more effective in resisting humidity breakdown than ester polyurethane. The use of a black or other UV-blocking ether polyurethane in the encapsulation layer 140 can provide protection against UV radiation (which causes polyurethane to deteriorate) by effectively blocking UV from sunlight from penetrating the skin of the polyurethane. In some embodiments, encapsulation 140 includes a pressed fiber matrix of 0°-90° configuration (i.e., each of a plurality of fiber layers within the pressed matrix form 90-degree angles with adjacent fiber layers). In some embodiments, encapsulation 140 includes a pressed "chip-matrix" design (e.g., a design using reinforcement fiber chips bonded in a manner similar to pressed-wood oriented-strand board). In some embodiments, encapsulation 140 includes a fire-retardant phenolic resin.

In some embodiments, component 101 has a total thickness of approximately 100 mm. In some embodiments, component 101 has a total thickness of approximately 105 mm. In some embodiments, component 101 has a total thickness of approximately 110 mm. In some embodiments, component 101 has a total thickness of approximately 115 mm. In some embodiments, component 101 has a total thickness of approximately 120 mm. In some embodiments, component 101 has a total thickness of approximately 125 mm. In some embodiments, component 101 has a total thickness of approximately 130 mm. In some embodiments, component 101 has a total thickness of approximately 135 mm. In some embodiments, component 101 has a total thickness of approximately 140 mm. In some embodiments, component 101 has a total thickness of approximately 145 mm. In some embodiments, component 101 has a total thickness of approximately 150 mm. In some embodiments, component 101 has a total thickness of approximately 155 mm. In some embodiments, component 101 has a total thickness of approximately 160 mm. In some embodiments, component 101 has a total thickness of approximately 165 mm. In some embodiments, component 101 has a total thickness of approximately 170 mm. In some embodiments, component 101 has a total thickness of approximately 175 mm. In some embodiments, component 101 has a total thickness of approximately 180 mm. In some embodiments, component 101 has a total thickness of approximately 185 mm. In some embodiments, component 101 has a total thickness of approximately 190 mm. In some embodiments, component 101 has a total thickness of approximately 195 mm. In some embodiments, component 101 has a total thickness of approximately 200 mm. In some embodiments, component 101 has a total thickness of approximately 205 mm. In some embodiments, component 101 has a total thickness of approximately 210 mm. In some embodiments, component 101 has a total thickness of approximately 220 mm. In some embodiments, component 101 has a total thickness of approximately 230 mm. In some embodiments, component 101 has a total thickness of approximately 240 mm. In some embodiments, component 101 has a total thickness of approximately 250 mm. In some embodiments, component 101 has a total thickness of approximately 260 mm. In some embodiments, component 101 has a total thickness of approximately 270 mm. In some embodiments, component 101 has a total thickness of approximately 280 mm. In some embodiments, component 101 has a total thickness of approximately 290 mm. In some embodiments, component 101 has a total thickness of approximately 300 mm. In some embodiments, component 101 has a total thickness of approximately 310 mm. In some embodiments, component 101 has a total thickness of approximately 320 mm. In some embodiments, component 101 has a total thickness of approximately 330 mm. In some embodiments, component 101 has a total thickness of approximately 340 mm. In some embodiments, component 101 has a total thickness of approximately 350 mm. In some embodiments, component 101 has a total thickness of more than 350 mm.

The MLCA component 101 is shown as a flat panel, but it should be noted that component 101 can be formed to any shape. For example, in some embodiments, component 101 is formed as a curved surface with multiple curves so as to conform to a fender of a combat vehicle, such as combat vehicle 99.

Figures 1E, 2A, 2B, 2C:
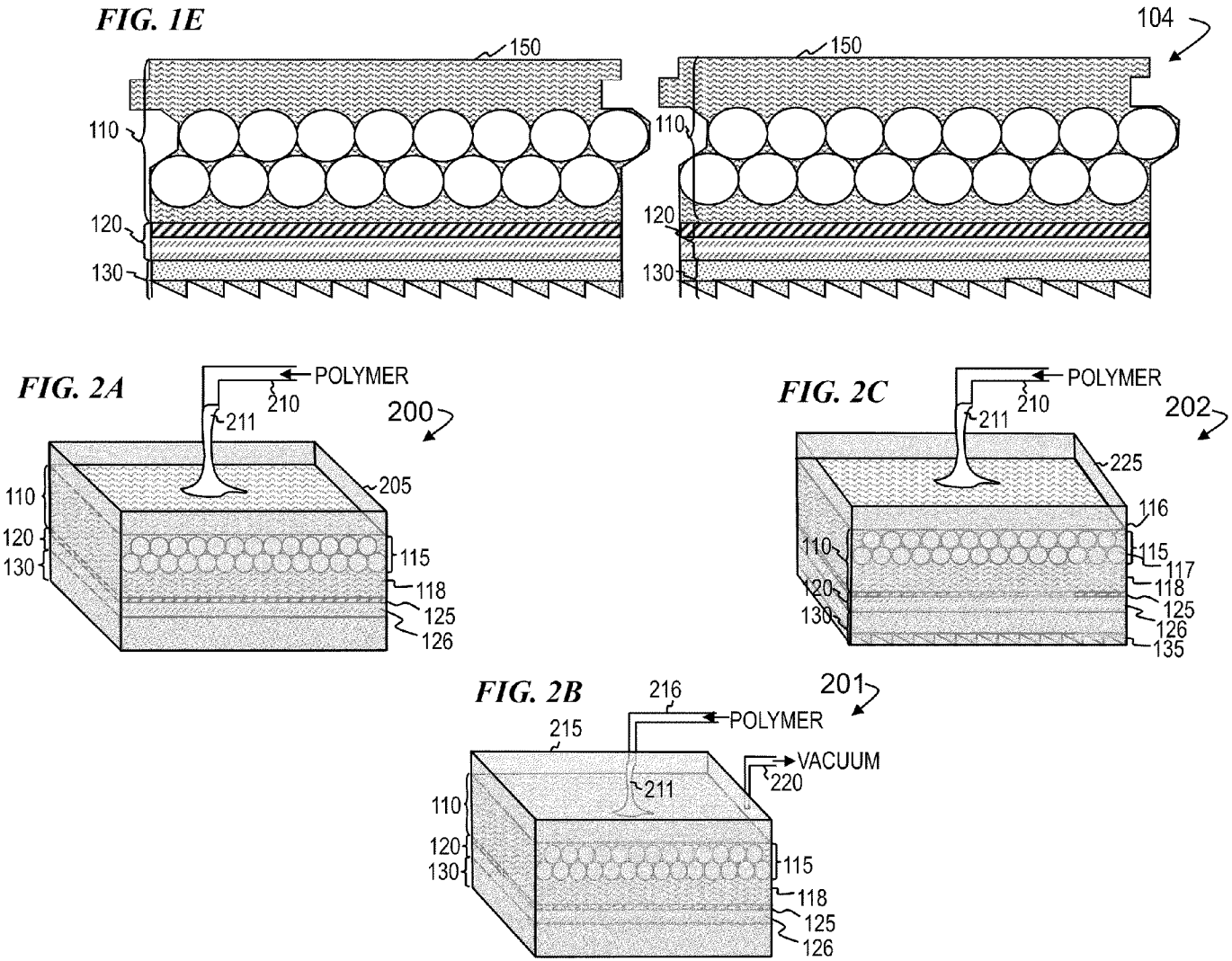
FIG. 1E is a cross-section 104 of two MLCA components 150 configured to be connected on a vehicle in an overlapping arrangement.
FIG. 2A is a perspective cross-sectional view of an apparatus 200 and method for fabricating a multi-layer composite armor (MLCA) component.
FIG. 2B is a perspective cross-sectional view of an apparatus 201 and method for fabricating a multi-layer composite armor (MLCA) component under vacuum.
FIG. 2C is a perspective cross-sectional view of an apparatus 202 and method for fabricating the outer encapsulation layer of an MLCA component.

FIG. 1E is a cross-section 104 of two MLCA components 150 configured to be connected on a vehicle in an overlapping arrangement. As illustrated in FIG. 1E, MLCA components 150 include substantially the same composite layers 110, 120, and 130 shown in FIG. 1B (encapsulation layer 140, however, is not illustrated in FIG. 1E). In some embodiments, a plurality of MLCA components are formed as large panels that are then cut into the shapes represented by MLCA components 150 such that the MLCA components 150 can be joined (by bolting, by adhesive, by Velcro™ or other suitable means) together on the surface of a vehicle hull. In some embodiments, individual MLCA components 150 are fabricated using a form having the shape illustrated in FIG. 1E.

FIG. 2A is a perspective cross-sectional view of an apparatus 200 and method for fabricating a multi-layer composite armor (MLCA) component according to an example embodiment. In some embodiments, the various layers that make up the MLCA component (e.g., layers 110, 120, and 130) are laid down one by one in the casting mold 205 and bonded together by a polymer 211 (e.g., a polyurethane such as ester polyurethane). In some embodiments, the materials making up the MLCA component are pre-treated with a bonding agent (e.g., a polyurethane or lacquer) and pre-heated prior to the addition of polymer 211. In some embodiments, the bonding agent is sprayed onto the materials. In some embodiments, the bonding agent is painted onto the materials. In some embodiments, for example, energy-dispersion objects 115 are configured in the desired matrix and then pre-treated with a bonding agent that bonds them together for easy emplacement in the casting mold.

In some embodiments, casting mold 205 is approximately 356 mm×356 mm×356 mm (14"×14"×14"). In some embodiments, casting mold 205 is a size other than 356 mm×356 mm×356 mm. In some embodiments, a liquid polymer 211 is poured into mold 205 via a hose or pipe 210. In some embodiments, polymer 211 impregnates layers such as first fiber layer 118 and second fiber layer 126 and also fills in the interstitial positions between the various energy-dispersion objects 115. In some embodiments, small gaps exist between the various layers and polymer 211 fills in these gaps. It should be noted that the type of material used to bond the MLCA component together is not necessarily limited to polyurethane but can include any kind of bonding material (e.g., thermoplastics, thermoset resins, other polymers, etc.). In some embodiments, metal inserts in the MLCA component are pre-treated with chemical coatings in order to improve adhesion. In some embodiments, the pre-treated metal inserts are metal inserts having minimal mechanical grip characteristics (i.e., smooth surfaces) such as, for example, metal energy-dispersion objects, steel plates, and lengths of solid steel. In some embodiments, the chemical coating includes THIXON™, (High performance rubber-to-metal bonding agents) which are available through Rohm and Haas, Corporate Headquarters, 100 Independence Mall West, Philadelphia, Pa. 19106 (www.rohmhaas.com/wcm/products/product_line_detail.page?product-line=1000096&application=). In some embodiments, the chemical coating includes Chemlok® (rubber-to-substrate adhesives & coatings), which are available through Lord Corporation, 111 Lord Drive, Cary, N.C. 27511-7923 (www.lord.com/Home/ProductsServices/Adhesives/Rubberto-SubstrateAdhesivesCoatings/tabid/3261/Default.aspx).

Once liquid polymer 211 sets (e.g., by a chemical reaction, and/or by cooling to solidify thermoplastic material, and/or by heating to set a thermosetting material), the MLCA component includes a plurality of layers of energy-dispersion objects 115 bonded together by polymer 211 along with the other MLCA component layers. The resulting MLCA component can then be joined (by bolting, by adhesive, by Velcro™ or other suitable means) to a plurality of other MLCA components to form or repair an armor panel 105. In some embodiments, contoured portion 135 (see FIG. 1B) is formed separately and joined (by bolting, by adhesive, by Velcro™, by polymer bonding, or other suitable means) to the MLCA component fabricated according to FIG. 2A. In some embodiments, contoured portion 135 is formed separately as part of shock-absorbing layer 130, and then shock-absorbing layer 130 (containing the contoured portion 135) is joined to the MLCA component fabricated according to FIG. 2A.

In some embodiments, different polymers 211 are used in different layers of the MLCA component. For example, in some embodiments, an MLCA component is formed according to the following steps:

A. Layer 130 is formed by pouring a first polymer 211 having a first hardness (e.g., 59A-durometer) onto the bottom of mold 205;

B. Once layer 130 has set, layer 120 is formed by placing second fiber layer 126 directly on top of layer 130, pouring a second polymer 211 having a second hardness (e.g., 83A-durometer) over fiber layer 126 such that it is impregnated with polymer 211, placing steel plate 125 directly on top of impregnated fiber layer 126, and pouring more of the second polymer 211 on top of plate 125 in order to bond layer 120 together;

C. Once layer 120 has set, layer 110 is formed by placing first fiber layer 118 directly, then a plurality of layers of energy-dispersion objects 115 are laid down in a closely-packed configuration on top of first fiber layer 118, and finally more of the second polymer 211 (e.g., 83A-durometer polyurethane) is poured directly on top of the plurality of layers of energy-dispersion objects 115 in order to bond the plurality of layers of energy-dispersion objects 115 together with each other and with first fiber layer 118 and to bond completed layer 110 together with the other layers of the MLCA component (e.g., layers 120 and 130).

FIG. 2B is a perspective cross-sectional view of an apparatus 201 and method for fabricating a multi-layer composite armor (MLCA) component under vacuum. In some embodiments, apparatus 201 is substantially similar to apparatus 200 except that vacuum mold 215 replaces casting mold 205. In some embodiments, vacuum mold 215 is evacuated via vacuum port 220 before the liquid polymer 211 is injected through a top port 216. Once the liquid polymer 211 is in place, air is let back into vacuum mold 215 to help press the liquid polymer 211 through the various layers to produce a dense, strong MLCA component (e.g., MLCA component 101 of FIG. 1B). Similarly to apparatus 200, the resulting MLCA component can then be joined (by bolting, by adhesive, by Velcro™ or other suitable means, to a plurality of other MLCA components to form or repair an armor panel 101. In some embodiments, vacuum mold 215 is used to fabricate a MLCA component having different types of polymer 211 in different layers (e.g., using a 59A-durometer polyurethane in layer 130, and using a 83A-durometer polyurethane in layers 120 and 110).

FIG. 2C is a perspective cross-sectional view of an apparatus 202 and method for fabricating the outer encapsulation layer 140 of an MLCA component. In some embodiments, the process is substantially similar to that illustrated in FIG. 2A except that a larger encapsulation mold 225 is used instead of the casting mold 205. In some embodiments, the MLCA component fabricated in mold 205 is placed within mold 225 and a liquid polymer 211 is added from a hose or pipe 210 to form layer 140 such that layer 140 encapsulates the entire component except for the side of the component that will be adjacent to the hull of the vehicle being protected (as illustrated in FIG. 1B, for example). In some embodiments, layer 140 fully encapsulates the MLCA component. In some embodiments, casting mold 225 is approximately 406 mm×406 mm×406 mm (16"×16"×16"). In some embodiments, casting mold 205 is a size other than 406 mm×406 mm×406 mm. In some embodiments, before adding the encapsulation layer 140, contoured portion 135 is joined (by bolting, by adhesive, by Velcro™ or other suitable means) to layer 130 of the MLCA component such that the encapsulated MLCA component includes layer 135 on the vehicle side of the component. In some embodiments, contoured portion 135 is formed separately as part of shock-absorbing layer 130 and shock-absorbing layer 130 (containing contoured portion 135) is joined to the MLCA component before adding the encapsulation layer 140. In some embodiments, shock-absorbing layer 130 (and/or contoured portion 130) is joined to the MLCA component after the encapsulation layer 140 is added. In some embodiments, mold 225 is used with a vacuum system such as illustrated in FIG. 2B.

Figure 3B:
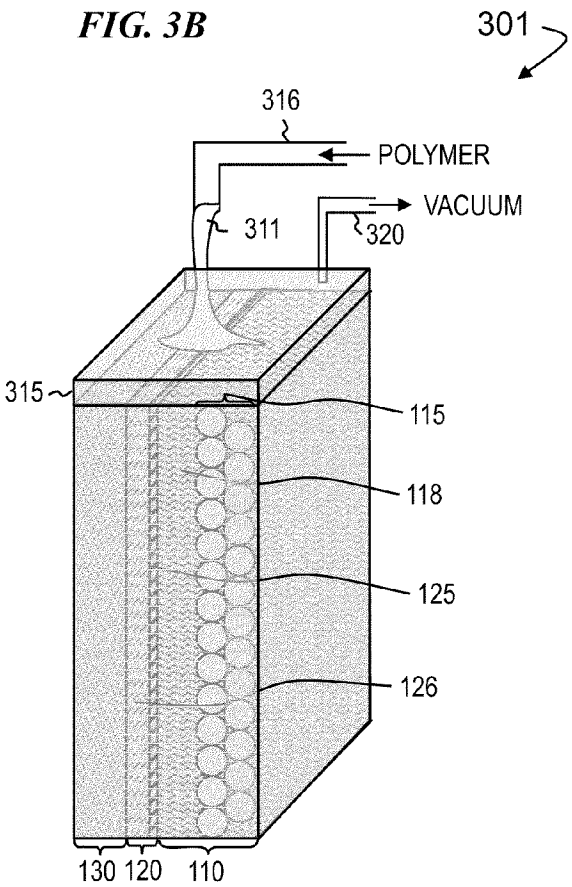
FIG. 3B is a perspective cross-sectional view of an apparatus 300 and method for vertically fabricating a MLCA component under a vacuum.
Figure 3A:
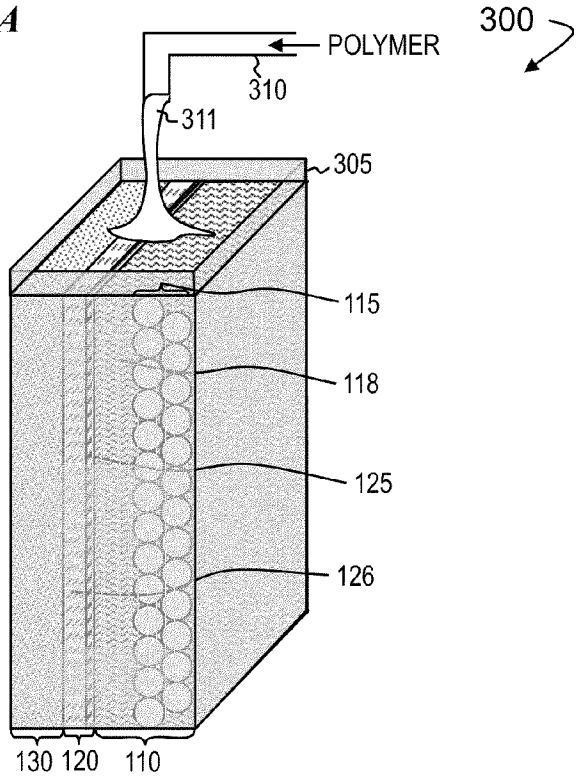
FIG. 3A is a perspective cross-sectional view of an apparatus 300 and method for vertically fabricating an MLCA component.

FIG. 3A is a perspective cross-sectional view of an apparatus 300 and method for vertically fabricating a MLCA component. In some embodiments, apparatus 300 bonds all of the layers of the MLCA component together at once by pouring polymer 311 through the sides of the layers instead of from top to bottom (as illustrated in FIG. 2A). For example, in some embodiments, polymer 311 is poured via a pipe or hose 310 down into a vertical casting mold 305 that is holding the various non-polymer layers such that the side of the MLCA component is on top. In some embodiments, therefore, the various layers are pre-arrayed in their order, and polymer 311 flows between them all in a single pour. In some embodiments, apparatus 300 is used to fabricate an MLCA component having different types of polymer 311 in different layers. In some of these embodiments, thin fibrous or metallic layers (not illustrated) are used to separate the different polymer 311 layers such that the vertical fabrication apparatus 300 can be used without intermixing the different polymers (e.g., in some embodiments, the MLCA component fabricated by apparatus 300 includes layers 130, 120, and 110, and layer 130 includes a first polymer 311 (e.g., 59A-durometer polyurethane) and layers 120 and 110 includes a second polymer 311 (e.g., 83A-durometer polyurethane)).

In some embodiments, in order to use the vertical fabrication apparatus 300, the plurality of layers of energy-dispersion objects 115 are bonded together before adding polymer 311. For example, in some embodiments, the plurality of layers of energy-dispersion objects 115 are assembled in the horizontal position and then bonded together using a heavy coat of bonding agent (e.g., a resin or cement) such that the energy-dispersion objects 115 can be placed in the vertical orientation necessary for apparatus 300. In some embodiments, fibrous layers like first fiber layer 118 and second fiber layer 126 is stretched tightly into the vertical position prior to adding polymer 311. In some embodiments, mold 305 includes notches that hold and space the non-polymer layers (e.g., fiber layers 118 and 126 and steel plate 125).

FIG. 3B is a perspective cross-sectional view of an apparatus 301 and method for vertically fabricating a MLCA component under a vacuum. In some embodiments, apparatus 301 is substantially similar to apparatus 301 except that vacuum mold 315 replaces casting mold 305. In some embodiments, vacuum mold 315 is evacuated via vacuum port 320 before the liquid polymer 311 is injected through a top port 316. Once the liquid polymer 311 is in place, air is let back into vacuum mold 315 to help press the liquid polymer 311 through the various layers to produce a dense, strong MLCA component (e.g., MLCA component 101 of FIG. 1B). Similar to the MLCA component fabricated by apparatus 300, the MLCA component fabricated by apparatus 301 can then be joined (by bolting, by adhesive, by Velcro™ or other suitable means, to a plurality of other MLCA components to form or repair an armor panel 101. In some embodiments, vacuum mold 315 is used to fabricate a MLCA component having different types of polymer 311 in different layers (e.g., using a 59A-durometer polyurethane in layer 130, and using a 83A-durometer polyurethane in layers 120 and 110).

Energy-Dispersion Objects

As used herein, "energy-dispersion objects" are defined as heavy, resilient and hard objects used in a multi-layer composite armor to dissipate the noise, vibration, and energy associated with a ballistic projectile or explosion striking the multi-layer composite armor.

As used herein, a "closely-packed" configuration of energy-dispersion objects is defined as the arrangement of a plurality of energy-dispersion objects in a first layer such that the each one of the plurality of energy-dispersion objects contacts at least three other energy-dispersion objects in the first layer. Multiple layers of energy-dispersion objects can also be closely packed with respect to each other if each energy-dispersion object of a plurality of energy-dispersion objects in a first layer is in contact with at least one energy-dispersion object of a plurality of energy dispersion objects in a second layer. A "hexagonal-closely packed" configuration is defined as the arrangement of a plurality of energy-dispersion objects in a first layer such that each one of the plurality of energy-dispersion objects (of those not in the outermost rows) contacts six other energy-dispersion objects in the first layer. A "square-closely packed" configuration is defined as the arrangement of a plurality of energy-dispersion objects in a first layer such that each one of the plurality of energy-dispersion objects (of those not in the outermost rows) contacts four other energy-dispersion objects in the first layer.

As shown in FIG. 1B, in some embodiments, layer 110 includes a plurality of layers of closely-packed energy-dispersion objects 115 (in some embodiments, spherical objects), such as ball bearings, embedded in a softer material (e.g., a polyurethane). In some embodiments, energy-dispersion objects 115 include steel spheres having an approximately 12.7-mm (0.5-inch) diameter, however other embodiments use other diameters, such as about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, about 29 mm, about 30 mm, or larger than 30 mm. In some embodiments, energy-dispersion objects 115 include approximately 19.84-mm-diameter (25/32-inch-diameter) steel spheres. In some embodiments, energy-dispersion objects having a diameter in the range of 12.7 mm to 25.4 mm (0.5 inches to 1 inch) are preferable for an MLCA component.

In some embodiments, as illustrated in FIG. 1B, the size of energy-dispersion objects 115 is the same in energy-dispersion layers 116 and 117. In other embodiments, energy-dispersion objects 115 have a first size in energy-dispersion layer 116 and a second size in energy-dispersion layer 117 (e.g., in some embodiments, energy-dispersion objects 115 in energy-dispersion layer 116 have a first diameter and energy-dispersion objects 115 in energy-dispersion layer 117 have a second diameter larger than the first diameter).

In some embodiments, energy-dispersion objects 115 have a hardness/malleability that optimizes their energy-dispersion properties. In other words, if energy-dispersion objects 115 are too hard, the strike from a projectile will simply shatter energy-dispersion objects 115 and a minimal amount of energy will be dispersed outwards. On the other hand, if energy-dispersion objects 115 are too soft, energy-dispersion objects 115 will deform around an incoming projectile rather than moving against each other and a minimal amount of energy will be dispersed outwards. In some embodiments, therefore, in order to determine the hardness/malleability of a given batch of energy-dispersion objects 115, a hammer or other hard object is used to strike the objects 115 (the resulting extent of deformation or shattering provides an estimate as to the hardness/malleability of the objects 115). In some embodiments, Q-235 (Chinese grade) stainless steel ball bearings provide the optimal hardness for energy-dispersion objects 115. In some embodiments, low-carbon content steel ball bearings provide the optimal hardness.

In some embodiments, energy-dispersion objects 115 include ceramic cylinders. In some embodiments, energy-dispersion objects 115 include ceramic spheres. In some embodiments, energy-dispersion objects 115 include ceramic-coated steel spheres. In some embodiments, energy-dispersion objects 115 include steel cylinders. In some embodiments, energy-dispersion objects 115 include hemispherical or convex-shaped steel objects.

In some embodiments, energy-dispersion objects 115 include unhardened steel spheres (e.g., 52100 Chrome Alloy grinding and burnishing media), wherein the 52100 Chrome Alloy grinding and burnishing media are available through Royal Steel Ball Products, Inc., 304 East 29$^{th}$ Street, P.O. Box 901, Sterling, Ill. 61081 (www.royalsteelballusa.com/grinding_media.htm). In some embodiments, energy-dispersion objects 115 include hollow steel spheres. In some embodiments, energy-dispersion objects 115 have a pyramid or cone shape. In some embodiments, energy-dispersion objects 115 include gravel (e.g., granite gravel). In some embodiments, energy-dispersion objects 115 include one or more layers of truncated energy-dispersion objects (e.g., by removing up to one-third or more of the inner portion of each of a plurality of the energy-dispersion objects) in order to reduce weight of the panel. In some embodiments, energy-dispersion objects 115 include hollow hardened energy-dispersion objects (also to reduce weight, while still providing the hardened resilient nature of the energy-dispersion objects to transfer energy sideways). In some embodiments, energy-dispersion objects 115 include case-hardened steel spheres such as available through Fox Industries, Inc., 22 Commerce Road, Fairfield, N.J. 07004 (www.foxindustries.com/grinding_media link.html) and Hoover Precision Products Inc., 2200 Pendley Road, Cumming, Ga. 30041 (www.hooverprecision.com/html/hoover_-_carbon_balls.html). As used herein, "case hardening" is defined as the process of hardening the surface of a metal, often a low carbon steel, by infusing elements into the material's surface, forming a thin layer of a harder alloy. In some embodiments, energy-dispersion objects 115 include through-hardened (also referred to as "thru-hardened") steel spheres such as available through Royal Steel Ball Products, Inc., 304 East 29$^{th}$ Street, P.O. Box 901, Sterling, Ill. 61081 (www.royalsteelballusa.com/grinding_media.htm) and Quackenbush Co., Inc., 6711 Sands Road, Crystal Lake, Ill. (www.quackco.com/gndblcyl.htm). As used herein, "through hardening" is defined as the process of hardening an entire piece of metal (as opposed to only hardening the surface), wherein the metal is heated to form austenite (e.g., austenite: a face-centered cubic form of iron or an iron alloy based on this structure), quenched to transform the austenite to martensite, which has a much harder microstructure, and finally tempered (heated to a moderate temperature) to reduce the internal stresses caused by martensite (e.g., martensite: an unstable polymorphic phase of iron which forms at temperatures below the eutectoid because the face-centered cubic structure of austenite becomes unstable—it changes spontaneously to a body-centered structure by shearing action, not diffusion) formation during the quench.

When explosion-formed shrapnel or ballistic projectiles (e.g., EFPs) strike the MLCA component 101, energy-dispersion objects 115 help disintegrate the shrapnel/projectile and spread (mechanically couple the force to a larger area) and/or dissipate (convert some of the energy to heat in the armor) the shrapnel/projectile's kinetic energy before it can reach the hull of vehicle 99 being protected by component 101. The primary advantage provided by multiple layers of energy-dispersion objects is that the energy associated with an incoming ballistic projectile is at least partially dispersed toward the perimeter of the layer of energy-dispersion objects, rather than directing all of the energy straight through the layers in a direction perpendicular to the layers and into the vehicle. The dispersing of energy away from the point of impact of the projectile lowers the pressure applied to the armor at any single point in the armor. In other words, enlarging the area of the energy impact lowers the pressure because the force-per-square-cm or other area is larger than the initial impact area of the projectile. By spreading the force over a greater area, less damage is done to other layers of the armor and to the vehicle hull itself. FIGS. 2A-2C and 3A-3C illustrate this energy-dispersion concept.

Figure 4B:
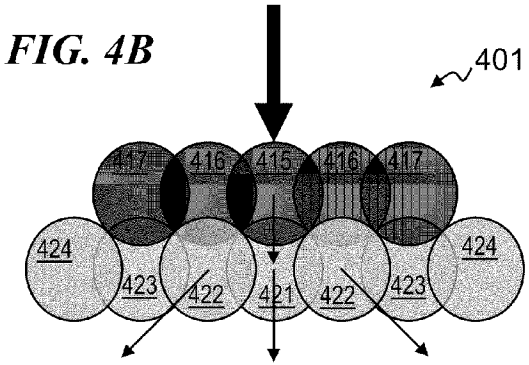
FIG. 4B is a cross-sectional view of the two layers of spherical energy-dispersion objects shown in FIG. 4A.
Figure 4C:
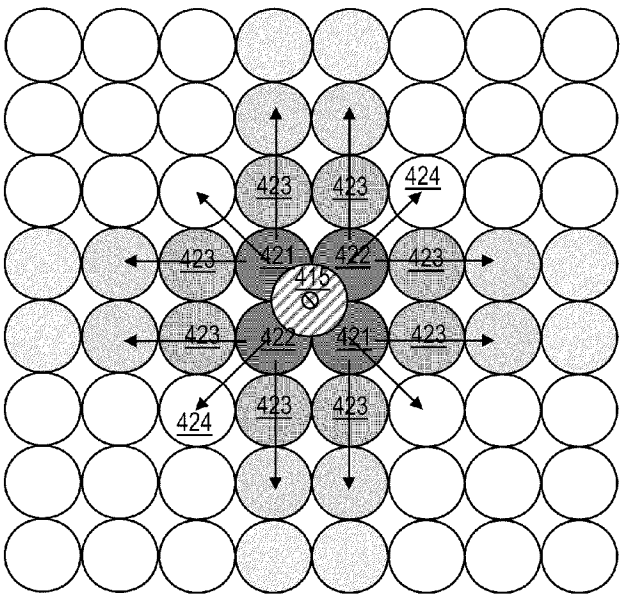
FIG. 4C is a plan view of the bottom layer of energy-dispersion objects from FIG. 4A illustrating the transfer of energy associated with a direct hit to object 415.
Figure 4A:
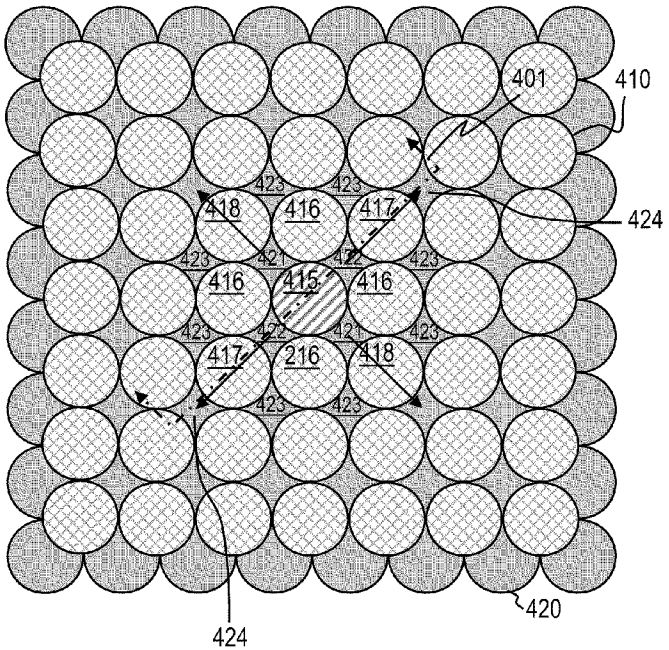
FIG. 4A is a plan view of two layers of spherical energy-dispersion objects in a square-closely packed configuration 400.

FIG. 4A is a plan view of two layers of spherical energy-dispersion objects arranged in a square-closely packed configuration 400. As explained above, the objects in a square-closely packed layer touch four other objects in the same layer. In addition to the closely-packed configuration within a given layer, in some embodiments, the two layers are also in a closely-packed configuration with respect to each other as illustrated in FIG. 4A. That is, each sphere in top layer 410 contacts four other spheres in bottom layer 420. In some embodiments, multiple layers of energy-dispersion objects are not closely packed with respect to each other. In some embodiments, individual layers of energy-dispersion objects are separated from each other by layers of bonding material. In some embodiments, individual layers of energy-dispersion objects are separated by lighter-weight materials (e.g., a polymer, fiber mat, etc.) in order to reduce weight and allow an incoming projectile and moving energy-dispersion objects from a first layer to laterally separate before they impact a second nearby layer of energy-dispersion objects.

For each spherical energy-dispersion object in top layer 410 (e.g., sphere 415) that is struck by an incoming projectile, four spherical energy-dispersion objects (e.g., spheres 421 and 422) in bottom layer 420 are struck by the spherical energy-dispersion object, and these energy-dispersion objects in bottom layer 420 are struck at glancing angles, which transfers much of the original energy from the projectile to energy-dispersion objects traveling in directions having a substantial velocity component perpendicular to the direction of the projectile and parallel to layers 410 and 420. This sideways travel of several energy-dispersion objects both spreads the impact over a larger area and/or redirects the momentum/energy of the projectile in directions other than directly inward to the volume being protected (e.g., the crew compartment and/or engine compartment). The energy transferred to the spherical energy-dispersion objects also reduces the speed of the projectile, allowing the other layers and different materials to stop the slower-moving debris more readily than could be done to the full-speed projectile.

In contrast to the present embodiment of multiple layers of energy-dispersion objects, if a high-speed incoming copper projectile from an EFP strikes a solid steel plate while traveling at, e.g., 1000 to 3000 meters per second, it may pass through even a fairly thick plate (e.g., 152-mm to 254-mm (or more) thick) since the steel to the side of the entry point is not readily moved to the sides of the direction of travel. Unlike a solid steel armor plate that does not readily move sideways from the incoming projectile, the energy-dispersion objects relatively readily move to the side when struck at high velocity (even when embedded in fiber-reinforced polymer), thus transferring much of the energy from a direction of the projectile (e.g., perpendicular to layers 410 and 420) into directions having a substantial component parallel to layers 410 and 420.

FIG. 4B is a cross-sectional view of FIG. 4A, as viewed along line 401. FIG. 4B illustrates how the energy absorbed by sphere 415 causes the spheres below it (spheres 422 and 421) to move away at an angle, rather than going straight down to the next layer. For example, when a ballistic projectile hits the center of sphere 415 at an angle perpendicular to top layer 410, spheres 421 and 422 move down and away from sphere 415 at an approximately forty-five degree angle (the arrow representing sphere 421's pathway actually comes out of the page toward the viewer at an approximately forty-five degree angle).

As illustrated in arrangement 402 of FIG. 4C, each individual layer of energy-dispersion objects also provides energy dissipation. For example, as spheres 421 and 422 move away from sphere 415, they transfer some of their energy to the spheres in contact with them in bottom layer 420 (e.g., some of the energy absorbed by spheres 421 and 422 is transferred to spheres 423 in an outward direction parallel to the plane of layer 420 as illustrated in FIG. 4C). The energy transfer from spheres 421 and 422 to spheres 423 causes spheres 423 to move in an outward direction parallel to the plane of layer 420 regardless of the angle in which spheres 421 and 422 are struck by sphere 415 because spheres 421 and 422 are in the same plane as spheres 423. In addition, however, the square-closely packed configuration of FIG. 4C causes the energy-transfer to spheres 423 and beyond to occur in the cross-like pattern illustrated by FIG. 4C (i.e., spheres 424 receive a minimal amount of energy unless sphere 415 is struck with such force that spheres 422 continue past spheres 423 and into spheres 424).

Returning to FIG. 4A, sphere 415 also transfers some of its energy to the spheres in contact with it in top layer 410 if the ballistic projectile strikes sphere 415 in an off-center location of sphere 415 and/or at some angle other than directly perpendicular, Therefore, in some scenarios, some of the energy absorbed by sphere 415 is transferred to spheres 416 (and to a minimal extent, spheres 418 and 417).

Figure 5B:
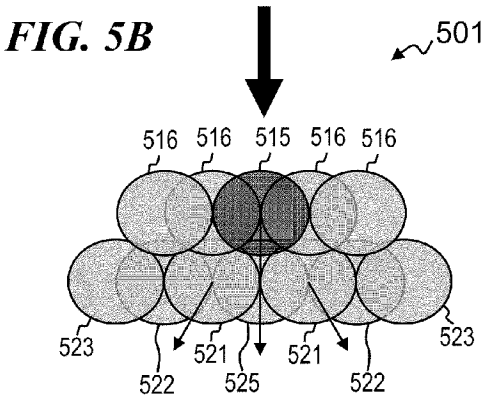
FIG. 5B is a cross-sectional view of the two layers of spherical energy-dispersion objects shown in FIG. 2A.
Figure 5C:
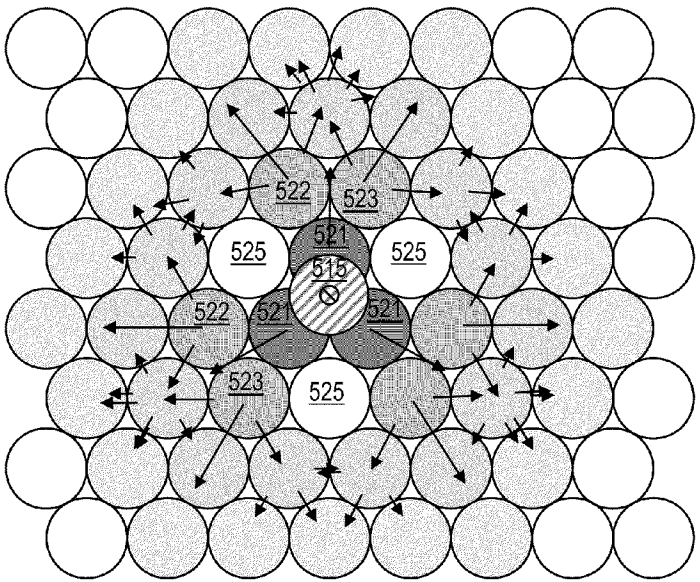
FIG. 5C is a plan view of the bottom layer of energy-dispersion objects from FIG. 5A illustrating the transfer of energy associated with a direct hit to object 515.
Figure 5A:
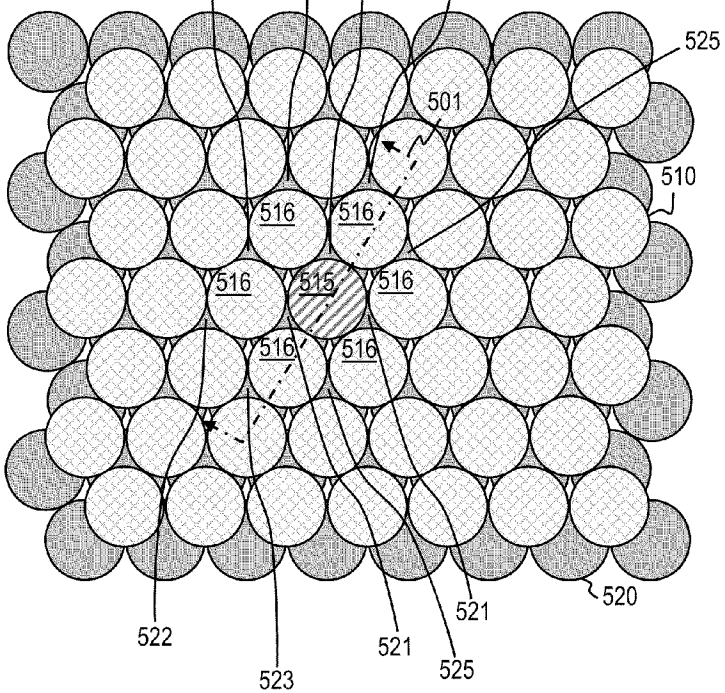
FIG. 5A is a plan view of two layers of spherical energy-dispersion objects in a hexagonal-closely packed configuration 500.

FIG. 5A is a plan view of two layers of spherical energy-dispersion objects, wherein each layer is arranged in a hexagonal-closely packed configuration 500. As explained above, the objects in a hexagonal-closely packed layer touch six other objects in the same layer. In addition to the closely-packed configuration within a given layer, the two layers are also in a closely-packed configuration with respect to each other. That is, each sphere in top layer 510 contacts three other spheres in bottom layer 520. As can be seen by comparing FIG. 4B to FIG. 5B, a hexagonal-closely packed layer of energy-dispersion objects is more dense and therefore heavier than a square-closely packed layer, and a hexagonal-closely packed layer provides less angle of deflection (compared to a vertical line) from one layer to an adjacent layer (e.g., approximately thirty degrees for a hexagonal-closely packed layer and approximately forty-five degrees for a square-closely packed layer). A given layer of hexagonal-closely packed energy-dispersion objects, however, disperses energy from a projectile among significantly more energy-dispersion objects than the number of energy-dispersion objects affected in a given layer of square-closely packed energy-dispersion objects (see FIG. 4C versus FIG. 5C).

FIG. 5B is a cross-sectional view of FIG. 5A, as viewed along line 501. FIG. 5B illustrates how the energy absorbed by sphere 515 causes the spheres below it (spheres 521) to move away at an angle, rather than going straight down to the next layer. For example, when a ballistic projectile hits the center of sphere 515 at an angle perpendicular to top layer 510, spheres 521 move down and away from sphere 515 at an approximately thirty-degree angle (compared to a vertical line running through the middle of sphere 515).

As illustrated in arrangement 502 of FIG. 5C, each individual layer of energy-dispersion objects also provides energy dissipation. For example, as spheres 521 move away from sphere 515, they transfer some of their energy to the spheres in contact with them in bottom layer 520 (e.g., some of the energy absorbed by spheres 521 is transferred to spheres 522 and 523 in an outward direction parallel to the plane of layer 520 as illustrated in FIG. 5C). The energy transfer from spheres 521 to spheres 522 and 523 causes spheres 522 and 523 to move in an outward direction parallel to the plane of layer 520 regardless of the angle in which spheres 521 are struck by sphere 515 because spheres 521 are in the same plane as spheres 522 and 523. In addition, due to the hexagonal-closely packed configuration of FIG. 5C (which is more closely packed than the square-closely packed configuration of FIG. 4C), virtually all of the spheres in layer 520 absorb some of the energy from spheres 521 (as illustrated in FIG. 5C, the only spheres that receive minimal energy transfer are spheres 525). Therefore, although a hexagonal-closely packed configuration adds more weight to a multi-layer composite armor than a square-closely packed configuration, a hexagonal configuration also provides more energy-dispersion than the square configuration.

Returning to FIG. 5A, sphere 515 also transfers some of its energy to the spheres in contact with it in top layer 510 if the ballistic projectile strikes sphere 515 in an off-center location of sphere 515 and/or at some angle other than directly perpendicular. Therefore, in some scenarios, some of the energy absorbed by sphere 515 is transferred to spheres 516 and beyond.

Figure 6A:
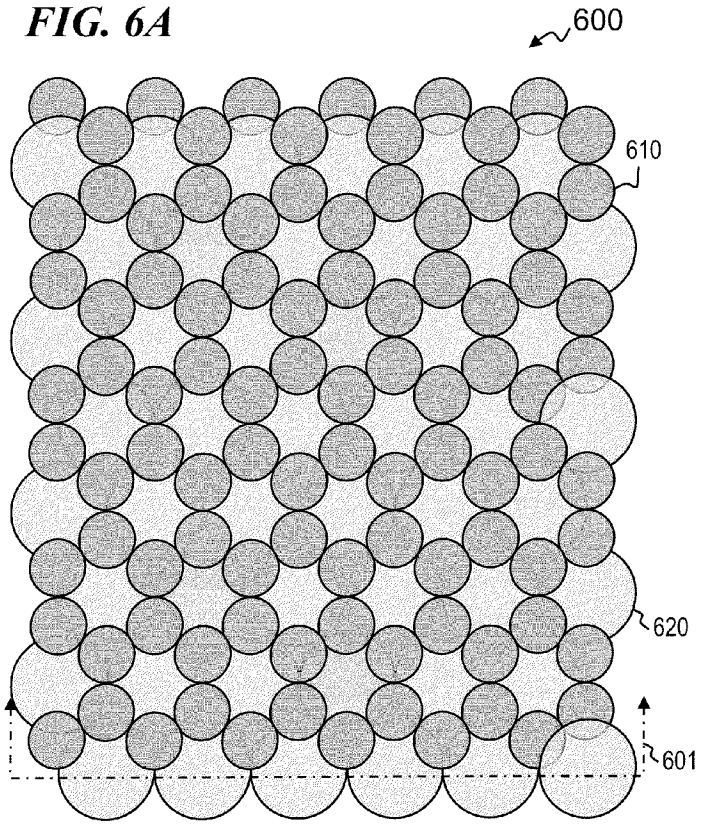
FIG. 6A is a plan view of two layers of spherical energy-dispersion objects having different-sized objects in each layer.
Figure 6B:
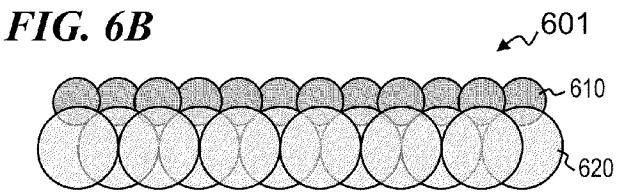
FIG. 6B is a cross-sectional view of the layers illustrated in FIG. 6A, as viewed along line 601.

FIG. 6A is a plan view of two layers of spherical energy-dispersion objects having different-sized objects in each layer. In some embodiments, as illustrated in FIG. 6A, the top layer 610 has a first diameter and the bottom layer 620 has a second diameter, and the second diameter is larger than the first diameter. The energy-dispersion objects of layer 610 are in a closely-packed configuration such that each energy-dispersion object in layer 610 contacts three other energy-dispersion objects in that layer. The energy-dispersion objects in layer 620, however, are in a hexagonal-closely packed configuration. FIG. 6B is a cross-sectional view of the layers illustrated in FIG. 6A, as viewed along line 601. FIGS. 6A and 6B show that the smaller spherical energy-dispersion objects are in top layer 610, but in some embodiments, this arrangement is reversed (i.e., in some embodiments, the larger spherical energy-dispersion objects are in top layer 610 and the smaller spherical energy-dispersion objects are in bottom layer 620).

Figure 7A:
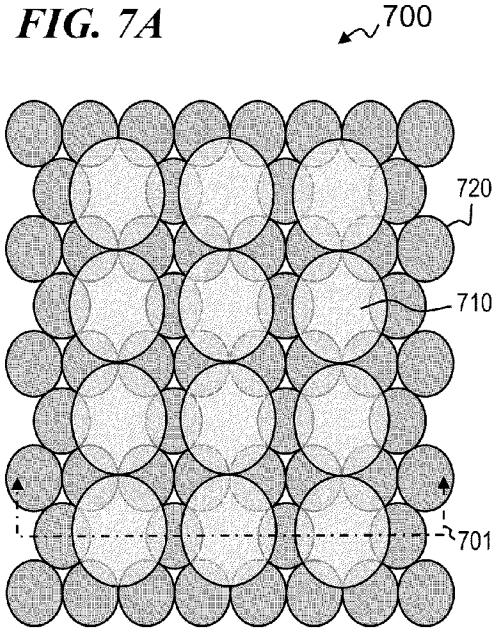
FIG. 7A a plan view of another pattern embodiment for two layers of spherical energy-dispersion objects having different-sized objects in each layer.
Figure 7B:
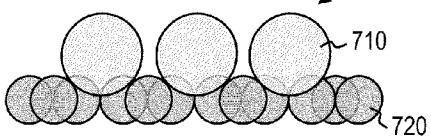
FIG. 7B is a cross-sectional view of the layers illustrated in FIG. 7A, as viewed along line 701.

FIG. 7A is a plan view of another pattern embodiment for two layers of spherical energy-dispersion objects having different-sized objects in each layer. In this embodiment, each energy-dispersion object in layer 710 contacts two other energy-dispersion objects in layer 710, whereas each energy-dispersion object in layer 720 contacts four other energy-dispersion objects in layer 720 (a square-closely packed configuration). FIG. 7B is a cross-sectional view of the layers illustrated in FIG. 7A, as viewed along line 701. FIGS. 7A and 7B show that the larger spherical energy-dispersion objects are in top layer 710, but in some embodiments, this arrangement is reversed (i.e., in some embodiments, the larger spherical energy-dispersion objects are in bottom layer 720 and the smaller spherical energy-dispersion objects are in top layer 710).

Figure 8A:
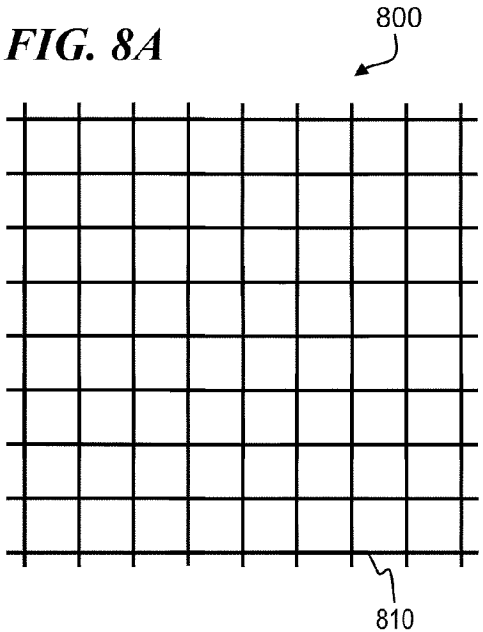
FIG. 8A is a plan view of an energy-dispersion frame 800 used to arrange and hold a plurality of energy-dispersion objects in a square-closely packed configuration during the formation of a layer (or layers) of energy-dispersion objects.

FIG. 8A is a plan view of an energy-dispersion frame 800 used to arrange and hold a plurality of energy-dispersion objects in place during the formation of a layer (or multiple layers) of energy-dispersion objects. FIG. 8B is a side view of frame 800. In some embodiments, frame 800 is used to arrange the plurality of energy-dispersion objects in the desired closely-packed configuration within mold 205 (see FIG. 2A). In some embodiments, frame 800 is left in mold 205 during the addition of polymer 211. In some embodiments, frame 800 is configured such that it can be removed from mold 205 before the addition of polymer 211 without disrupting the arrangement of energy-dispersion objects created by frame 800.

In some embodiments, as illustrated in FIG. 8A, frame 800 is configured such that the placement of energy-dispersion objects onto frame 800 creates a square-closely packed configuration of energy-dispersion objects. In some embodiments, frame 800 is a wire mesh (i.e., a plurality of wire strands 810 twisted together in a 0°-90° arrangement). In some embodiments, frame 800 is a fibrous mesh. In some embodiments, frame 800 is a four-sided (plus a bottom side) wire basket (e.g., a bottom surface as illustrated in FIG. 8B and four side surfaces (not illustrated) generally perpendicular to the bottom surface).

In some embodiments, as illustrated in FIG. 8A, frame 800 includes a jig having spaces (openings, indentations, protrusions, slots or the like) for holding sixty-four energy-dispersion objects. In other embodiments, frame 800 includes a suitable number of spaces including, for example, 16, 20, 24, 25, 30, 35, 36, 42, 49, 50, 56, 72, 81, or 100 (or any other suitable number).

Figure 8C:
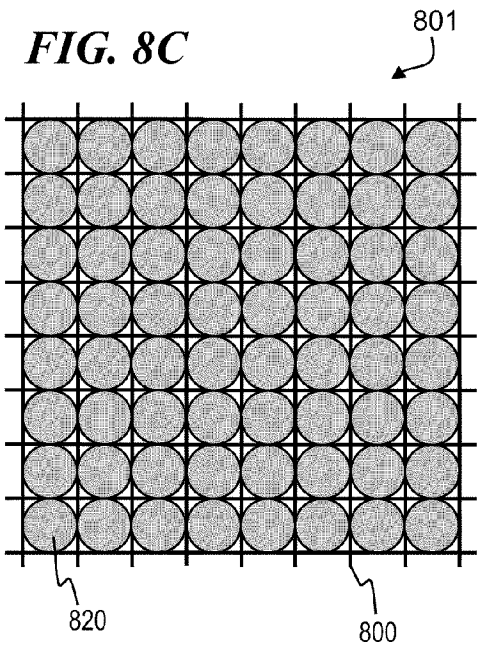
FIG. 8C is a plan view of a first layer of energy-dispersion objects placed onto the frame illustrated in FIG. 8A.

FIG. 8C is a plan view of a configuration 801 that includes a first layer of energy-dispersion objects 820 placed onto frame 800. FIG. 8D is a side view of configuration 801. In some embodiments, as illustrated in FIG. 8C, each of a plurality of energy-dispersion objects in first layer 820 touches four other energy-dispersion objects in first layer 820 (a square-closely packed configuration).

Figure 8E:
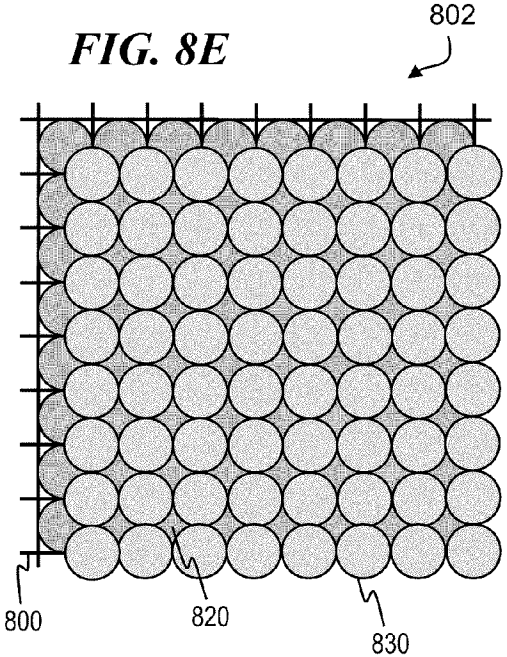
FIG. 8E is a plan view of two adjacent layers of energy-dispersion objects placed onto the frame illustrated in FIG. 8A.
Figure 8B:
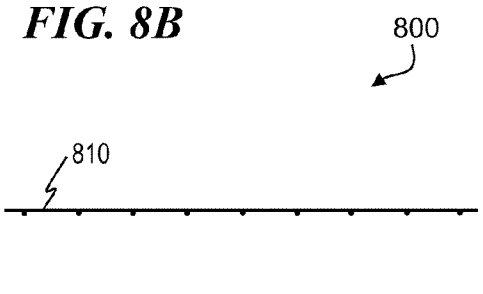
FIG. 8B is a side view of FIG. 8A.
Figure 8D:
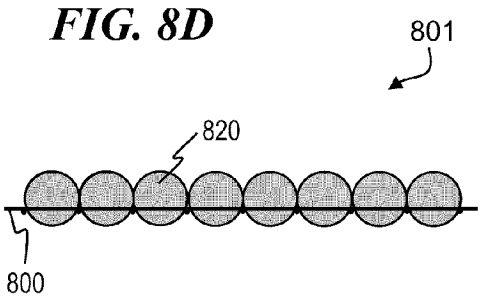
FIG. 8D is a side view of FIG. 8C.
Figure 8F:
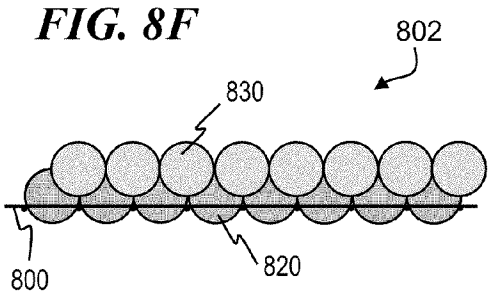
FIG. 8F is a side view of FIG. 8E.

FIG. 8E is a plan view of a configuration 802 that includes a second layer of energy-dispersion objects 830 placed directly on top of first layer 820. FIG. 8F is a side view of configuration 802. As FIG. 8E illustrates, the square-closely packed configuration of first layer 820 is retained in second layer 830 by placing an energy-dispersion object on top of the junction formed between each group of four energy-dispersion objects in first layer 820. As seen in FIG. 8F, the two layers 820 and 830 are also in a closely-packed configuration with respect to each other. That is, a given energy-dispersion object in FIGS. 8E and 8F touches four other energy-dispersion objects in the same layer and four other energy-dispersion objects in the layer directly adjacent to it. In some embodiments, individual layers of energy-dispersion objects are not closely-packed with respect to each other. For example, in some embodiments, a layer of polymer or other material separates two energy-dispersion object layers.

Figures 9A, 9B, 9C, 9D, 9E, 9F:
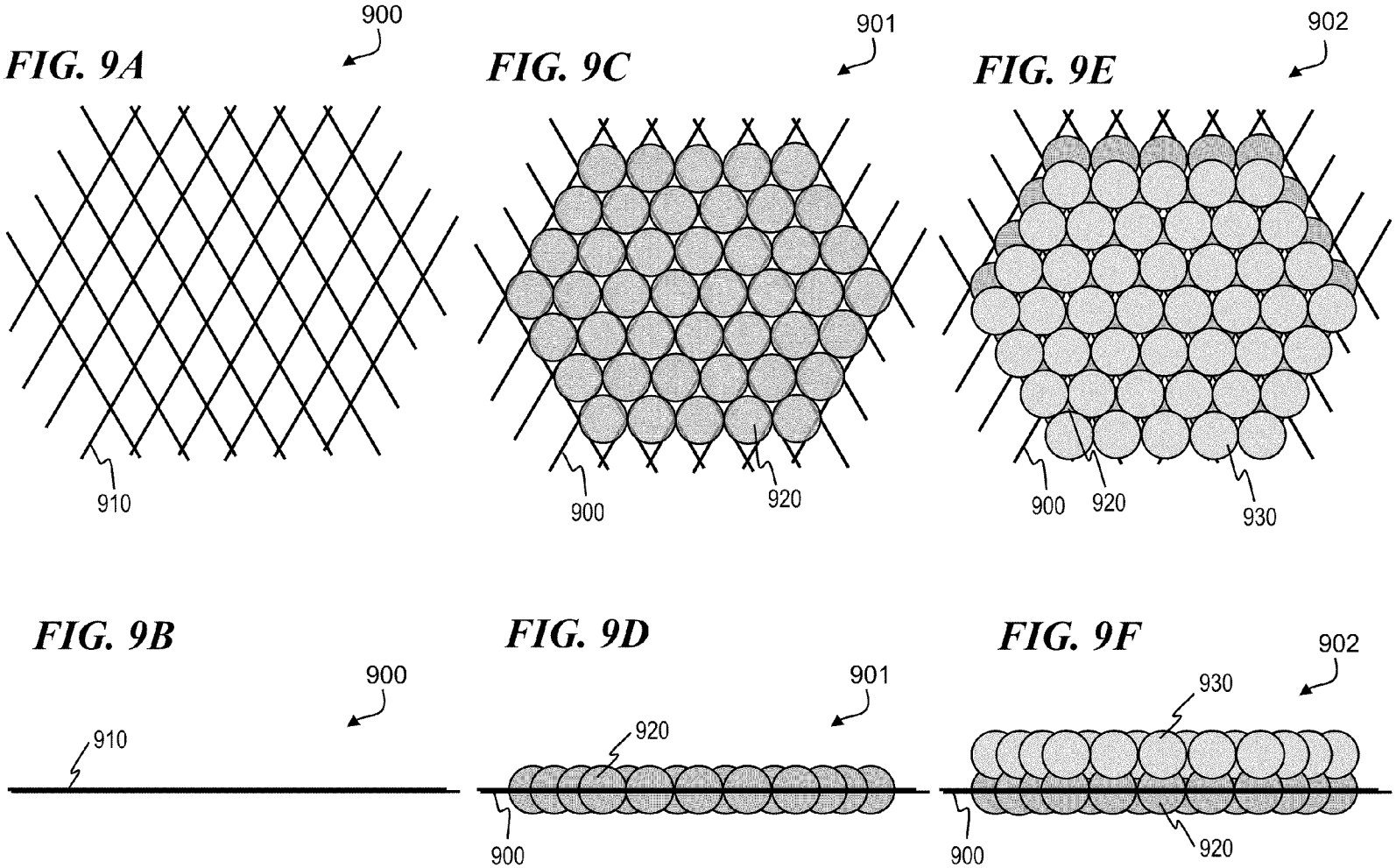
FIG. 9A is a plan view of an energy-dispersion frame used to arrange and hold a plurality of energy-dispersion objects in a hexagonal-closely packed configuration during the formation of a layer (or layers) of energy-dispersion objects.
FIG. 9B is a side view of FIG. 9A.
FIG. 9C is a plan view of a first layer of energy-dispersion objects placed onto the frame illustrated in FIG. 9A.
FIG. 9D is a side view of FIG. 9C.
FIG. 9E is a plan view of two adjacent layers of energy-dispersion objects placed onto the frame illustrated in FIG. 9A.
FIG. 9F is a side view of FIG. 9E.

FIG. 9A is a plan view of an energy-dispersion frame 900 used to arrange and hold a plurality of energy-dispersion objects in place during the formation of a layer (or multiple layers) of energy-dispersion objects. FIG. 9B is a side view of frame 900. Similar to frame 800, in some embodiments, frame 900 is used to arrange the plurality of energy-dispersion objects in the desired closely-packed configuration within mold 205 (see FIG. 2A).

In some embodiments, as illustrated in FIG. 9A, frame 900 is configured such that the placement of energy-dispersion objects onto frame 900 creates a hexagonal-closely packed configuration of energy-dispersion objects. In some embodiments, frame 900 is a wire mesh (i.e., a plurality of wire strands 910 twisted together in a 0°-90° arrangement). In some embodiments, frame 900 is a fibrous mesh. In some embodiments, frame 900 is a five-sided wire basket (e.g., a bottom surface as illustrated in FIG. 9B and four side surfaces (not illustrated) perpendicular to the bottom surface). In some embodiments, as illustrated in FIG. 9A, frame 900 includes a jig having spaces (openings, indentations, protrusions, slots or the like) for holding forty-four energy-dispersion objects. In other embodiments, frame 900 includes a suitable number of spaces including, for example, 16, 20, 24, 25, 30, 35, 36, 42, 49, 50, 56, 72, 81, or 100 (or any other suitable number).

FIG. 9C is a plan view of a configuration 901 that includes a first layer of energy-dispersion objects 920 placed onto frame 900. FIG. 9D is a side view of configuration 901. In some embodiments, as illustrated in FIG. 9C, each of a plurality of energy-dispersion objects in first layer 920 touches six other energy-dispersion objects in first layer 920 (a hexagonal-closely packed configuration).

FIG. 9E is a plan view of a configuration 902 that includes a second layer of energy-dispersion objects 930 placed directly on top of first layer 920. FIG. 9F is a side view of configuration 902. As FIG. 9E illustrates, the hexagonal-closely packed configuration of first layer 920 is retained in second layer 930 by placing an energy-dispersion object on top of the junction formed between each group of three energy-dispersion objects in first layer 920. As seen in FIG. 9F, the two layers 920 and 930 are also in a closely-packed configuration with respect to each other. That is, a given energy-dispersion object in FIGS. 9E and 9F touches four other energy-dispersion objects in the same layer and four other energy-dispersion objects in the layer directly adjacent to it. In some embodiments, individual layers of energy-dispersion objects are not closely packed with respect to each other. For example, in some embodiments, a layer of polymer or other material separate two energy-dispersion object layers.

Figure 10A:
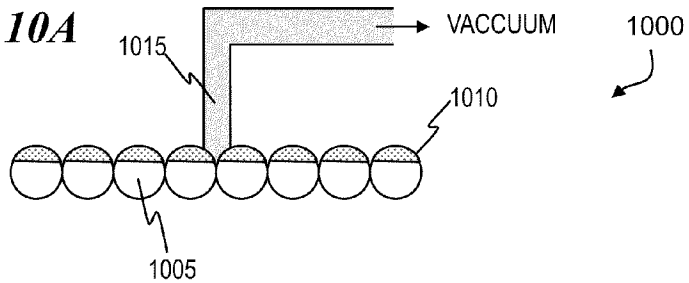
FIG. 10A is a side view of a vacuum mold used to arrange a layer of energy-dispersion objects for a multi-layer composite armor component.
Figure 10B:
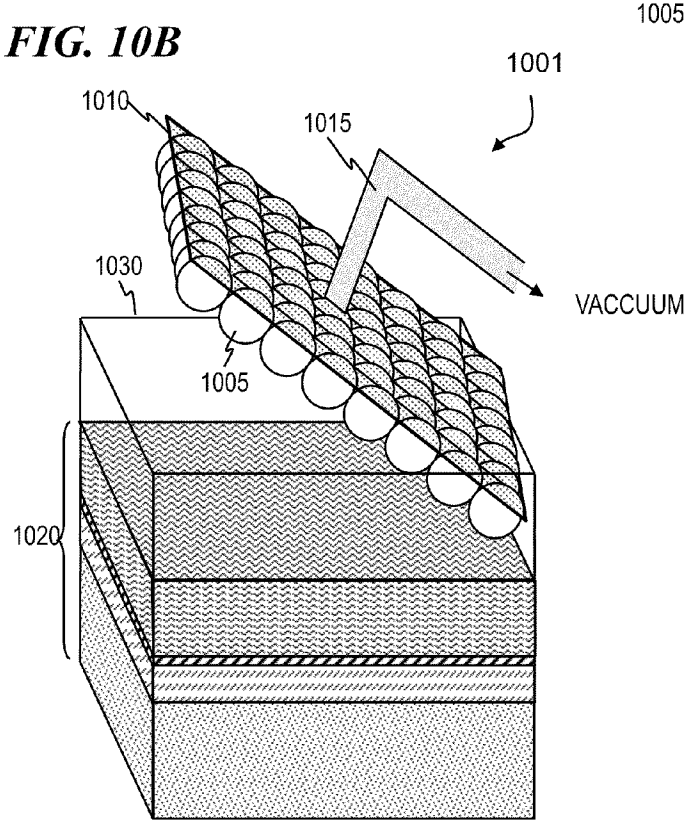
FIG. 10B is a perspective view of the placement of a layer of energy-dispersion objects using the vacuum mold.
Figure 10C:
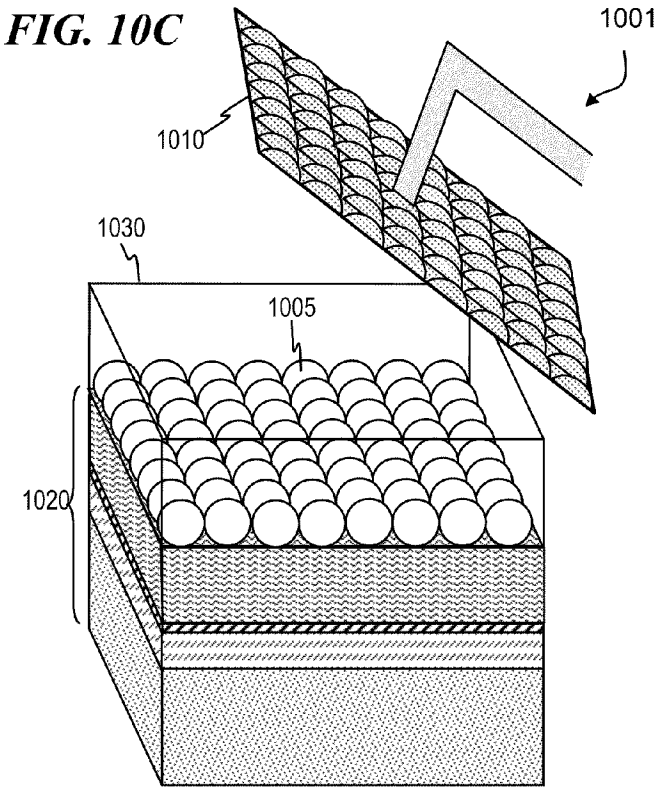
FIG. 10C is a perspective view of a layer of energy-dispersion objects put into place within a multi-layer composite armor mold by the vacuum mold.

In some embodiments, individual layers of energy-dispersion objects are formed without using a frame such as frame 800 or frame 900. In some such embodiments, a plurality of energy-dispersion objects are placed directly onto an adjacent armor layer and the closely-packed configuration of the energy-dispersion objects keeps the energy-dispersion objects in the correct position during the bonding of the energy-dispersion objects with the adjacent armor layer. In some embodiments, individual layers of energy-dispersion objects are added to multiple layers of composite material by using a vacuum mold such as illustrated in FIG. 10A, which is a side-view 1000 of a vacuum mold 1010. In some embodiments, vacuum mold 1010 is formed from a plaster casting of a square (or, in some embodiments, hexagonal) closely-packed configuration, which includes small holes drilled at the apex of each spherical chamber in mold 1010. A vacuum fitting and pipe 1015 is fastened over the top of mold 1010, and a vacuum is pulled on mold 1010 such that the air being pulled through the small holes in the spherical chambers of mold 1010 pulls the energy-dispersion objects 1005 into these chambers and holds them there, in the proper pattern. The evacuated mold 1010 is placed into a casting mold 1030 containing previously bonded layers of composite material 1020, as illustrated by configuration 1001 in FIG. 10B. When energy-dispersion objects 1005 are all in place, the vacuum is turned off and energy-dispersion objects 1005 are released from mold 1010 onto the top layer of composite material 1020, as illustrated by FIG. 10C. Finally, the energy-dispersion objects are bonded to composite material 1020 and to each other via the hardening of a polymer (e.g., a polyurethane) poured into casting mold 1030 (using, for example, hose 210 and polymer 211 from FIG. 2A).

Reinforcement Layers

In some embodiments, the MLCA component fabricated according to the present invention is reinforced with embedded fibers/fabric and/or metal plates. In some embodiments, embedded fiber layers are made from a relatively strong material that has a high tensile strength (i.e., the fiber layer will yield rather than break like a brittle material; e.g., basalt fibers, glass fibers (e.g., E-glass), steel fibers, elongated armor elements (e.g., lengths of solid steel or high-strength steel or stainless-steel cables, for example) aramids (e.g., Kevlar®) fibers, and ceramic chips). Aramid fibers are a class of heat-resistant and strong synthetic fibers. They are used in aerospace and military applications, for ballistic-rated body armor fabric, and as an asbestos substitute. The name is a shortened form of "aromatic polyamide". They are fibers in which the chain molecules are highly oriented along the fiber axis, so the strength of the chemical bond can be exploited.

In some embodiments, as described above, the MLCA component includes a first fiber reinforcement layer 118 and a second fiber reinforcement layer 120. These embedded fiber layers provide reinforcement for the bonding agent used in a given layer, and, when placed on the vehicle side of one or more layers of energy-dispersion objects, the embedded fiber layers also provide containment (i.e., the embedded fiber layers help prevent energy-dispersion objects from passing directly through the MLCA component when energy-dispersion objects absorb energy from an incoming projectile).

Figure 11B:
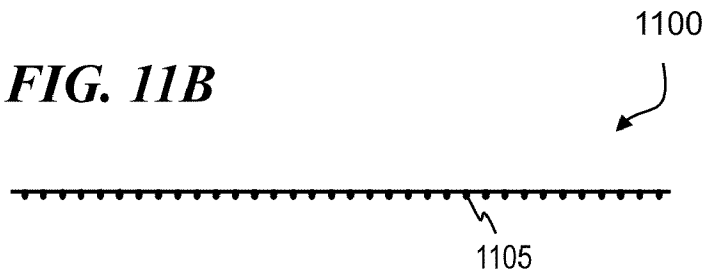
FIG. 11B is a side view of the fiber layer illustrated in FIG. 11A.
Figure 11A:
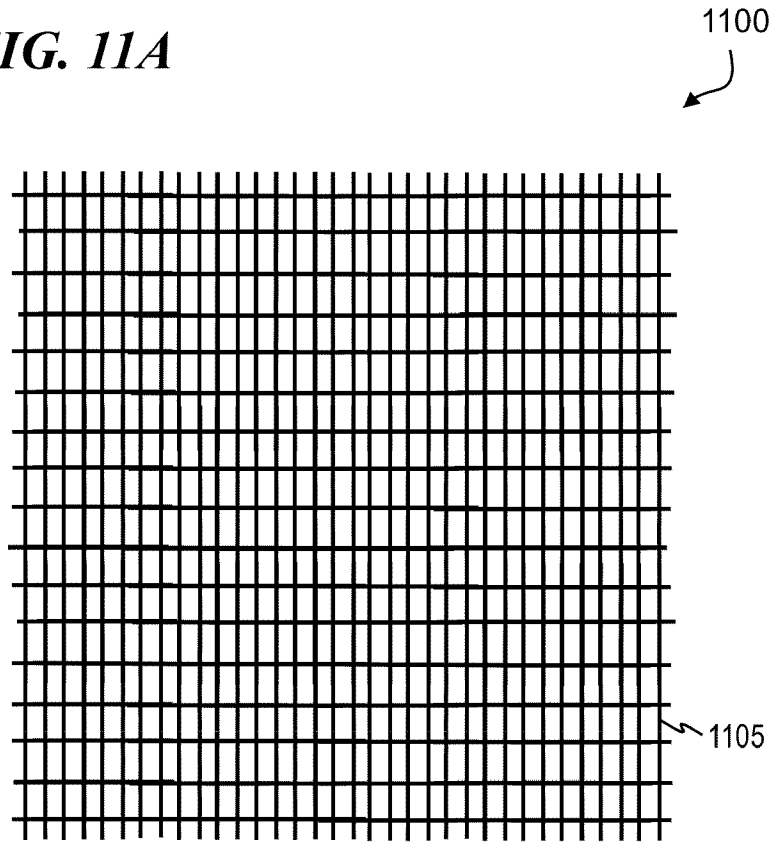
FIG. 11A is a plan view of a fiber layer 1100 used to reinforce an MLCA component.

FIG. 11A is a plan view of a fiber layer 1100 used to reinforce an MLCA component. FIG. 11B is a side view of fiber layer 1100. In some embodiments, as illustrated in FIG. 11A, fiber layer 1100 includes a hardwire steel fiber sheet (i.e., a plurality of wire strands 1105 twisted together in a 0°-90° arrangement (i.e., the plurality of wires include a set of vertical and horizontal wires that make 90-degree angles with each other)). In some embodiments, fiber layer 1100 includes a steel fiber mesh fabric. In some embodiments, a plurality of fiber layers 1100 are placed adjacent to each other within an MLCA component in a 0°-90° configuration (i.e., the individual sheets of hardwire steel fiber form 90-degree angles with adjacent sheets). In some embodiments, individual fiber layers 1100 are separated from each other within an MLCA component. In some embodiments, fiber layer 1100 is placed adjacent to other fiber reinforcement layers (e.g., in some embodiments, a plurality of adjacent hardwire steel fiber sheets 1100 (wherein the adjacent hardwire steel fiber sheets are in a 0°-90° configuration with respect to each other) are placed on the strike-face side of another fiber reinforcement layer).

In some embodiments, embedded fibers are placed next to or near metal plates (e.g., plate 125 of FIG. 1B) within the MLCA component in order to increase the containment capabilities of the component. For example, in some embodiments, a fiber reinforced metal plate (i.e., a metal plate with one or more fiber layers adjacent to it on the non-strike-face side of the metal plate) placed on the non-strike-face side of a plurality of energy-dispersion objects helps contain or catch the energy-dispersion objects as they move through the MLCA component toward the vehicle hull during a projectile strike. In other embodiments, a metal plate reinforced fiber layer (i.e., a fiber layer with one or more metal plates adjacent to it on the non-strike-face side of the fiber layer) is placed on the non-strike-face side of a plurality of energy-dispersion objects. Since many of the energy-dispersion objects 115 from layer 110 strike the metal plate 125 at a shallow angle (e.g., 45 degrees), the energy-dispersion objects are more likely to be deflected or stopped rather than passing through. In some embodiments, metal plate 125 is a stainless steel plate. In some embodiments, metal plate 125 is a perforated stainless steel plate. In some embodiments, metal plate 125 includes high-strength stainless steel such as types 304, 316, 347 or other suitable alloys. In some embodiments, multiple layers of adjacent metal plates are embedded within the MLCA component on the non-strike-face side of a plurality of energy-dispersion objects. In some embodiments, three adjacent stainless steel plates, each having 3.175-mm (⅛-inch) thickness, are embedded on the non-strike-face side of a plurality of energy-dispersion objects. In some embodiments, three adjacent bainite steel plates (e.g., obtained from FSP: 11825 29 Mile Road, Washington Township, Mich. 48095, (www.bainitesteel.com)), each having 3.175-mm (⅛-inch) thickness, are embedded on the non-strike-face side of a plurality of energy-dispersion objects.

In some embodiments, metal plate 125 includes steel that is reinforced and/or strengthened using a bainite or other suitable process of hardening. (Bainite is a mostly metallic substance that exists in steel after certain heat treatments. First described by Davenport, E. S. and Edgar Bain, it forms when austenite (a solution of carbon in iron) is rapidly cooled past a critical temperature of 723° C. (about 1333° F.). A fine non-lamellar structure, bainite commonly consists of ferrite and cementite. It is similar in constitution to pearlite, but with the ferrite forming by a displacive mechanism similar to martensite formation, usually followed by precipitation of carbides from the supersaturated ferrite or austenite. When formed during continuous cooling, the cooling rate to form bainite is higher than that required to form pearlite, but lower than that to form martensite, in steel of the same composition. Bainite is generally stronger but less ductile than pearlite. In some embodiments, metal plate 125 includes 1774 Aluminum with T4 hardening.

In some embodiments, fiber reinforcement layers (e.g., layer 118 of FIG. 1B) are woven into a loose-weave (e.g., in some embodiments, with warf and woof fibers spaced on 1-mm centers to form fabric with square openings of less than 1 mm) fabric that allows the polymer to flow through more easily, and many layers of the fabric are used to cover the holes of other layers. In some embodiments, fiber reinforcement layers are cut into chip-sized pieces (e.g., 1 cm to 4 cm in diameter square pieces). In some embodiments, fiber reinforcement layers include basalt fibers, glass fibers, steel fibers, aramid fibers, and/or ceramic or fabric chips pressed into a dense mat with minimal binders (such as epoxy resins). This hard fiber layer is better able to stop the remaining parts of the projectile and energy-dispersion object debris because of the transfer of momentum to large mass over a large area traveling at a much smaller velocity than the original projectile.

Shock-Absorbing Layers

As used herein, a "shock-absorbing layer" is defined as a layer within a multi-layer composite armor that provides the greatest shock-absorption capacity of any of the layers within the armor. In other words, while all of the layers within the multi-layer composite armor described by the present invention provide some shock-absorption, a shock-absorbing layer like layer 130 in FIG. 1B is specifically designed to provide the most shock-absorption of all of the layers. In some embodiments, for example, shock-absorbing layer 130 includes 59A-durometer polyurethane, which has a lower durometer value than 83A polyurethane and 93A polyurethane and therefore provides the highest elasticity and shock absorption of all of the layers in the multi-layer composite armor. In some embodiments, shock-absorbing layer 130 includes a gel, liquid, or other elastic material.

In some embodiments, the shock-absorbing layer also includes a contour pattern (e.g., having a surface with patterns such as scallops, ripples, hemispheres, bumps, indentations, ridges, protrusions, holes, checkerboard recesses, etc.) on the non-strike-face side of the shock-absorbing layer in order to provide increased shock absorption and reduced weight (e.g., contoured portion 135 in FIG. 1B). In some embodiments, the contour pattern includes the same polymer (e.g., 59A polyurethane) as found in shock-absorbing layer 130. In some embodiments, the contour pattern is formed as part of the fabrication of shock-absorbing layer 130. The use of a contour pattern on the non-strike-face side of the shock-absorbing layer creates a hardness gradient that decreases in hardness when moving away from the strike-face side of the shock-absorbing layer because the contours, in effect, replace polymer material with air. The hardness gradient provides increased shock-absorption without having to provide a lower durometer material.

FIGS. 12A-12G illustrate contour patterns that can used as part of the shock-absorbing layer 130 of the present invention, according to some embodiments. In each of these figures, the contour pattern is illustrated as being joined to the bottom (i.e., the side closest to the vehicle) of the multiple composite layers 1210 that make up the rest of the MLCA component. Also illustrated in each figure is an encapsulation layer 1215, which is substantially similar to the encapsulation layer 140, discussed above. In some embodiments, the contour pattern is not joined to the bottom of the multiple composite layers 1210, but rather is placed in an inner or strike-face layer of the MLCA component.

Figure 12B:
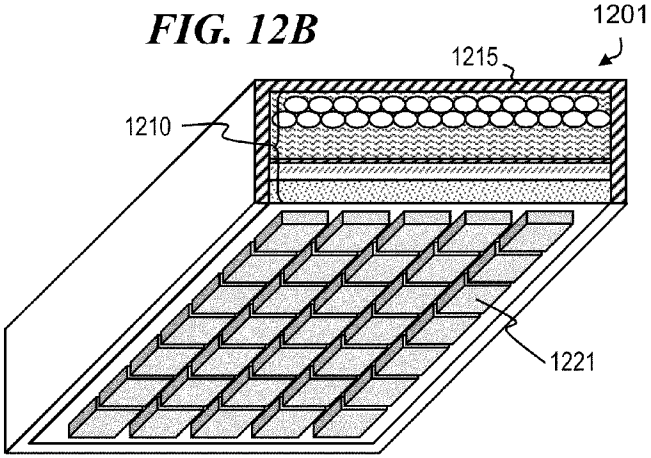
FIG. 12B is a perspective cross-section of a grid-protrusion contour pattern 1221 attached to the vehicle side of an MLCA component 1201.
Figure 12A:
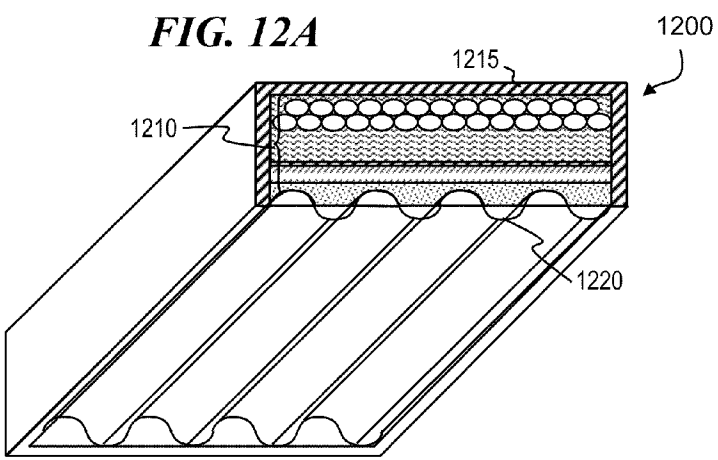
FIG. 12A is a perspective cross-section of a scalloped contour pattern 1220 attached to the vehicle side of an MLCA component 1200.
Figure 12D:
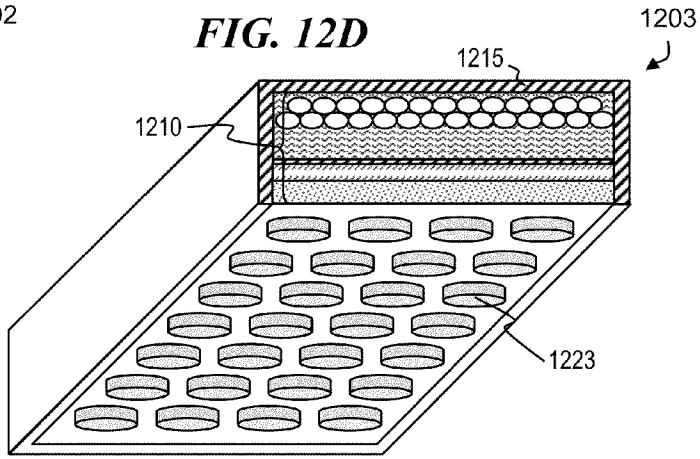
FIG. 12D is a perspective cross-section of a cylindrical-protrusion contour pattern 1223 attached to the vehicle side of an MLCA component 1203.
Figure 12C:
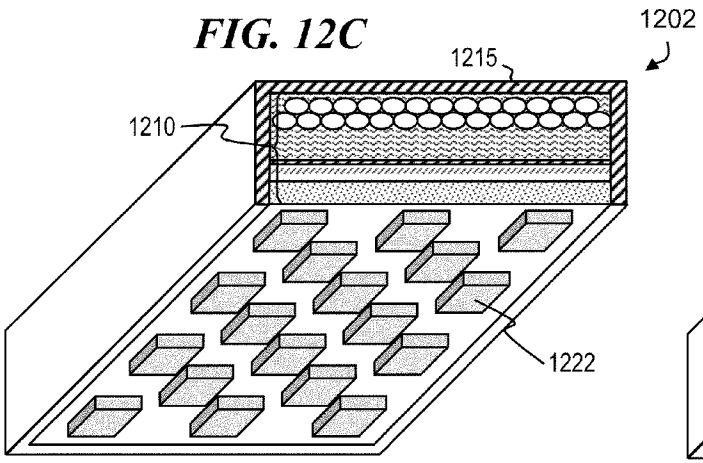
FIG. 12C is a perspective cross-section of a checkerboard-protrusion contour pattern 1222 attached to the vehicle side of an MLCA component 1202.
Figure 12F:
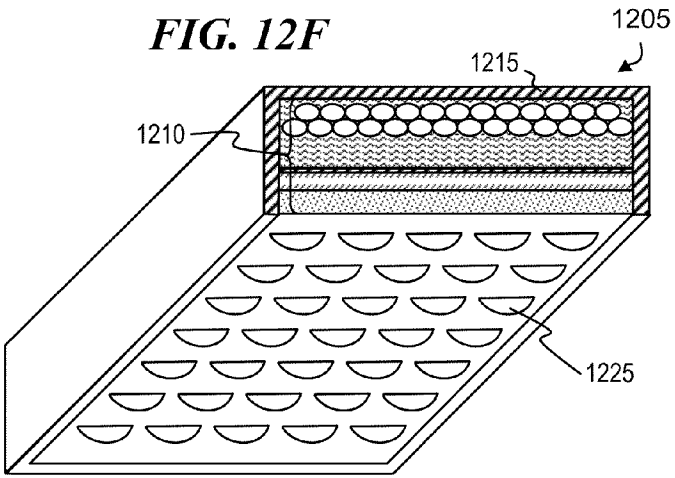
FIG. 12F is a perspective cross-section of a hemispherical contour pattern 1225 attached to the vehicle side of an MLCA component 1205.
Figure 12E:
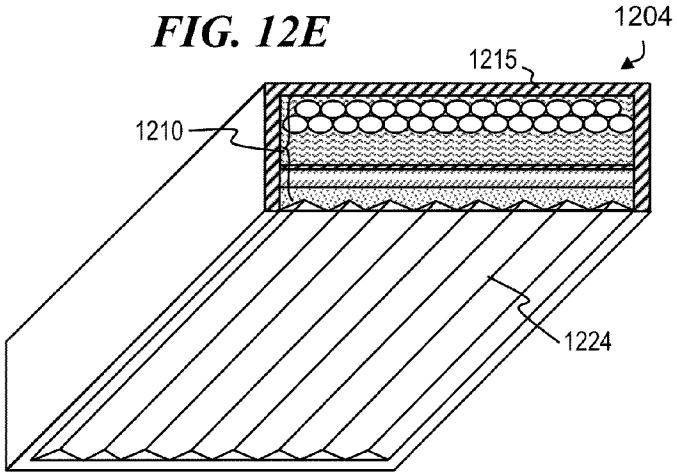
FIG. 12E is a perspective cross-section of a ridged contour pattern 1224 attached to the vehicle side of an MLCA component 1204.
Figure 12G:
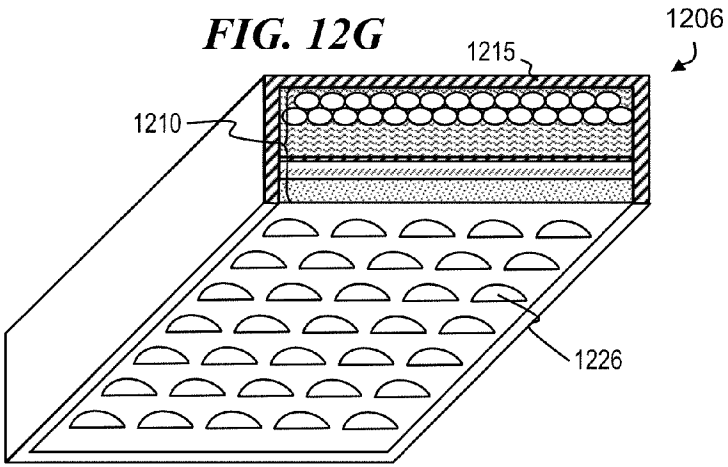
FIG. 12G is a perspective cross-section of a recessed-hemispherical contour pattern 1226 attached to the vehicle side of an MLCA component 1206.

FIG. 12A is a perspective cross-section of an MLCA component 1200 that includes a scalloped contour pattern 1220 attached to the vehicle side of MLCA component 1200. FIG. 12B is a perspective cross-section of an MLCA component 1201 that includes a grid-protrusion contour pattern 1221 attached to the vehicle side of MLCA component 1201. FIG. 12C is a perspective cross-section 1202 of an MLCA component 1202 that includes a checkerboard-protrusion contour pattern 1222 attached to the vehicle side of MLCA component 1202. FIG. 12D is a perspective cross-section 1203 of an MLCA component 1203 that includes a cylindrical-protrusion contour pattern 1223 attached to the vehicle side of MLCA component 1203. FIG. 12E is a perspective cross-section of an MLCA component 1204 that includes a ridged contour pattern 1224 (e.g., substantially parallel elongated protrusions (ridges separated by grooves)) attached to the vehicle side of MLCA component 1204. In other embodiments, ridges having other geometrical shapes and/or angular relationships are used. FIG. 12F is a perspective cross-section of an MLCA component 1205 that includes a hemispherical contour pattern 1225 of bumps (protrusions each having a outward-pointing hemispherical contour) attached to the vehicle side of MLCA component 1205. In other embodiments, protrusions having other geometrical shapes are used. FIG. 12G is a perspective cross-section of an MLCA component 1206 that includes a pattern 1226 of indentations (e.g., each having a recessed-hemispherical contour) attached to the vehicle side of MLCA component 1206. In other embodiments, indentations having other geometrical shapes are used.

Figure 13B:
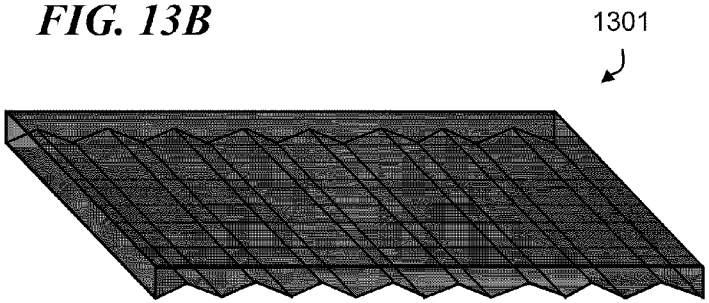
FIG. 13B is a perspective view of a ridged contour pattern 1301 formed using the contour form illustrated in FIG. 13A.
Figure 13A:
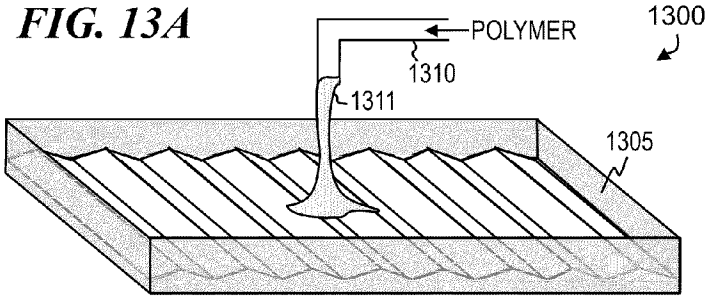
FIG. 13A is a perspective view of an apparatus 1300 and method for fabricating a contour layer.

In some embodiments, the contour layer of the multi-layer composite armor (MLCA) component is fabricated separately from the other layers of the MLCA component and then attached to the vehicle side of shock-absorbing layer 130. In other embodiments, a contour pattern is formed on the vehicle side of shock-absorbing layer 130 as part of the fabrication of shock-absorbing layer 130. FIG. 13A is a perspective view of an apparatus 1300 and method for fabricating the contour layer. In some embodiments, a polymer 1311 (e.g., 59A polyurethane) is poured from a hose or pipe 1310 onto a contour form 1305 that includes the contour pattern desired to be made (e.g., a ridged pattern as illustrated in FIG. 13A). After the polymer sets (e.g., by a chemical reaction, and/or by cooling to solidify thermoplastic material, and/or by heating to set a thermosetting material), the completed layer is attached (by bolting, by adhesive, by Velcro™ or other suitable means) to the MLCA component on a side of the component closest to the vehicle being protected. In some embodiments, contour form 1305 is used under vacuum in a manner similar to that illustrated in FIG. 2B and FIG. 3B. FIG. 13B is a perspective view of a ridged contour pattern 1301 formed using contour form 1305.

Other Embodiments

FIG. 14 is a perspective view of an armor-enhanced stationary structure 1400, according to an example embodiment. In some embodiments, each of the outer walls 1410 incorporate one or more of the designs of FIGS. 1B, 1C, and/or 1D as at least part of their armor.

Figure 15B:
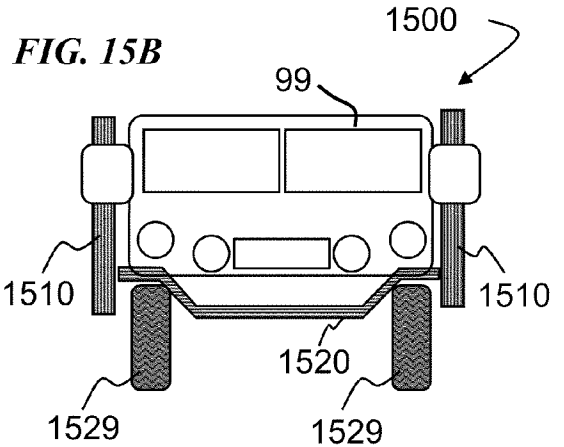
FIG. 15B is a front view of an armor-enhanced combat vehicle 1500, according to an example embodiment.
Figure 15D:
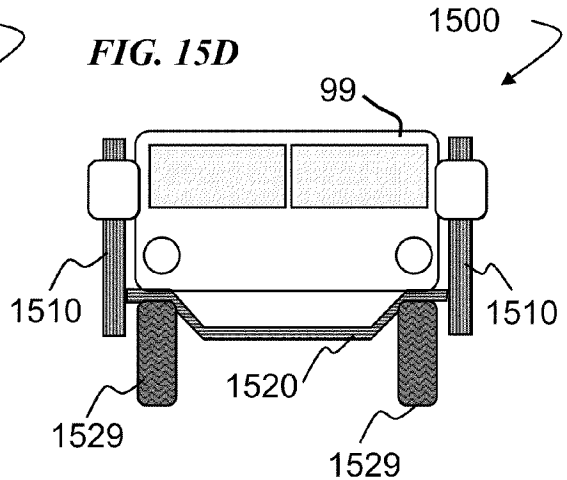
FIG. 15D is a rear view of an armor-enhanced combat vehicle 1500, according to an example embodiment.
Figure 15A:
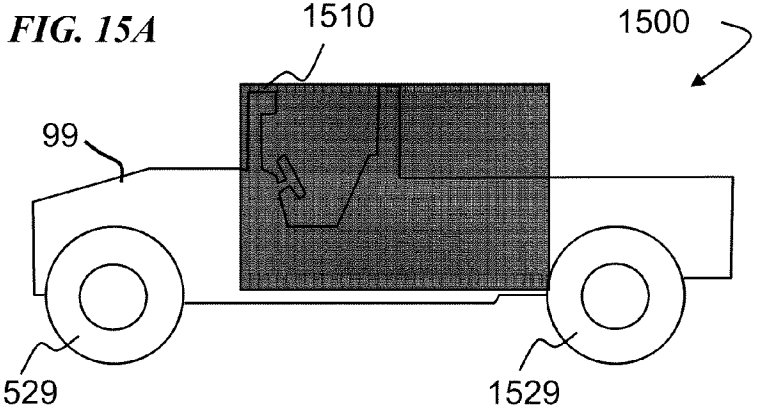
FIG. 15A is a side view of an armor-enhanced combat vehicle 1500, according to an example embodiment.
Figure 15C:
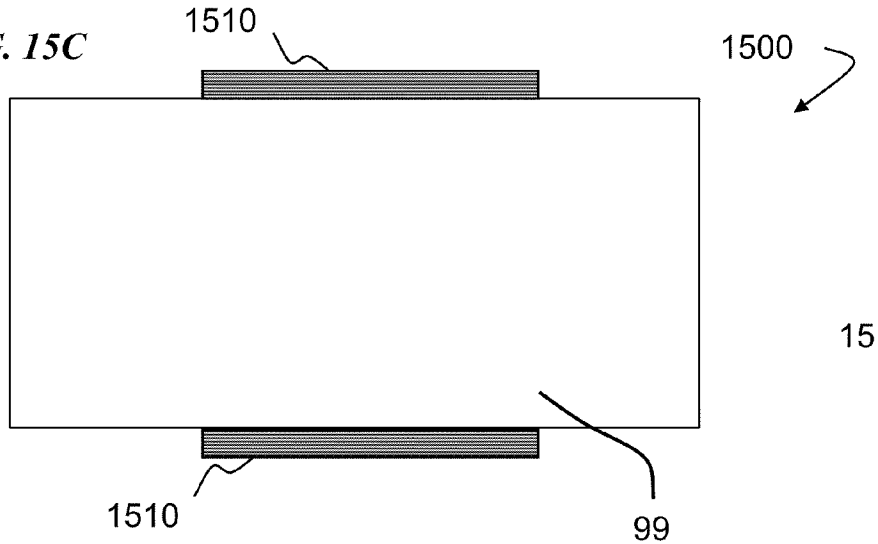
FIG. 15C is a plan view of an armor-enhanced combat vehicle 1500, according to an example embodiment.

FIG. 15A is a side view of an armor-enhanced combat vehicle 1500, according to an example embodiment. FIG. 15B is a front view of an armor-enhanced combat vehicle 1500, according to an example embodiment. FIG. 15C is a plan view of an armor-enhanced combat vehicle 1500, according to an example embodiment. FIG. 15D is a rear view of an armor-enhanced combat vehicle 1500, according to an example embodiment. In some embodiments, side armor 1510 includes one or more of the designs of FIGS. 1B, 1C, and/or 1D as at least part of their armor. In some embodiments, bottom armor 1510 includes one or more of the designs of FIGS. 1B, 1C, and/or 1D as at least part of their armor. In some embodiments, vehicle 99 includes tires 1529 and underbelly armor 1520. In some embodiments, the first layer of bonding material in underbelly armor 1520 has a high durometer (e.g., 93A-durometer polyurethane) such that elongation and acceleration of the first multi-layer composite armor is mitigated. In some embodiments, bainite-hardened steel and Kevlar® sheeting are placed in the strike-face layer of underbelly armor 1520 in order to substantially stop explosion fragments (e.g., 20 mm fragments) from penetrating underbelly armor 1520.

Figure 16:
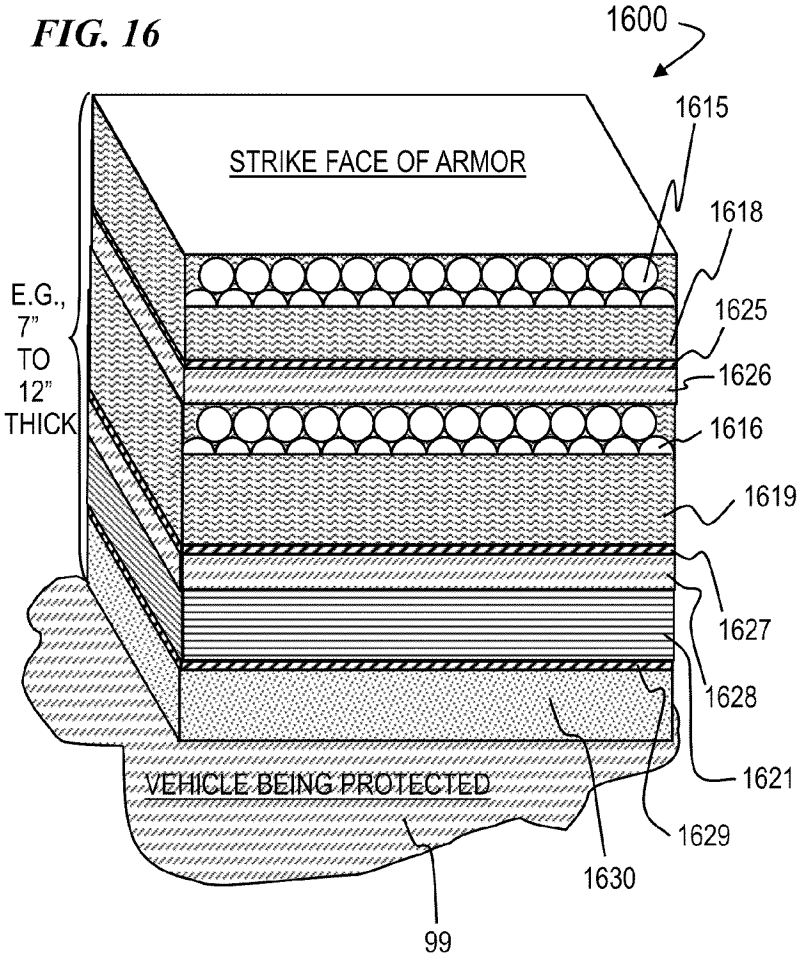
FIG. 16 is a perspective cross-section of a multi-layer composite armor (MLCA) component 1600 used to protect a vehicle 99.

FIG. 16 is a perspective cross-section of a multi-layer composite armor (MLCA) component 1600 used to protect a vehicle 99. In some embodiments, MLCA component 1600 includes a plurality of layers of hemispherical energy-dispersion objects. In some embodiments, MLCA component 1600 includes the following specifications: energy-dispersion objects 1615 include approximately 12.7-mm-diameter (½-inch-diameter) stainless-steel ball bearings in the top layer closely packed (either square or hexagonal, depending on the embodiment) with approximately 12.7-mm-diameter (½-inch-diameter) steel hemispheres in the bottom layer, fiber reinforcement layer 1618 includes a basalt fiber mat/mesh (10- to 27-micron-diameter fibers embedded in thermosetting or thermoplastic polymer), metal plate 1625 includes an approximately 3.175-mm-thick (⅛-inch-thick) stainless-steel plate, fiber reinforcement layer 1626 includes an approximately 12.7-mm-thick (½-inch-thick) ester polyurethane with aramid fiber reinforcement, energy-dispersion objects 1616 include 12.7-mm-diameter (½-inch-diameter) stainless-steel ball bearings in the top layer closely packed with approximately 12.7-mm-diameter (½-inch-diameter) steel hemispheres in the bottom layer, fiber reinforcement layer 1619 includes a basalt fiber mat/mesh (10- to 27-micron-diameter fibers embedded in thermosetting or thermoplastic polymer), metal plate 1627 includes an approximately 3.175-mm-thick (⅛-inch-thick) stainless-steel plate, fiber reinforcement layer 1628 includes an approximately 12.7-mm-thick (½-inch-thick) deadened non-rebounding polyurethane with fiber reinforcement, fiber reinforcement layer

1621 includes an approximately 25.4-mm-thick (1-inch-thick) basalt fiber cross-laid straight fiber mat, metal plate 1629 includes an approximately 3.175-mm-thick (⅛-inch-thick) stainless-steel plate, and shock-absorbing layer 1630 includes 25.4-mm-thick (1-inch-thick) deadened non-rebounding polyurethane.

Figure 17:
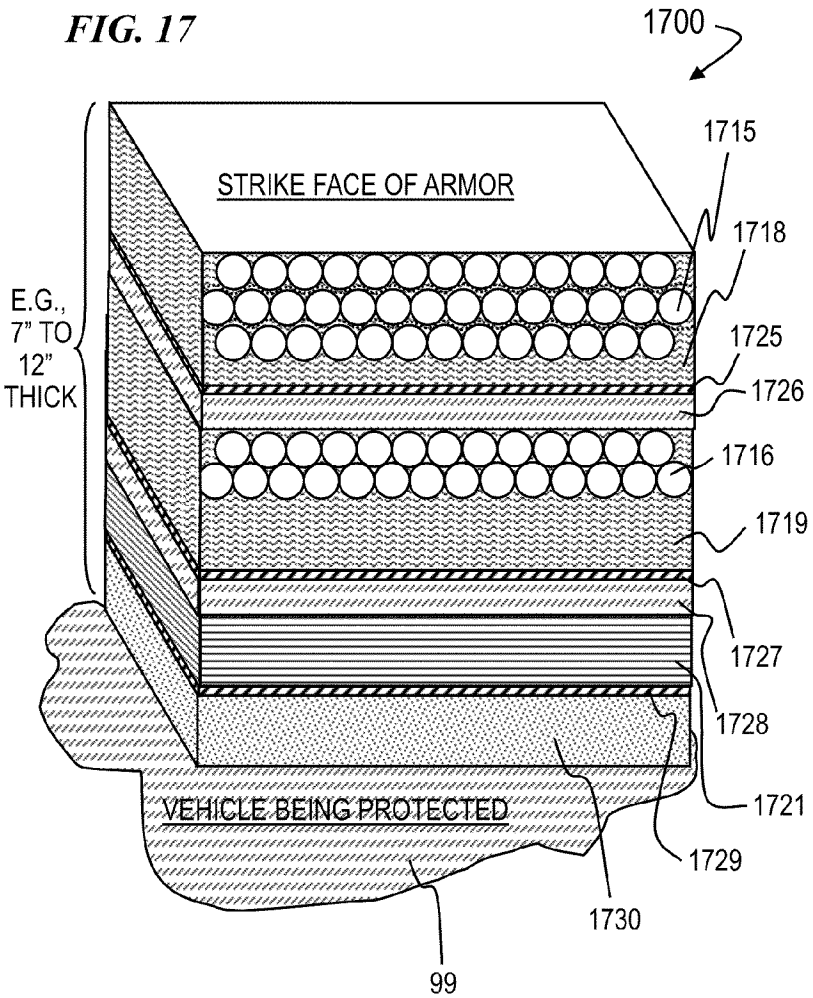
FIG. 17 is a perspective cross-section of a multi-layer composite armor (MLCA) component 1700 used to protect a vehicle 99.

FIG. 17 is a perspective cross-section of a multi-layer composite armor (MLCA) component 1700 used to protect a vehicle 99. In some embodiments, MLCA component 1700 includes the following specifications: energy-dispersion objects 1715 include three adjacent layers of closely packed approximately 12.7-mm-diameter (½-inch-diameter) stainless-steel ball bearings, fiber reinforcement layer 1718 includes a basalt fiber mat/mesh (10- to 27-micron-diameter fibers embedded in thermosetting or thermoplastic polymer), metal plate 1725 includes an approximately 3.175-mm-thick (⅛-inch-thick) stainless-steel plate, fiber reinforcement layer 1726 includes an approximately 12.7-mm-thick (½-inch-thick) ester polyurethane with aramid fiber reinforcement, energy-dispersion objects 1716 includes two adjacent layers of closely packed approximately 12.7-mm-diameter (½-inch-diameter) stainless steel ball bearings, fiber reinforcement layer 1719 includes a basalt fiber mat/mesh (10- to 27-micron-diameter fibers embedded in thermosetting or thermoplastic polymer), metal plate 1727 includes an approximately 3.175-mm-thick (⅛-inch-thick) stainless steel plate, fiber reinforcement layer 1728 includes an approximately 12.7-mm-thick (½-inch-thick) deadened non-rebounding polyurethane with fiber reinforcement, fiber reinforcement layer 1721 includes an approximately 25.4-mm-thick (1-inch-thick) basalt fiber cross-laid straight fiber mat, metal plate 1729 includes an approximately 3.175-mm-thick (⅛-inch-thick) stainless-steel plate, and shock-absorbing layer 1730 includes an approximately 25.4-mm-thick (1-inch-thick) deadened non-rebounding polyurethane.

Figure 18:
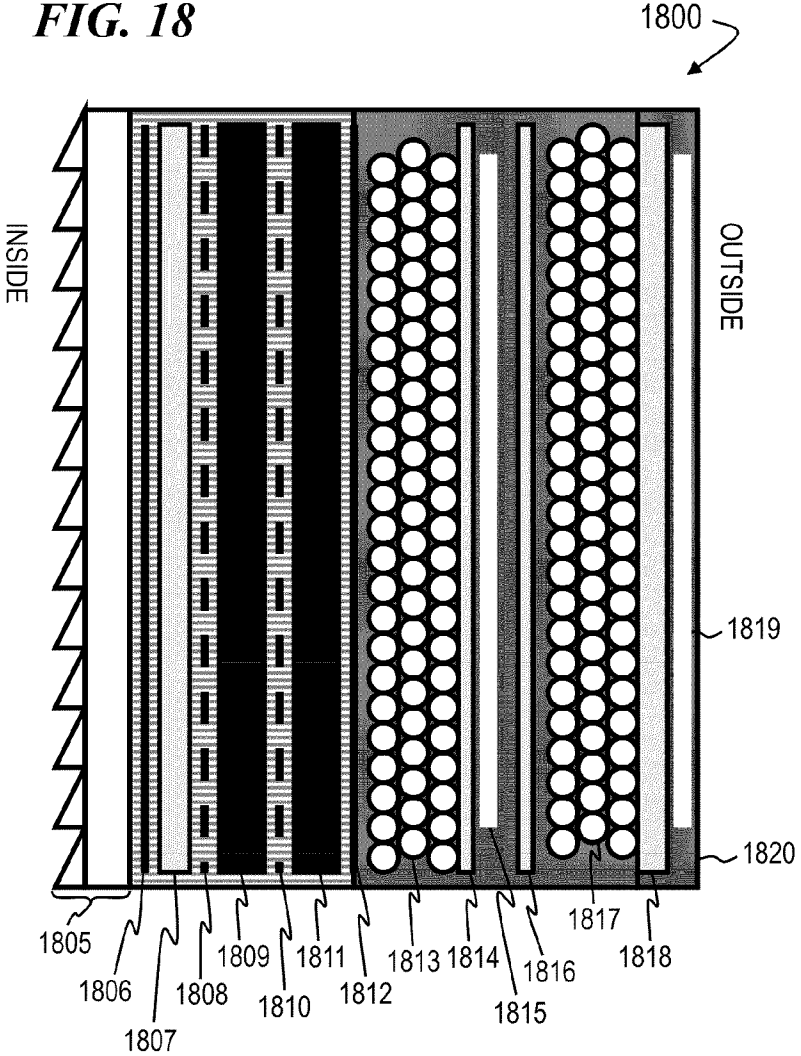
FIG. 18 is a cross-section of a multi-layer composite armor (MLCA) component 1800.

FIG. 18 is a cross-section of a multi-layer composite armor (MLCA) component 1800. In some embodiments, MLCA component 1800 has a pre-encapsulation thickness of approximately 257 mm (10⅛"), a weight of approximately 113 kg (249 pounds), and a density of approximately 682.95 kg-per-square-meter (139.88 pounds-per-square-foot (lbs/ft$^2$)). In some embodiments, MLCA component 1800 includes the following specifications: layer 1805 includes 59A-durometer polyurethane; layer 1806 includes a ⅛" (about 3 mm) thick stainless steel plate with a 59A-durometer polyurethane bonding layer on the strike-face side; layer 1807 includes an about 13-mm-thick (0.50"-thick) E-glass (electric-grade glass) ballistic composite, layer 1808 includes two sub-layers of hardwire mixed with 59A-durometer polyurethane; layer 1809 includes an about 25-mm-thick (1"-thick) basalt fiber; layer 1810 includes two sub-layers of hardwire mixed with 59A-durometer polyurethane; layer 1811 includes an about 25-mm-thick (1"-thick) basalt fiber with an about 6-mm-thick (0.25"-thick) layer of 59A polyurethane on the strike-face side; layer 1812 includes an about 3-mm-thick (⅛"-thick) stainless steel plate with a 59A-durometer bonding sub-layer on the strike-face side of the steel plate; layer 1813 includes three layers of about 13-mm-diameter (0.50"-diameter) steel ball bearings in a square-closely packed configuration mixed in with 83A-durometer polyurethane; layer 1814 includes an about 6-m-thick (0.25"-thick) Pacific Bulletproof® (level 3) ballistic composite with an about 3-mm-thick (⅛"-thick) 83A-durometer polyurethane on the strike-face side; layer 1815 includes an about 10-mm-thick (⅜"-thick) ceramic tile with an about 6-mm-thick (0.25"-thick) 83A-durometer polyurethane on the strike-face side; layer 1816 includes an about 6-mm-thick (0.25"-thick) glass; layer 1817 includes three layers of about 19-mm-diameter (0.75"-diameter) steel ball bearings in a square-closely packed configuration mixed in with 83A-durometer polyurethane; layer 1818 includes an about 13-mm-thick (0.50"-thick) E-glass (electric-grade glass) ballistic composite with an about 3-mm-thick (⅛"-thick) 93A polyurethane on the strike-face side; layer 1819 includes an about 10-mm-thick (⅜"-thick) ceramic tile; and encapsulation layer 1820 includes an about 6-mm-thick (0.25"-thick) 93A-durometer polyurethane.

Figure 19:
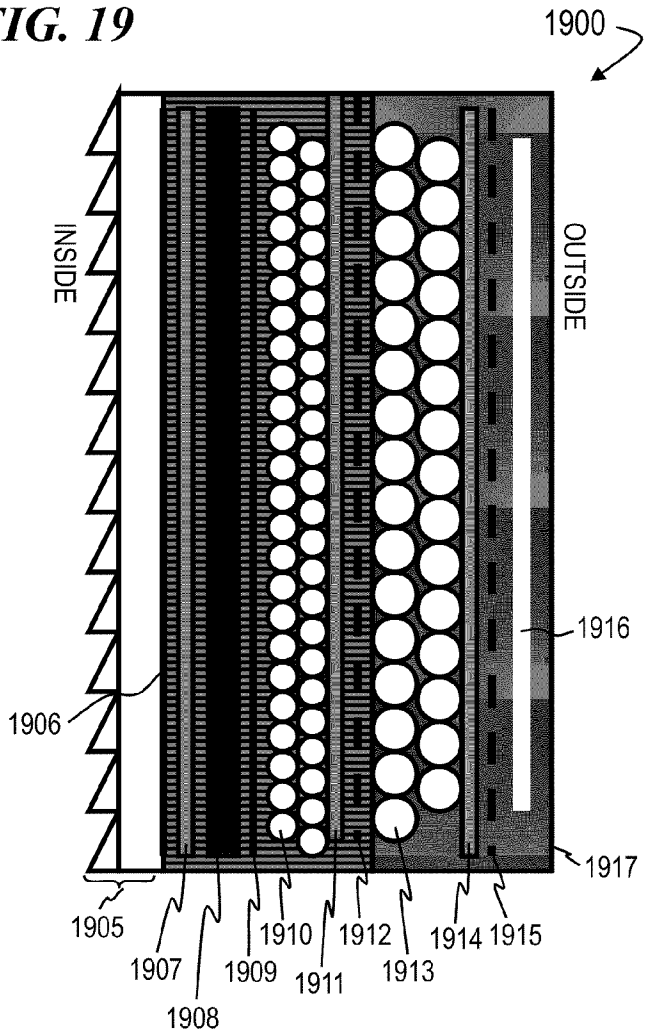
FIG. 19 is a cross-section of a multi-layer composite armor (MLCA) component 1900.

FIG. 19 is a cross-section of a multi-layer composite armor (MLCA) component 1900. In some embodiments, MLCA component 1900 has a pre-encapsulation thickness of approximately 171 mm (6¾"), a weight of approximately 82.6 kg (182 pounds), and a density of approximately 499.81 kg-per-square-meter (102.37 pounds-per-square-foot (lbs/ft$^2$)). In some embodiments, MLCA component 1900 includes the following specifications: layer 1905 includes 59A-durometer polyurethane; layer 1906 includes a stainless-steel plate; layer 1907 includes an approximately 6-mm-thick (0.25"-thick) Pacific Bulletproof® ballistic composite, layer 1908 includes an approximately 13-mm-thick (0.5"-thick) basalt fiber; layer 1909 includes a stainless-steel plate; layer 1910 includes two layers of approximately 13-mm-diameter (0.50"-diameter) steel ball bearings in a hexagonal-closely packed configuration; layer 1911 includes an approximately 6-mm-thick (0.25"-thick) Pacific Bulletproof® ballistic composite; layer 1912 includes two layers of hardwire; layer 1913 includes two layers of approximately 20-mm-diameter (25/32"-diameter) steel ball bearings in a hexagonal-closely packed configuration; layer 1914 includes an approximately 6-mm-thick (0.25"-thick) Pacific Bulletproof® ballistic composite; layer 1915 includes two layers of hardwire; layer 1916 includes zirconia-hardened alumina ceramic tiles; and encapsulation layer 1917 includes an approximately 6-mm-thick (0.25"-thick) 93A-durometer polyurethane.

In some embodiments, the ceramic tiles (layer 1916) on the strike face provide explosively-formed-projectile (EFP) deformation. In some embodiments, larger spheres (layer 1913) out front provide energy-dispersion objects with a greater mass to potentially transfer a greater amount of energy. It is also more difficult to force a larger object like an EFP through the depth of the panel when struck. In some embodiments, the containment layers (e.g., layers 1907, 1908, and 1909) behind layer 1910 also serve to absorb energy. In some embodiments, the second matrix of steel ball bearings (layer 1910) are smaller in diameter, providing a smaller gapped matrix to stop the smaller particles of the now disintegrating EFP passing through the strike-face layers of MLCA component 1900. In some embodiments, containment layers behind layer 1910 are composed of very strong materials that have the ability to flex a great deal before break: basalt fiber, and stainless steel. This is important at the rear for shock absorption and reducing mechanical force from the impact. Essentially, the containment layers are doubled (1906 and 1907, and 1908 and 1909).

Figure 20:
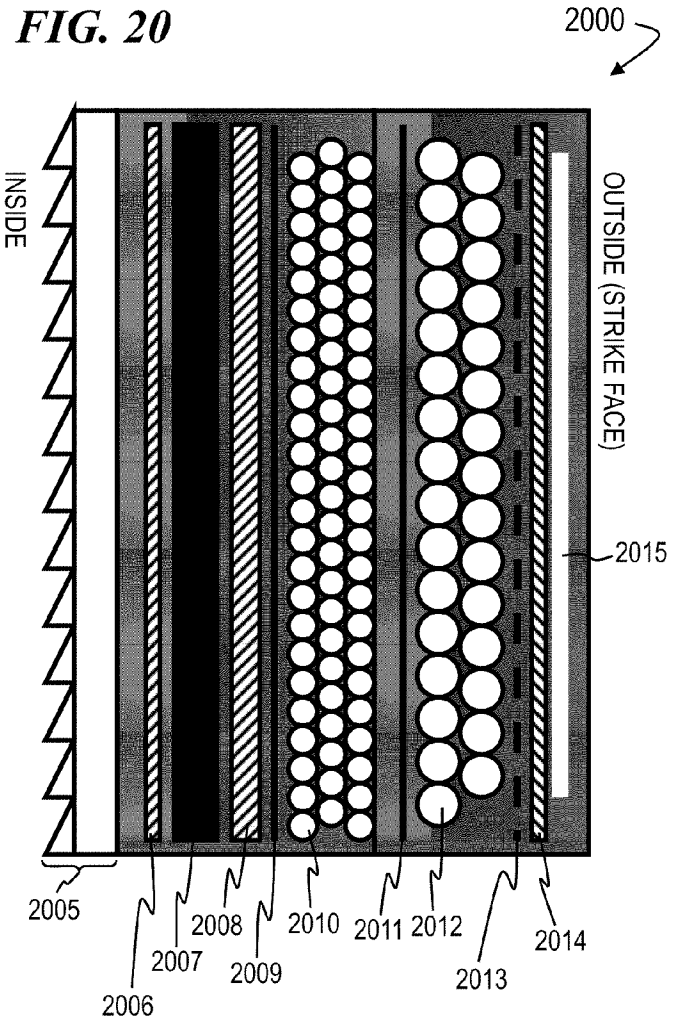
FIG. 20 is a cross-section of a multi-layer composite armor (MLCA) component 2000.

FIG. 20 is a cross-section of a multi-layer composite armor (MLCA) component 2000. In some embodiments, MLCA component 2000 includes the following specifications: layer 2005 includes 59A-durometer polyurethane; layer 2006 includes an approximately 6-mm-thick (0.25"-thick) Pacific Bulletproof® ballistic composite; layer 2007 includes an approximately 13-mm-thick (0.5"-thick) E-glass (electric-grade glass) or basalt fiber; layer 2008 includes a 13-mm-thick (0.5"-thick) E-glass (electric-grade glass); layer 2009 includes a stainless steel plate; layer 2010 includes three layers of 13-mm-diameter (0.5"-diameter) steel ball bearings in a square-closely packed configuration; layer 2011 includes a stainless-steel plate; layer 2012 includes two layers of approximately 20-mm-diameter (25/32"-diameter) steel ball bearings in a square-closely packed configuration; layer 2013 includes two layers of hardwire; layer 2014 includes an approximately 6-mm-thick (0.25"-thick) Pacific Bulletproof® ballistic composite; and layer 2015 includes a zirconia-hardened alumina ceramic. In some embodiments, the triple layer of energy-dispersion objects (layer 2111) dramatically strengthens the overall armor compared to a double layer, but it also adds weight.

Figure 21:
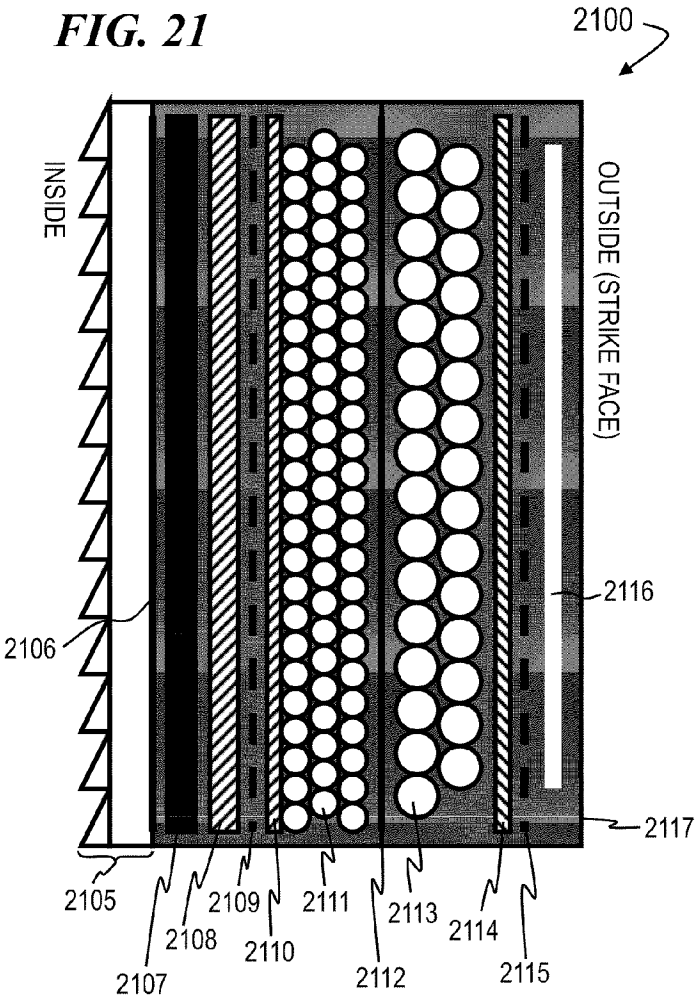
FIG. 21 is a cross-section of a multi-layer composite armor (MLCA) component 2100.

FIG. 21 is a cross-section of a multi-layer composite armor (MLCA) component 2100. In some embodiments, MLCA component 2100 has a pre-encapsulation thickness of about 197 mm (7¾"), a weight of about 88 kg (194 pounds), and a density of about 532.77 kg-per-square-meter (109.12 pounds-per-square-foot (lbs/ft2)). In some embodiments, MLCA component 2100 includes the following specifications: Layer 2105 includes 59A-durometer urethane; layer 2106 includes a stainless-steel plate; layer 2107 includes an approximately 12.7-mm-thick (0.5"-thick) basalt fiber; layer 2108 includes an approximately 12.7-mm-thick (0.5"-thick) E-glass (electric-grade glass); layer 2109 includes two layers of hardwire; layer 2110 includes an approximately 6.35-mm-thick (0.25"-thick) Pacific Bulletproof® ballistic composite; layer 2111 includes three layers of approximately 12.7-mm-diameter (0.50"-diameter) steel ball bearings in a square-closely packed configuration; layer 2112 includes a stainless-steel plate; layer 2113 includes two layers of approximately 19.84-mm-diameter (25/32"-diameter) steel ball bearings in a square-closely packed configuration; layer 2114 includes an approximately 6.35-mm-thick (0.25"-thick) Pacific Bulletproof® ballistic composite; layer 2115 includes two layers of hardwire; layer 2116 includes a zirconia-hardened alumina ceramic; and encapsulation layer 2117 includes approximately 6.35-mm-thick (0.25"-thick) 93A-durometer polyurethane. In some embodiments, the triple layer of energy-dispersion objects (layer 2111) dramatically strengthens the overall armor compared to a double layer, but it also adds weight.

Figure 22:
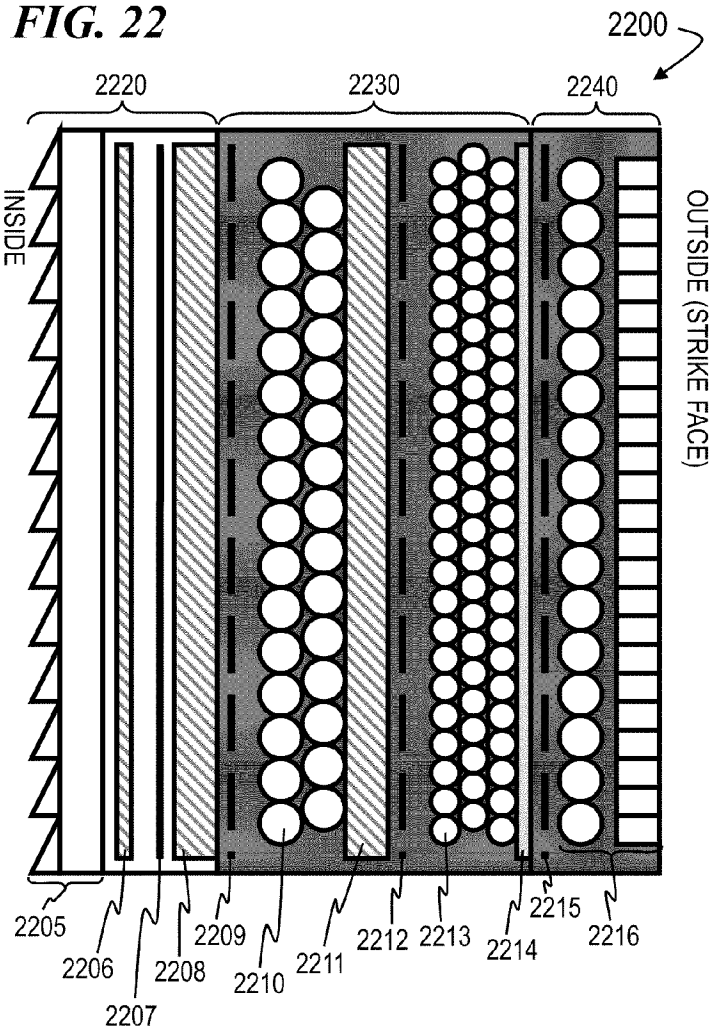
FIG. 22 is a cross-section of a multi-layer composite armor (MLCA) component 2200.

FIG. 22 is a cross-section of a multi-layer composite armor (MLCA) component 2200. In some embodiments, MLCA component 2200 has a pre-encapsulation thickness of approximately 233 mm (9 3/16") and a weight of approximately 102 kg (225 pounds). In some embodiments, MLCA component 2200 includes the following specifications: layer 2205 includes 59A-durometer polyurethane; layer 2206 includes an approximately 6-mm-thick (0.25"-thick) E-glass (electric-grade glass) with an approximately 13-mm-thick (½"-thick) 59A-durometer polyurethane on the strike-face side; layer 2207 includes a stainless-steel plate; layer 2208 includes an approximately 13-mm-thick (0.5"-thick) E-glass; layer 2209 includes two layers of hardwire; layer 2210 includes two layers of approximately 20-mm-diameter (25/32"-diameter) steel ball bearings in a hexagonal-closely packed configuration; layer 2211 includes an approximately 13-mm-thick (0.5"-thick) E-glass; layer 2212 includes two layers of hardwire; layer 2213 includes three layers of approximately 13-mm-diameter (0.5"-diameter) steel ball bearings in a square-closely packed configuration; layer 2214 includes an approximately 6-mm-thick (0.25"-thick) Pacific Bulletproof® ballistic composite; layer 2215 includes two layers of hardwire; layer 2216 includes two layers of ceramic cylinders (the strike-face layer having the axis of the cylinders facing toward the strike face of the MLCA component 2200 and the inner layer in a orientation perpendicular to the strike-face layer). Section 2220 includes 59A-durometer polyurethane as a bonding agent; section 2230 includes 83A-durometer polyurethane as a bonding agent; and section 2240 includes 93A-durometer polyurethane as a bonding agent.

In some embodiments, like MLCA component 1800, MLCA component 2200 is intended to be a type of "heavy" armor. In some embodiments, layer 2216 includes 90% alumina hardened ceramic cylinder grinding media. The dual layer/dual orientation of layer 2216 is seen as a much stronger strike face than a flat tile ceramic strike face. While the flat tile has close to 99% zirconia hardened alumina content and is harder, the cylinder matrix is seen as having a greater multi-hit capability for small arms (e.g., 20 mm canon, 14.5 and 12.75 mm MG), and greater energy absorption capability for EFPs. In some embodiments, the approximately 6-mm-thick (0.25"-thick) sheet of E-glass layer (layer 2206) is used to reinforce the stainless plate, which was found to work very well against a lower-durometer-polyurethane shock absorber. In each section of energy-dispersion objects, the energy-dispersion objects are followed by a fiber composite panel reinforced layering of hardwire. In some embodiments, the larger ball bearings (layer 2210) are moved to the vehicle side to provide a greater energy dispersion closer to the vehicle hull.

Figure 23:
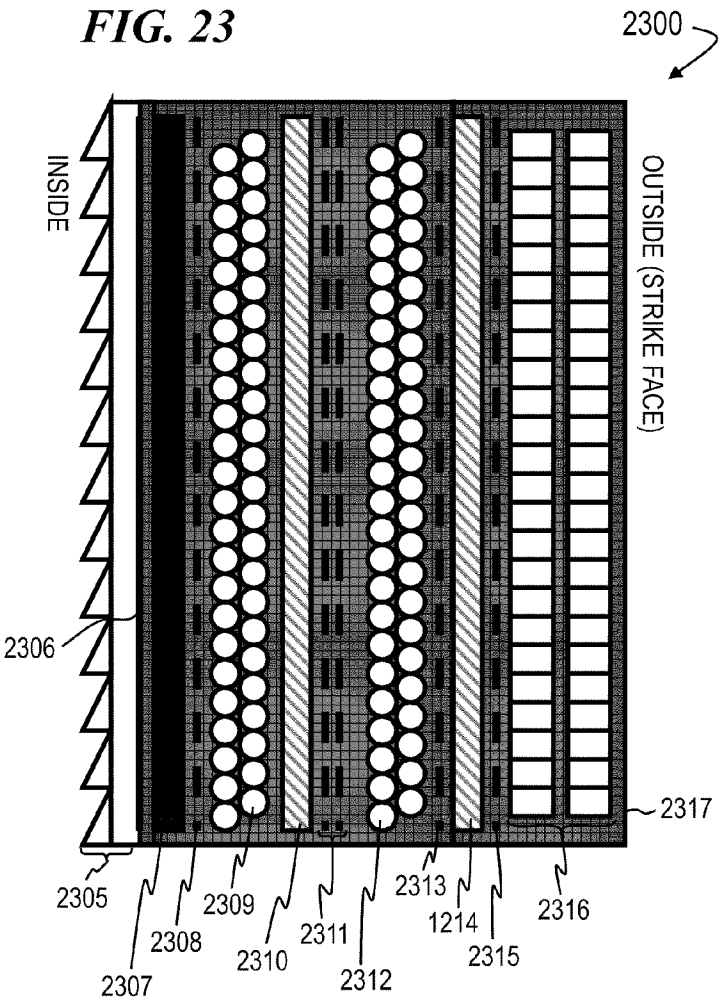
FIG. 23 is a cross-section of a multi-layer composite armor (MLCA) component 2300.

FIG. 23 is a cross-section of a multi-layer composite armor (MLCA) component 2300. In some embodiments, MLCA component 2300 has a pre-encapsulation thickness of approximately 206 mm (8⅛") and a weight of approximately 88.9 kg (196 pounds). In some embodiments, MLCA component 2300 includes the following specifications: layer 2305 includes 59A-durometer polyurethane; layer 2306 includes a stainless steel plate; layer 2307 includes an approximately 13-mm-thick (0.5"-thick) basalt fiber; layer 2308 includes two layers of hardwire; layer 2309 includes two layers of approximately 13-mm-diameter (0.5"-diameter) steel ball bearings in a hexagonal-closely packed configuration; layer 2310 includes an approximately 13-mm-thick (0.5"-thick) E-glass; layer 2311 includes four layers of hardwire; layer 2312 includes two layers of approximately 13-mm-diameter (0.5"-diameter) steel ball bearings in a hexagonal-closely packed configuration; layer 2313 includes two layers of hardwire; layer 2314 includes an approximately 13-mm-thick (0.5"-thick) E-glass; layer 2315 includes two layers of hardwire; layer 2316 includes two layers of ceramic cylinders (both layers are oriented such that the axis of the cylinders faces the strike face of MLCA component 2300); and encapsulation layer 2317 includes an approximately 6-mm-thick (¼"-thick) 93A-durometer polyurethane.

Figure 24:
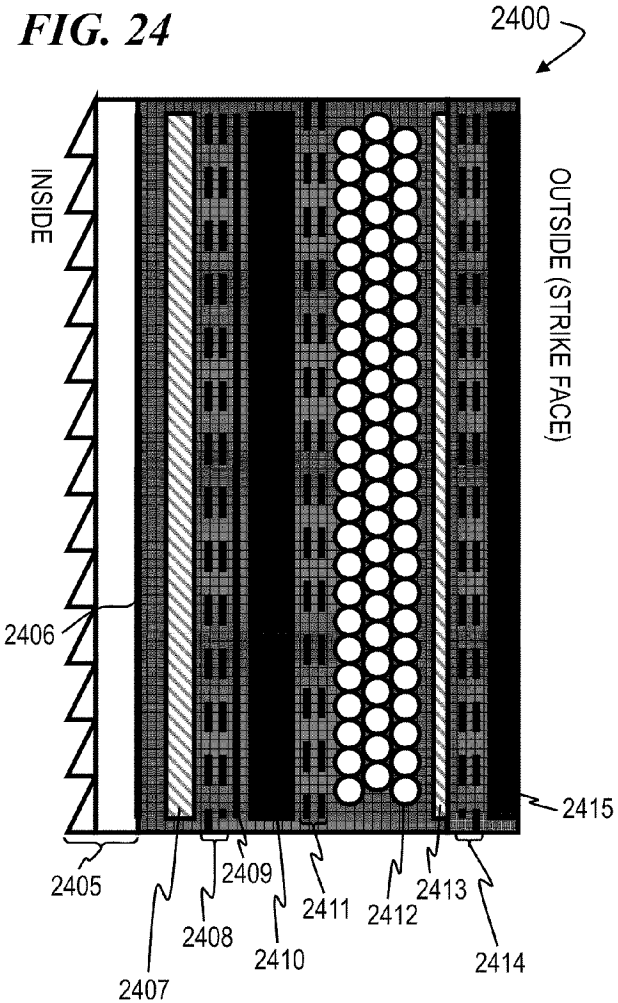
FIG. 24 is a cross-section of a multi-layer composite armor (MLCA) component 2400.

FIG. 24 is a cross-section of a multi-layer composite armor (MLCA) component 2400. In some embodiments, MLCA component 2400 has a pre-encapsulation thickness of approximately 202 mm (7 15/16"), a weight of approximately 78.0 kilograms (172 pounds), and a density of approximately 472.4 kilograms-per-square-meter (96.75 pounds-per-square-foot (lbs/ft$^2$)). In some embodiments, MLCA component 2400 includes the following specifications: layer 2405 includes 59A-durometer polyurethane; layer 2406 includes a stainless steel plate with an approximately 13-mm-thick (½"-thick) 83A-durometer polyurethane on the strike-face side; layer 2407 includes an approximately 13-mm-thick (0.5"-thick) Pacific Bulletproof® ballistic composite; layer 2408 includes three layers of hardwire; layer 2409 includes a stainless steel plate with an approximately 6-mm-thick (¼"-thick) 83A-durometer polyurethane on the strike-face side; layer 2410 includes an approximately 25-mm-thick (1"-thick) basalt fiber; layer 2411 includes three layers of hardwire; layer 2412 includes three layers of approximately 13-mm-diameter (0.5"-diameter) steel ball bearings in a hexagonal-closely packed configuration mixed in with approximately 6-mm-thick (¼"-thick) 83A-durometer polyurethane; layer 2413 includes an approximately 6-mm-thick (0.25"-thick) Pacific Bulletproof® ballistic composite; layer 2414 includes three layers of hardwire; and layer 2415 includes an approximately 19-mm-thick (¾"-thick) layer of approximately 102-mm-diameter (4"-diameter) silicon carbide ceramic tiles.

In some embodiments, MLCA component 2400 is an ultra lightweight armor using approximately 19-mm-thick (¾"-thick) silicon carbide tiling as a strike face. It is surmised that a Si—C strike face will have approximately the same strength as a dual layer of approximately 13-mm-diameter (0.50"-diameter) steel spheres. Thus, in some embodiments, the Si—C strike face provides the strength of having a dual steel sphere matrix at a much lighter weight. In some embodiments, strength was attempted to be increased by using a triple layer of steel spheres (layer 2412), which has proved to be effective in previous tests.

Figure 25:
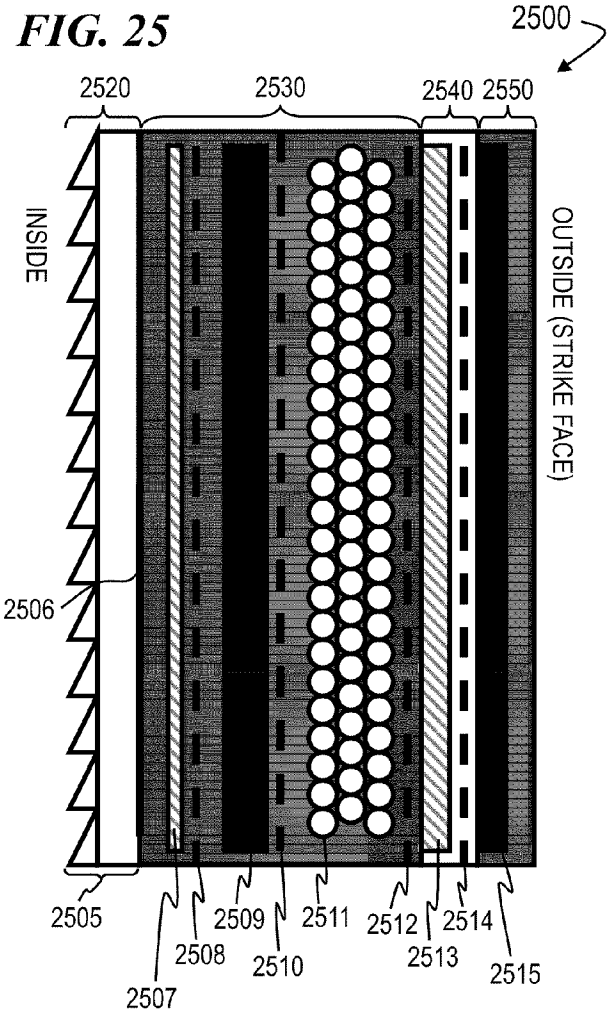
FIG. 25 is a cross-section of a multi-layer composite armor (MLCA) component 2500.

FIG. 25 is a cross-section of a multi-layer composite armor (MLCA) component 2500. In some embodiments, MLCA component 2500 has a pre-encapsulation thickness of approximately 161 mm (6.33"), a weight of approximately 67.1 kilograms (148 pounds), and a density of approximately 406.5 kilograms-per-square-meter (83.25 pounds-per-square-foot (lbs/ft$^2$)). In some embodiments, MLCA component 2500 includes the following specifications: layer 2505 includes 59A-durometer polyurethane; layer 2506 includes a stainless steel plate; layer 2507 includes an approximately 6-mm-thick (0.25"-thick) Pacific Bulletproof® fiberglass plate; layer 2508 includes three layers of hardwire; layer 2509 includes an approximately 25-mm-thick (1"-thick) basalt chip plate; layer 2510 includes three layers of hardwire; layer 2511 includes three layers of approximately 13-mm-diameter (0.5"-diameter) steel ball bearings in a hexagonal-closely packed configuration; layer 2512 includes two layers of hardwire; layer 2513 includes an approximately 13-mm-thick (0.50"-thick) E-glass (electronic-grade glass); layer 2514 includes two layers of hardwire; and layer 2515 includes approximately 102-mm-diameter (4"-diameter) silicon-carbide-ceramic tiles. Section 2520 includes an approximately 25-mm-thick (1"-thick) 59A-durometer ester polyurethane as a bonding agent; section 2530 includes 83A-durometer polyurethane as a bonding agent; section 2540 includes an approximately 13-mm-thick (0.5"-thick) 59A-durometer ester polyurethane as a bonding agent; and section 2550 includes 93A-durometer ester polyurethane as a bonding agent.

In some embodiments, MLCA component 2500 is basically a lighter version of MLCA component 2400. In some embodiments, for example, MLCA component 2500 has only one stainless steel plate. Most noteworthy is that MLCA component 2500 uses 59A-durometer polyurethane (section 2540) directly behind the ceramic strike face (layer 2515) in order to increase the ceramic's shock absorption abilities while at the same time destroying the form of an EFP. In other words, MLCA component 2500 combines the extremely high hardness of Si—C with the cushion of 59A ester polyurethane.

A plurality of the previously mentioned MLCA components were tested using a 152 mm explosively-formed projectile (EFP) having an approximately 6-mm-thick (0.25"-thick) copper warhead and a 152 mm EFP having an approximately 5-mm-thick (0.1875"-thick) copper warhead. All of the MLCA components mentioned above were able to prevent the approximately 6-mm-thick (0.25"-thick) copper EFP's from penetrating completely through the armor. In contrast, the 5-mm-thick (0.1875"-thick) copper EFP's, which travel approximately 304.8 meters-per-second (1000 feet-per-second) faster and form a narrower, tighter EFP (therefore concentrating more force in a smaller point) caused some embodiments of MLCA components 1900, 2300, 2400, and 2500 to fail (i.e., the EFP was able to penetrate through the respective MLCA component). The 5-mm-thick (0.1875"-thick) copper EFP testing, therefore, led to the modification and improvement of some of the previously mentioned MLCA components. Some of the modifications include the use of layers of elongated armor elements (discussed below) and the use of high strength polyurethane (e.g., 93A polyurethane) throughout an MLCA component, as opposed to only using high strength polyurethane in certain layers of the MLCA component.

In some embodiments, the present invention includes a plurality of layers of elongated armor elements (e.g., lengths of high-strength steel or stainless-steel cables, for example, laid parallel to one another). In some embodiments, the plurality of such layers of elongated armor elements are placed in the strike-face layer of a multi-layer composite armor (MLCA) component. In some embodiments, the plurality of elongated armor elements are placed in containments layers of a multi-layer composite armor (MLCA) component (e.g., in some embodiments, a plurality of elongated armor elements are used instead of an e-glass layer). Elongated armor elements used in the strike face layer help to break up and spread out the concentration of an incoming explosively-formed projectile (EFPs) before the EFP reaches the layer(s) of energy-dispersion objects. Elongated armor elements are especially effective for defending against EFPs that are narrow and tightly formed (e.g., a 152 mm EFP having an approximately 5-mm-thick (0.1875"-thick) copper warhead, as opposed to an approximately 6-mm-thick (0.25"-thick) copper warhead).

In some embodiments, elongated armor elements include high-strength steel cables (also called "wire rope"). In some embodiments, elongated armor elements include wire rope such as described in U.S. Pat. No. 315,077, titled "WIRE ROPE OR CABLE", issued Apr. 7, 1885. In some embodiments, a plurality of wire ropes are placed together in a layer of a multi-layer-composite armor component such that wire rope laid with a first twist is adjacent to wire rope laid with a second twist. Placing wire ropes with opposite twist adjacent to each other helps reduce the amount of interstitial space between adjacent wire ropes (the grooves of wire rope with the first twist lines up with the ridges of adjacent wire rope having the second twist), which thereby provides greater flexibility to the overall layer of wire ropes. In some embodiments, elongated armor elements include lengths of solid steel (e.g., solid steel bars). In some embodiments, elongated armor elements are woven such that a steel fiber mesh is formed (e.g., a steel-cable-fiber mesh). In some embodiments, elongated armor elements are emplaced in 0°-90° configurations (e.g., individual layers of elongated armor elements form 90-degree angles with adjacent elongated armor element layers). In some embodiments, layers of elongated armor elements are configured by placing a plurality of elongated armor elements into grooved or multi-holed spacers (e.g., a plate having side-by-side holes of the diameter of the steel cables being held) that hold the plurality of elongated armor elements in place during the addition of the bonding material. In some embodiments, the plurality of elongated armor elements is glued onto a wire mesh that holds the plurality of elongated armor elements in place during bonding material addition. In some embodiments, each one of the plurality of elongated armor elements in a given layer has approximately the same diameter. In some embodiments, elongated armor elements in a given layer have varying diameters. In some embodiments, a first plurality of elongated armor elements in a first layer have a first diameter and a second plurality of elongated armor elements in a second adjacent layer have a second diameter.

Figures 26A, 26B, 26C:
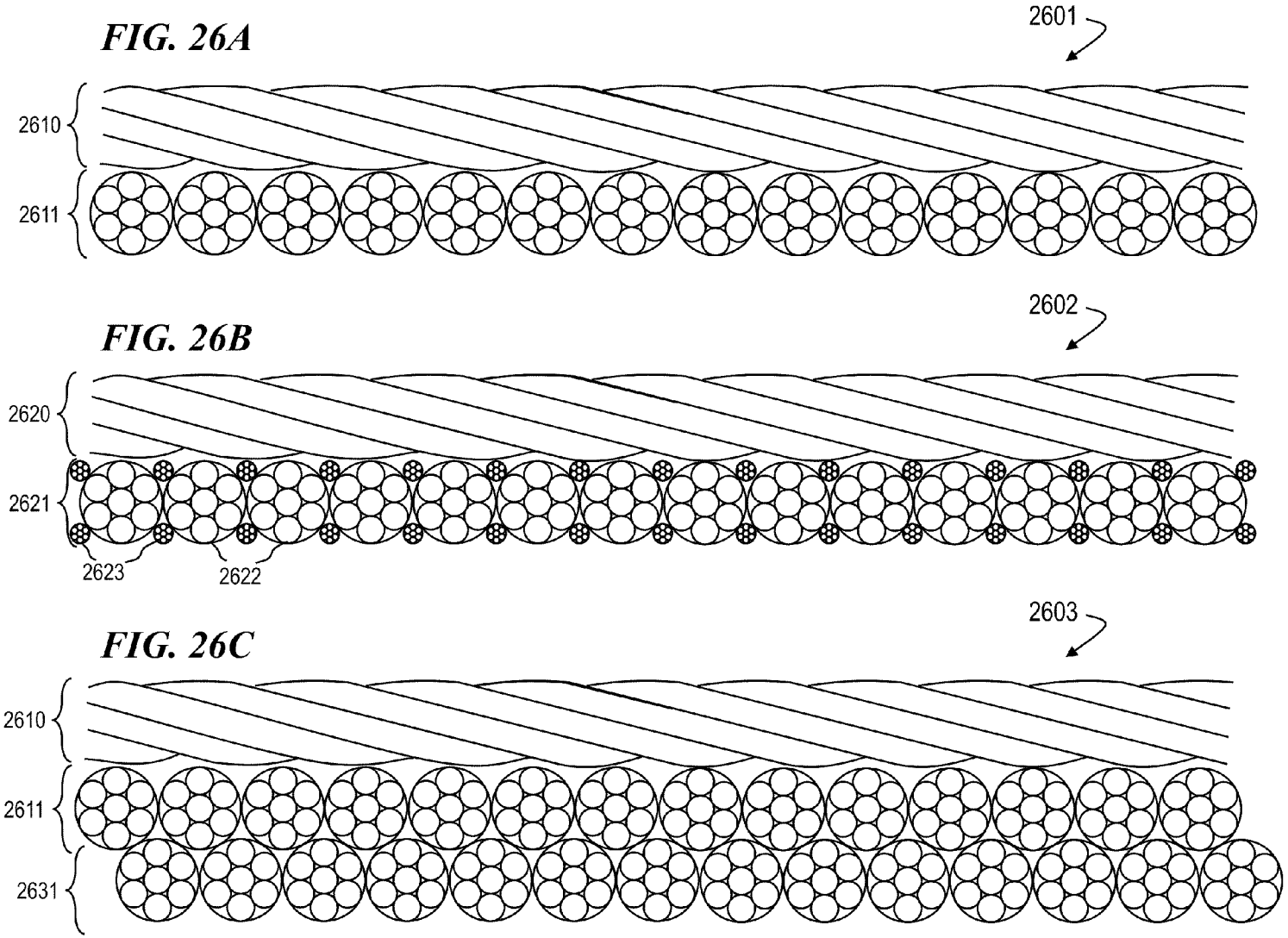
FIG. 26A is a cross-section of two layers of elongated armor elements (e.g., steel cables).
FIG. 26B is a cross-section of four layers of elongated armor elements 2602, some having different diameters.
FIG. 26C is a cross-section of three layers of elongated armor elements 2603.

FIG. 26A is a cross-section of two layers of elongated armor elements 2601 (layer 2610 and layer 2611). In some embodiments, layers 2610 and 2611 include a plurality of lengths of steel cables, each of the same diameter.

FIG. 26B is a cross-section of four layers of elongated armor elements 2602 (layer 2620 and layer 2621, wherein layer 2621 includes cables of different sizes laid at three levels with small cables 2623 in the groove spaces of large cables 2622). In some embodiments, layers 2620 and 2621 include a plurality of lengths of steel cables having a plurality of different diameters.

FIG. 26C is a cross-section of three layers of elongated armor elements 2603 (layer 2610 and layer 2611 as shown in FIG. 26A, with a third layer 2631 laid in the grooves of layer 2611). In some embodiments, layers 2610, 2611 and 2631 include a plurality of lengths of steel cables, each of the same-diameter cables. In some embodiments, a fourth layer of same-sized cables is laid in the grooves above layer 2610. In some embodiments, yet additional layers of cables are used.

In some embodiments, each one of the plurality of steel cables has a diameter of approximately 5 mm. In some embodiments, each one of the plurality of steel cables has a diameter of approximately 10 mm. In some embodiments, each one of the plurality of steel cables has a diameter of approximately 15 mm. In some embodiments, each one of the plurality of steel cables has a diameter of approximately 20 mm. In some embodiments, each one of the plurality of steel cables has a diameter of approximately 25 mm. In some embodiments, each one of the plurality of steel cables has a diameter of approximately 30 mm. In some embodiments, each one of the plurality of steel cables has a diameter of approximately 35 mm. In some embodiments, each one of the plurality of steel cables has a diameter of approximately 40 mm. In some embodiments, each one of the plurality of steel cables has a diameter of approximately 45 mm. In some embodiments, each one of the plurality of steel cables has a diameter of approximately 50 mm. In some embodiments, each one of the plurality of steel cables has a diameter larger than 50 mm.

Figure 27A:
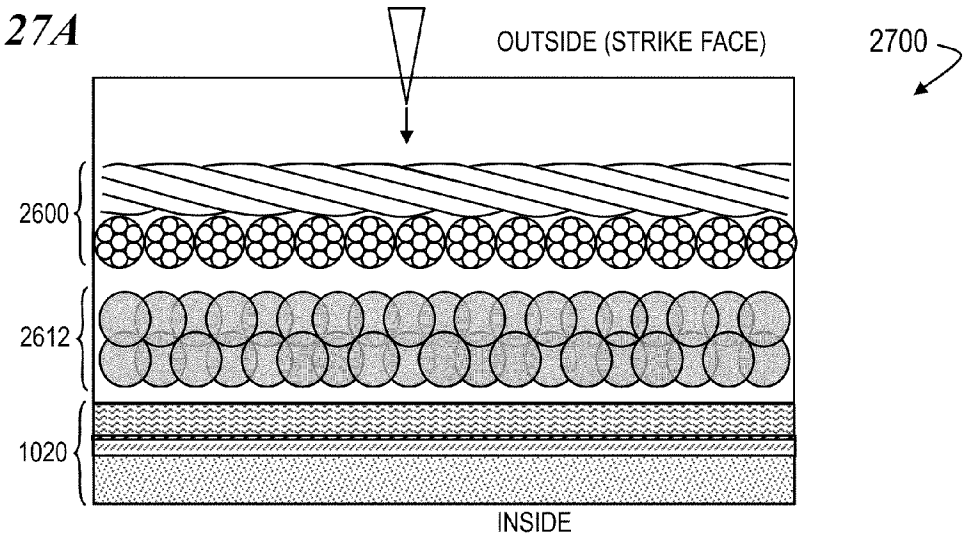
FIG. 27A is a cross-section of a multi-layer composite armor (MLCA) component 2700 containing a plurality of elongated armor elements (e.g., steel cables) and a plurality of energy-dispersion objects (e.g., steel ball bearings).

FIG. 27A is a cross-section of a multi-layer composite armor (MLCA) component 2700 containing a plurality of elongated armor elements 2601 (e.g., steel cables) and a plurality of energy-dispersion objects (e.g., steel ball bearings). In some embodiments, MLCA component 2700 includes a plurality of energy-dispersion objects 2612 and composite material 1020.

Figure 27B:
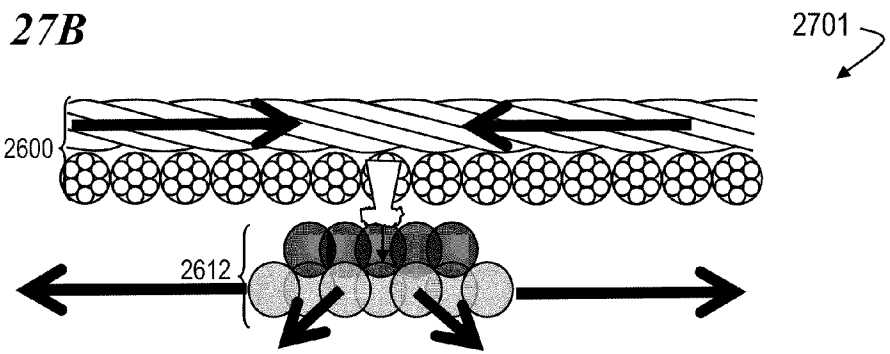
FIG. 27B is a cross-section schematically illustrating hypothetical energy dispersion that occurs when an explosively-formed projectile (EFP) strikes a multi-layer composite armor (MLCA) component that includes a plurality of elongated armor elements and a plurality of energy-dispersion objects.

FIG. 27B is a cross-section schematically illustrating hypothetical energy dispersion that may occur when an explosively-formed projectile (EFP) strikes a multi-layer composite armor (MLCA) component 2701 that includes a plurality of elongated armor elements 2600 and a plurality of energy-dispersion objects 2612. The large arrows pointing toward the middle of the elongated armor elements 2600 illustrate how the elongated armor elements 2600 get pulled toward the point of impact of the EFP as it moves through MLCA component 2701 (i.e., the high-tensile-strength elongated armor elements 2600 provide some resistance to the EFP, rather than allowing the EFP to break right through, which causes the elongated armor elements 2600 to get pulled toward the EFP-impact point). The large arrows pointing away from the EFP and the smaller arrows pointing down and away from the EFP illustrate how energy-dispersion objects 2612 disperse the energy from the EFP away from the point of impact on MLCA component 2701.

Figure 28:
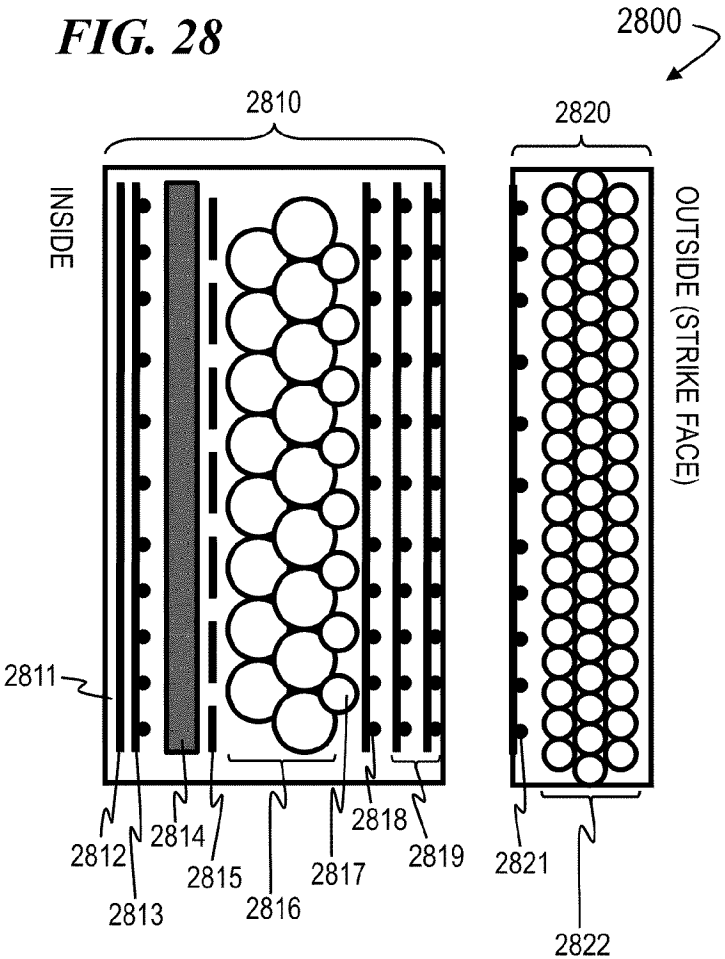
FIG. 28 is a cross-section of one embodiment of a multi-layer composite armor (MLCA) component 2800.

FIG. 28 is a cross-section of a multi-layer composite armor (MLCA) component 2800. In some embodiments, MLCA component 2800 includes a body portion 2810 and a strike face portion 2820. In some embodiments, as illustrated in FIG. 28, body portion 2810 is formed separately from strike face portion 2820 and then the two portions are joined together (by bolting, by adhesive, by Velcro™, by polymer bonding, or other suitable means). In some embodiments, body portion 2810 has a total thickness of approximately 143 mm (5⅝"). In some embodiments, strike face portion 2820 has a total thickness of approximately 67 mm (2⅝"). In some embodiments, body portion 2810 includes the following specifications: layer 2811 includes an approximately 5-mm-thick (3/16"-thick) 93A-durometer polyurethane; layer 2812 includes an approximately 3-mm-thick (0.125"-thick) bainite steel plate; layer 2813 includes an approximately 3-mm-thick (0.125"-thick) steel cable weave screen; layer 2814 includes an approximately 13-mm-thick (0.50"-thick) fiberglass plate; layer 2815 includes a layer of hardwire; layer 2816 includes two layers of approximately 32-mm-diameter (1.25"-diameter) steel ball bearings in a square-closely packed configuration; layer 2817 includes a layer of approximately 19-mm-diameter (0.75"-diameter) steel spheres (plugs) placed in the holes created by layer 2816; layer 2818 includes an approximately 6-mm-thick (0.25"-thick) steel cable weave screen; and layer 2819 includes two layers of approximately 6-mm-thick (0.25"-thick) steel cable weave screen. In some embodiments, the individual layers of body portion 2810 are bonded together using 93A-durometer polyurethane bonding layers each having a thickness of approximately 6 mm (0.25") or less. In some embodiments, the steel cable weave screen is formed by placing layers of steel cables in 0°-90° configurations with respect to adjacent steel cable layers.

In some embodiments, strike face portion 2820 includes the following specifications: layer 2821 includes an approximately 3-mm-thick (0.125"-thick) steel fabric (e.g., woven steel cables or wires), and layer 2822 includes three layers of approximately 13-mm-diameter (0.50"-diameter) steel spheres.

Figure 29:
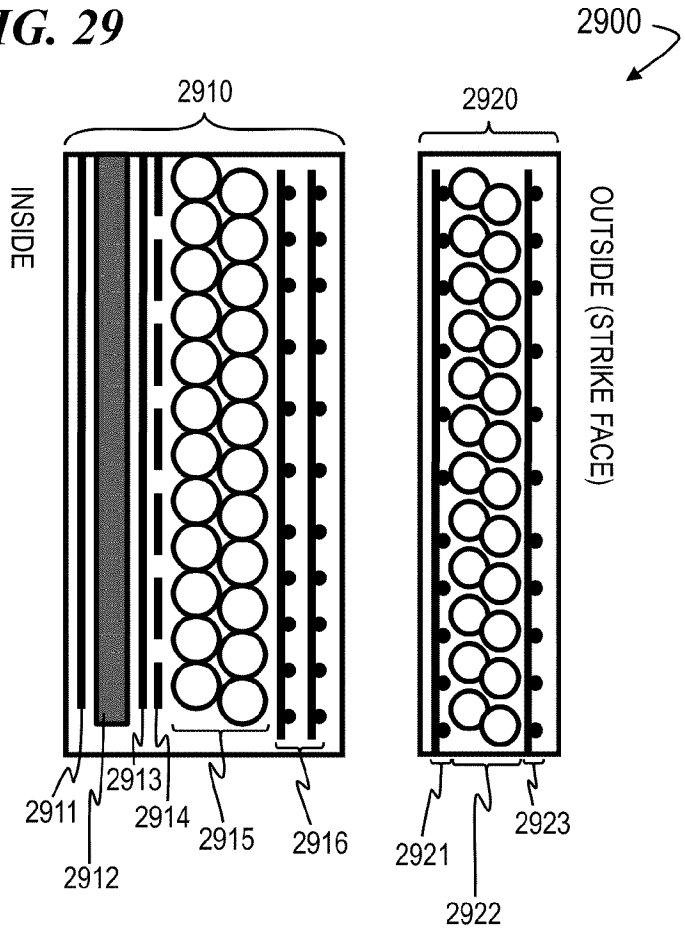
FIG. 29 is a cross-section of another embodiment of a multi-layer composite armor (MLCA) component 2900.

FIG. 29 is a cross-section of a multi-layer composite armor (MLCA) component 2900. In some embodiments, MLCA component 2800 includes a body portion 2910 and a strike face portion 2920. In some embodiments, as illustrated in FIG. 29, body portion 2910 is formed separately from strike face portion 2920 and then the two portions are joined together (by bolting, by adhesive, by Velcro™, by polymer bonding, or other suitable means). In some embodiments, body portion 2910 has a total thickness of approximately 143 mm (5⅝"). In some embodiments, strike face portion 2920 has a total thickness of approximately 60 mm (2⅜"). In some embodiments, body portion 2910 includes the following specifications: layer 2911 includes an approximately 3-mm-thick (0.125"-thick) steel plate; layer 2912 includes an approximately 13-mm-thick (0.5"-thick) fiberglass plate; layer 2913 includes an approximately 3-mm-thick (0.125"-thick) steel plate; layer 2914 includes three layers of hardwire; layer 2915 includes two layers of approximately 25-mm-diameter (1.0"-diameter) steel spheres in a hexagonal-closely packed configuration; and layer 2916 includes two layers of approximately 6-mm-thick (0.25"-thick) steel cable weave. In some embodiments, the individual layers of body portion 2910 are bonded together using 93A-durometer polyurethane bonding layers each having a thickness of approximately 6 mm (0.25") or less. In some embodiments, the steel cable weave is formed by placing layers of steel cables in 0°-90° configurations with respect to adjacent steel cable layers.

In some embodiments, strike face portion 2920 includes the following specifications: layer 2921 includes two layers of approximately 3-mm-thick (0.125"-thick) steel fabric; layer 2922 includes two layers of approximately 19-mm-diameter (0.75"-diameter) steel spheres in a hexagonal-closely packed configuration; and layer 2923 includes two layers of approximately 6-mm-thick (0.25"-thick) steel fabric.

Figure 30:
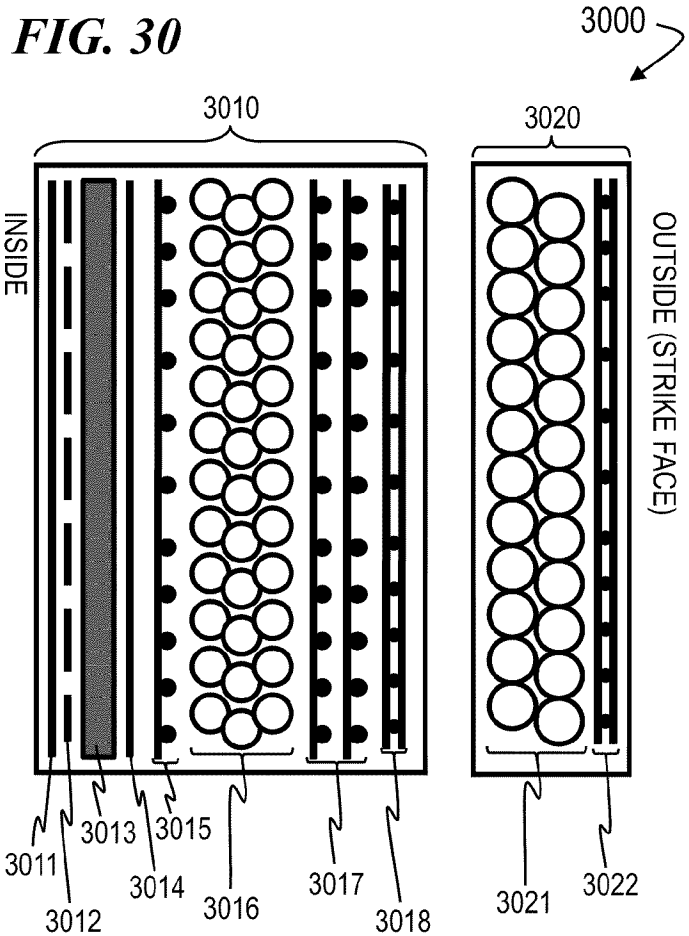
FIG. 30 is a cross-section of yet another embodiment of a multi-layer composite armor (MLCA) component 3000.

FIG. 30 is a cross-section of a multi-layer composite armor (MLCA) component 3000. In some embodiments, MLCA component 3000 includes a body portion 3010 and a strike face portion 3020. In some embodiments, as illustrated in FIG. 30, body portion 3010 is formed separately from strike face portion 3020 and then the two portions are joined together (by bolting, by adhesive, by Velcro™, by polymer bonding, or other suitable means). In some embodiments, body portion 3010 has a total thickness of approximately 140 mm (5½") to 152 mm (6"). In some embodiments, strike face portion 3020 has a total thickness of approximately 51 mm (2") to 64 mm (2½"). In some embodiments, body portion 3010 includes the following specifications: layer 3011 includes an approximately 3-mm-thick (0.125"-thick) steel plate; layer 3012 includes three layers of hardwire; layer 3013 includes an approximately 13-mm-thick (0.5"-thick) fiberglass plate; layer 3014 includes an approximately 3-mm-thick (0.125"-thick) steel plate; layer 3015 includes two layers of approximately 6.35-mm-thick steel cables (as the elongated armor elements); layer 3016 includes three layers of approximately 19-mm-diameter (0.75"-diameter) steel spheres in a square-closely packed configuration; layer 3017 includes four layers of approximately 6-mm-thick (0.25"-thick) steel cables; and layer 3018 includes three layers of approximately 5-mm-thick (0.1875"-thick) steel cables. In some embodiments, the individual layers of body portion 3010 are bonded together using 93A-durometer polyurethane bonding layers each having a thickness of approximately 6 mm (0.25") or less. In some embodiments, the layers of steel cables are formed by placing the layers of steel cables in 0°-90° configurations with respect to adjacent steel cable layers.

In some embodiments, strike face portion 3020 includes the following specifications: layer 3021 includes two layers of approximately 25-mm-diameter (1.0"-diameter) steel spheres, and layer 3022 includes three layers of approximately 6-mm-thick (0.25"-thick) steel cables.

Figure 31:
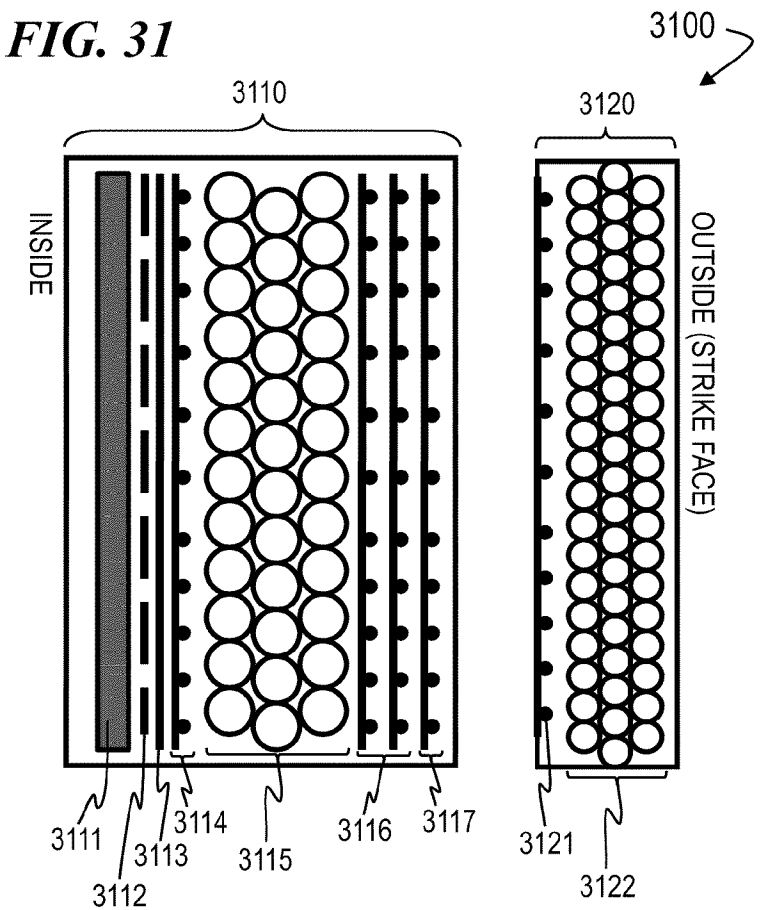
FIG. 31 is a cross-section of still another embodiment of a multi-layer composite armor (MLCA) component 3100.

FIG. 31 is a cross-section of a multi-layer composite armor (MLCA) component 3100. In some embodiments, MLCA component 3100 includes a body portion 3110 and a strike face portion 3120. In some embodiments, as illustrated in FIG. 31, body portion 3110 is formed separately from strike face portion 3120 and then the two portions are joined together (by bolting, by adhesive, by Velcro™, by polymer bonding, by welding, or other suitable means). In some embodiments, body portion 3110 has a total thickness of approximately 140 mm (5½") to 152 mm (6"). In some embodiments, strike face portion 3120 has a total thickness of approximately 51 mm (2"). In some embodiments, body portion 3110 includes the following specifications: layer 3111 includes an approximately 13-mm-thick (0.5"-thick) E-glass (electric-grade glass); layer 3112 includes four layers of hardwire; layer 3113 includes an approximately 3-mm-thick (0.125"-thick) bainite steel plate; layer 3114 includes an approximately 3-mm-thick (0.125"-thick) steel cable weave; layer 3115 includes three layers of approximately 25-mm-diameter (1.0"-diameter) steel spheres; layer 3116 includes four layers of approximately 3-mm-thick (0.125"-thick) steel fabric; and layer 3117 includes two layers of approximately 6-mm-diameter (0.25"-diameter) steel spheres. In some embodiments, the individual layers of body portion 3110 are bonded together using 93A-durometer polyurethane bonding layers each having a thickness of approximately 6 mm (0.25") or less. In some embodiments, the layers of steel fabric are placed in 0°-90° configurations with respect to adjacent steel fabric layers.

In some embodiments, strike face portion 3120 includes the following specifications: layer 3121 includes three layers of approximately 16-mm-diameter (⅝"-diameter) steel spheres in a hexagonal-closely packed configuration, and layer 3122 includes a 3 mm (0.125"-thick) steel cable weave.

Figure 32:
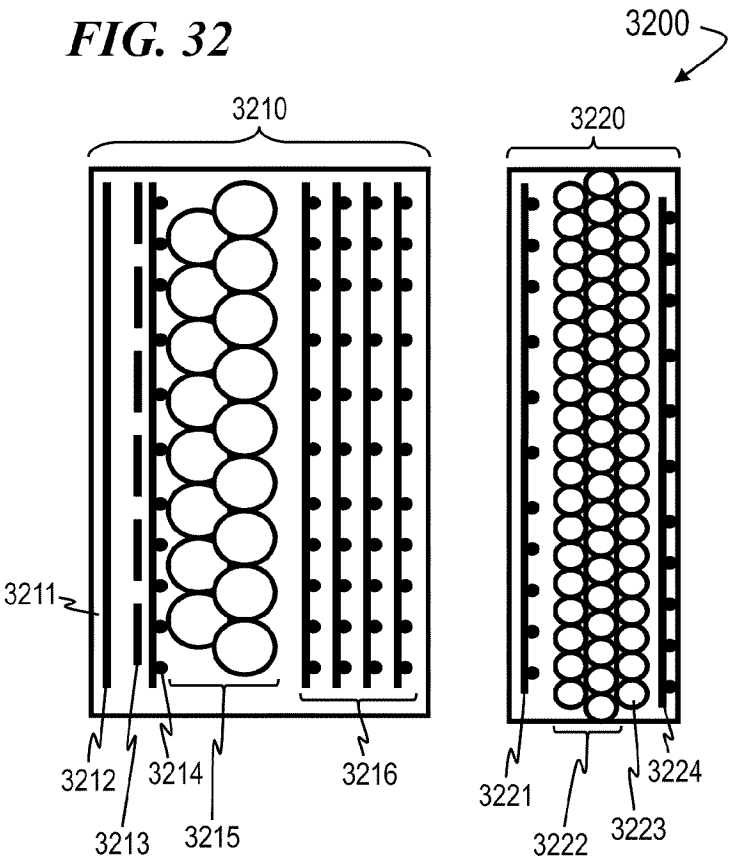
FIG. 32 is a cross-section of yet still another embodiment of a multi-layer composite armor (MLCA) component 3200.

FIG. 32 is a cross-section of a multi-layer composite armor (MLCA) component 3200. In some embodiments, MLCA component 3200 includes a body portion 3210 and a strike face portion 3220. In some embodiments, as illustrated in FIG. 32, body portion 3210 is formed separately from strike face portion 3220 and then the two portions are joined together (by bolting, by adhesive, by Velcro™, by polymer bonding, or other suitable means). In some embodiments, body portion 3210 has a total thickness of approximately 133 mm (5.25"). In some embodiments, strike face portion 3220 has a total thickness of approximately 67 mm (2⅝"). In some embodiments, body portion 3210 includes the following specifications: layer 3211 includes an approximately 5-mm-thick (3/16"-thick) 93A-durometer polyurethane; 3212 includes an approximately 3-mm-thick (0.125"-thick) bainite steel plate; layer 3213 includes hardwire; layer 3214 includes an approximately 3-mm-thick (0.125"-thick) steel cable weave screen (in other embodiments, layer 3214 includes a plurality of steel cables arranged in a 0°-90° configuration); layer 3215 includes two layers of approximately 32-mm-diameter (1.25"-diameter) steel spheres in a square-closely packed configuration; layer 3216 includes two layers of approximately 6-mm-thick (0.25"-thick) steel cable screen (in some embodiments, layer 3216 includes six individual layers, wherein the four layers closest to the vehicle hull have approximately 13-mm-thick (0.5"-thick) gaps between each layer, and the two layers farthest from the vehicle hull have no gap between each layer).

In some embodiments, strike face portion 3220 includes the following specifications: layer 3221 includes an approximately 3-mm-thick (0.125"-thick) steel fabric; layer 3222 includes two layers of approximately 16-mm-diameter (0.625"-diameter) steel spheres in a square-closely packed configuration; layer 3223 includes a layer of approximately 13-mm-diameter (0.5"-diameter) steel spheres (plugs) placed in the holes created by layer 3223; and layer 3224 includes approximately 5-mm-thick (0.1875"-thick) steel fabric.

Figure 33:
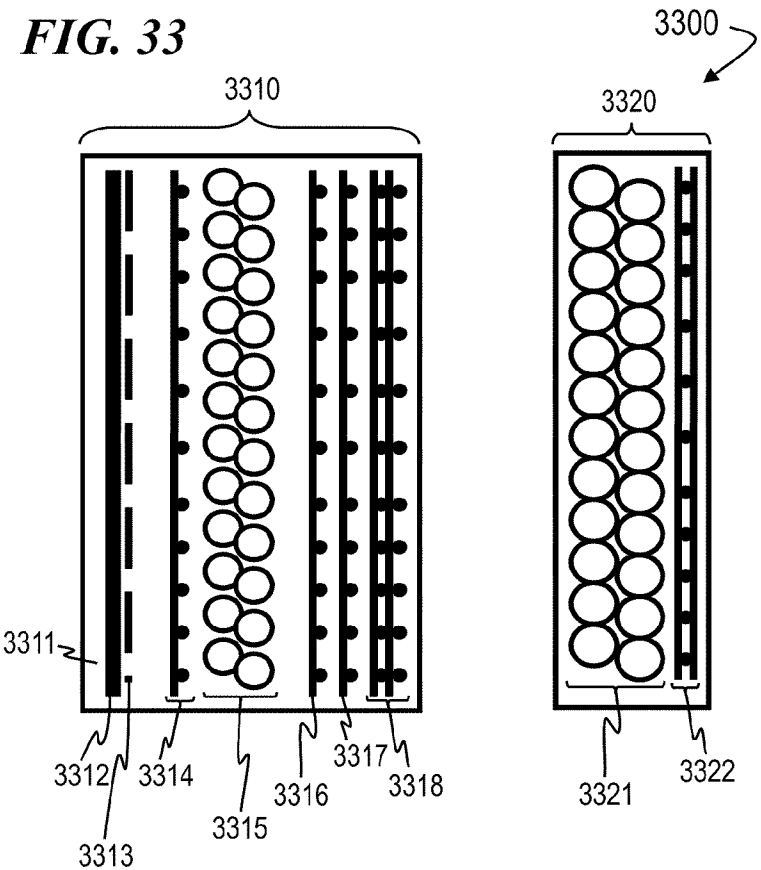
FIG. 33 is a cross-section of again another embodiment of a multi-layer composite armor (MLCA) component 3300.

FIG. 33 is a cross-section of a multi-layer composite armor (MLCA) component 3300. In some embodiments, MLCA component 3300 includes a body portion 3310 and a strike face portion 3320. In some embodiments, as illustrated in FIG. 33, body portion 3310 is formed separately from strike face portion 3320 and then the two portions are joined together (by bolting, by adhesive, by Velcro™, by polymer bonding, or other suitable means). In some embodiments, body portion 3310 has a total thickness of approximately 140 mm (5½") to 152 mm (6"). In some embodiments, strike face portion 3320 has a total thickness of approximately 51 mm (2") to 64 mm (2½"). In some embodiments, body portion 3310 includes the following specifications: layer 3311 includes approximately 3-mm-thick (0.125"-thick) 93A-durometer polyurethane; 3312 includes an approximately 3-mm-thick (0.125"-thick) bainite steel plate; layer 3313 includes three layers of hardwire; layer 3314 includes two layers of approximately 6-mm-thick (0.25"-thick) steel cable; layer 3315 includes two layers of approximately 19-mm-diameter (0.75"-diameter) steel spheres in a hexagonal-closely packed configuration; layer 3316 includes an approximately 6-mm-thick (0.25"-thick) steel weave; layer 3317 include four layers of approximately 6-mm-thick (0.25"-thick) steel fabric; and layer 3318 includes four layers of approximately 5-mm-thick (0.1875"-thick) steel cables.

In some embodiments, strike face portion 3320 includes the following specifications: layer 3321 includes two layers of approximately 25-mm-diameter (1.0"-diameter) steel spheres, and layer 3322 includes three layers of approximately 6-mm-thick (0.25"-thick) steel cables.

Figure 34:
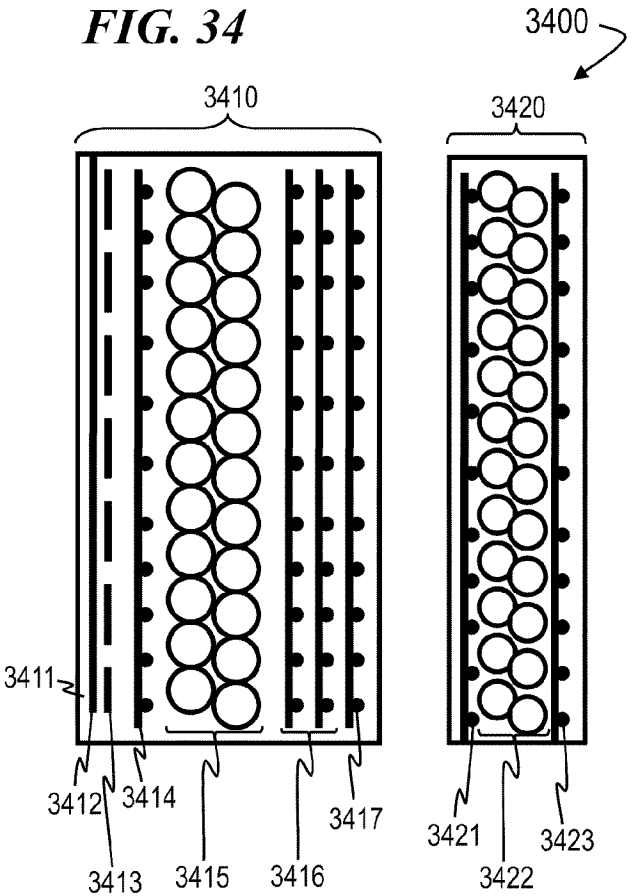
FIG. 34 is a cross-section of yet again another embodiment of a multi-layer composite armor (MLCA) component 3400.

FIG. 34 is a cross-section of a multi-layer composite armor (MLCA) component 3400. In some embodiments, MLCA component 3400 includes a body portion 3410 and a strike face portion 3420. In some embodiments, as illustrated in FIG. 34, body portion 3410 is formed separately from strike face portion 3420 and then the two portions are joined together (by bolting, by adhesive, by Velcro™, by polymer bonding, or other suitable means). In some embodiments, body portion 3410 has a total thickness of approximately 140 mm (5½") to 152 mm (6"). In some embodiments, strike face portion 3420 has a total thickness of approximately 51 mm (2"). In some embodiments, body portion 3410 includes the following specifications: layer 3411 includes an approximately 3-mm-thick (0.125"-thick) 93A-durometer polyurethane; 3412 includes an approximately 3-mm-thick (0.125"-thick) bainite steel plate; layer 3413 includes four layers of hardwire; layer 3414 includes approximately 3-mm-thick (0.125"-thick) steel fabric; layer 3415 includes two layers of approximately 25-mm-diameter (1.0"-diameter) steel spheres in a square-closely packed configuration; layer 3416 includes four layers of approximately 6-mm-thick (0.25"-thick) steel fabric; and layer 3417 includes approximately 5-mm-thick (0.1875"-thick) steel cable weave.

In some embodiments, strike face portion 3420 includes the following specifications: layer 3421 includes approximately 3-mm-thick (0.125"-thick) steel cable fabric; layer 3422 includes two layers of approximately 19-mm-diameter (0.75"-diameter) steel spheres in a hexagonal-closely packed configuration, and layer 3423 includes approximately 3-mm-thick (0.125"-thick) steel cable fabric.

Figure 35:
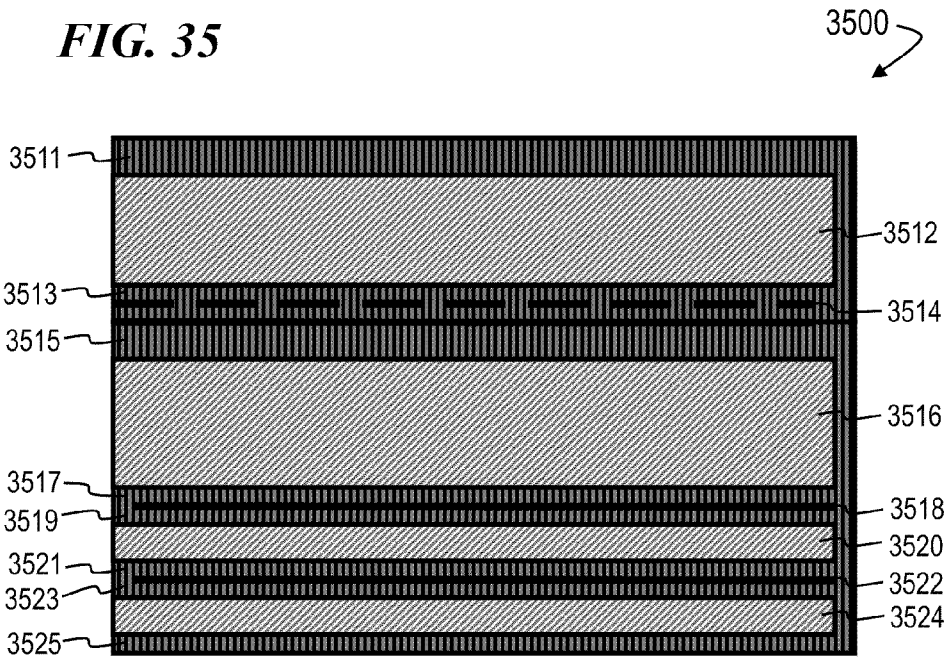
FIG. 35 is a cross-section of yet still again another embodiment of a multi-layer composite armor (MLCA) component 3500.

FIG. 35 is a cross-section of a multi-layer composite armor (MLCA) component 3500. In some embodiments, MLCA component 3500 includes the following specifications: layer 3511 includes approximately 6 mm to 13 mm (0.25" to 0.5") 93A polyurethane; layer 3512 includes two layers of approximately 25-mm-diameter (1.0"-diameter) steel spheres (in some embodiments, the steel spheres are epoxied together in the desired configuration (e.g., square or hexagonal-closely packed) before being placed in the casting mould); layer 3513 includes an approximately 13-mm-thick (0.5"-thick) 93A polyurethane; layer 3514 includes a steel plate with hardwire on top; layer 3515 includes approximately 6-mm-thick (0.25"-thick) 93A polyurethane; layer 3516 includes approximately 19-mm-diameter (0.75"-diameter) steel spheres (in some embodiments, the steel spheres are epoxied together in the desired configuration (e.g., square or hexagonal-closely packed) before being placed in the casting mould); layer 3517 includes approximately 6-mm-thick (0.25"-thick) 93A polyurethane; layer 3518 includes an approximately 3-mm-thick (0.125"-thick) steel plate; layer 3519 includes approximately 6-mm-thick (0.25"-thick) 93A polyurethane; layer 3520 includes an approximately 13-mm-thick (0.5"-thick) composite layer (i.e., a layer that comprises at least two different materials; in some embodiments, for example, a layer comprising polyurethane and fiber-reinforced steel is a composite layer); layer 3521 includes approximately 6-mm-thick (0.25"-thick) 93A polyurethane; layer 3522 includes an approximately 3-mm-thick (0.125"-thick) steel plate; layer 3523 includes approximately 6-mm-thick (0.25"-thick) 93A polyurethane; layer 3524 includes an approximately 13-mm-thick (0.5"-thick) composite layer (e.g., Strongwell® electronic-grade glass); and layer 3525 includes approximately 6-mm-thick (0.25"-thick) 93A polyurethane.

Figure 36B:
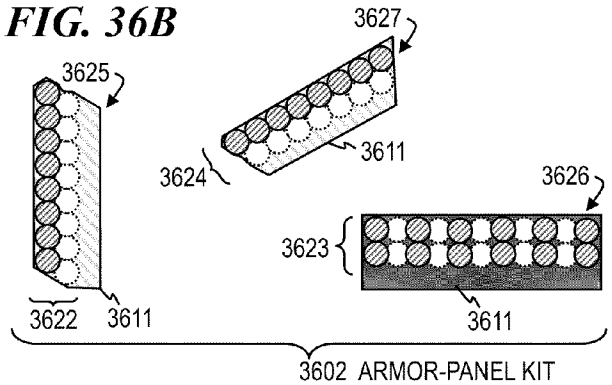
FIG. 36B is a cross section of an armor-panel kit 3602.
Figure 36C:
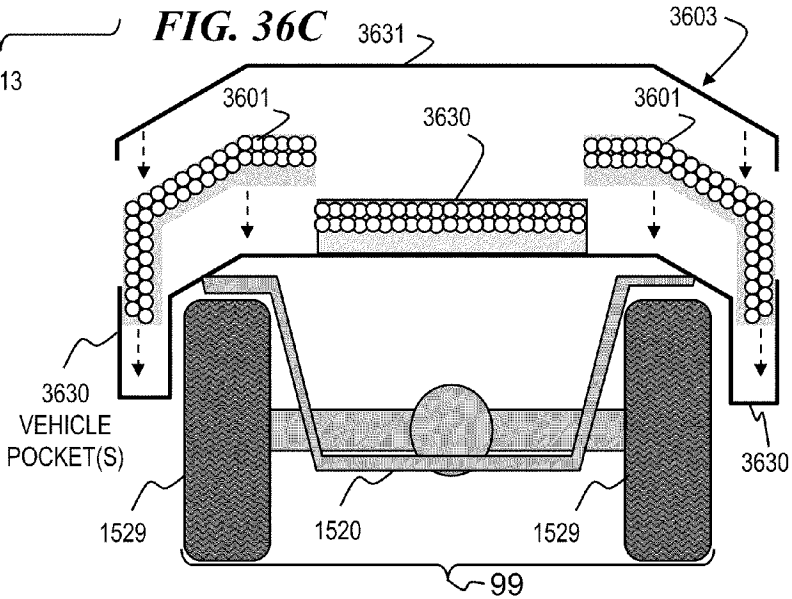
FIG. 36C is a cross-section of an armor-enhanced combat vehicle 3603, according to an example embodiment of the present invention.
Figure 36A:
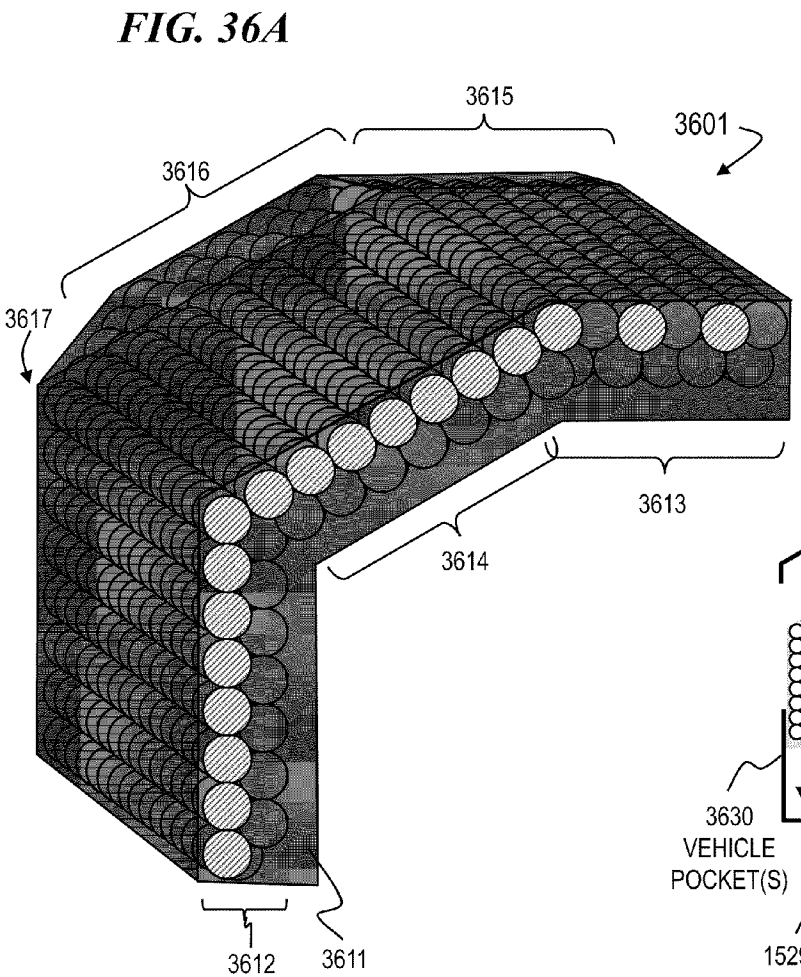
FIG. 36A is perspective view of a multi-planed composite armor component 3601 shown in partial cross-section.

FIG. 36A is perspective view of a composite armor component 3601 having a plurality of sections that are oriented at non-parallel angles to one another (herein called multi-planed armor sections since each section includes planes that are not co-planar), which is shown in partial cross-section. In some embodiments, each of a plurality of sections of armor component 3601 includes a plurality of layers of energy-dispersion objects (e.g., hardened balls made of steel or other suitable metal) that are held in place by a polymer binder and energy-dispersing material (e.g., hard, high-durometer polyurethane) 3611. In some embodiments, (not shown) only one layer of energy-dispersion objects (e.g., hardened balls made of steel or other suitable metal) is used. In some embodiments, armor component 3601 further includes at least one layer of closely-packed metal rope (e.g., steel cables, such as shown in FIG. 26A, 26B, or 26C, but not shown in this figure). In some embodiments, armor component 3601 includes at least one layer of metal such as bainite-hardened steel plate or steel fabric (such as plates 2812 and 2813 shown in FIG. 28, but not shown in this figure). In some embodiments, armor component 3601 is a light-weight armor used to defend a vehicle against heavy-caliber man-portable weapons systems (e.g., a 14.5-mm round). In some embodiments, armor component 3601 is approximately 51 mm thick (2 inches thick) and includes two layers of hexagonal-closely packed, approximately 19-mm-diameter (0.75-inch-diameter), case-hardened metal spheres, wherein polyurethane 3611 is a high-tensile-strength polyurethane such as obtained using Andur 5 DPLM-brand prepolymer. In other embodiments, three layers of hexagonal-closely packed, approximately 13-mm-diameter (0.5-inch-diameter), case-hardened metal spheres (e.g., such as layers 2822 of FIG. 28, but not shown here). In some embodiments, composite armor component 3601 includes a first dual-layer-of-balls plane of metal spheres 3612 that is vertical with respect to the ground, a second dual-layer-of-balls plane of metal spheres 3613 that is horizontal with respect to the ground, and a third dual-layer-of-balls plane of metal spheres 3614 that is non-parallel with respect to both the first and the second planes, but connected to both at their respective center edges. In some embodiments, plane 3614 forms a 60-degree angle with plane 3612, and plane 3614 forms a 30-degree angle with plane 3613. In some embodiments, armor component 3601 includes a fourth plane of metal spheres 3615 and a fifth plane of metal spheres 3616, wherein the fourth plane and fifth plane are non-parallel to each other, and wherein both plane 3615 and plane 3616 angle down over the hood toward the front of the vehicle being protected. In some embodiments, armor component 3601 includes a sixth plane of metal spheres 3617 that is vertical with respect to the ground and wraps completely around the front of the vehicle.

In some embodiments, armor component 3601 is molded as one continuous piece and then attached to the vehicle by inserting armor component 3601 into metal-plate pockets 3630 (see FIG. 26C), while in other embodiments, armor component 3601 is attached by bolting, by adhesive, by Velcro™ or by other suitable means. In some embodiments, each plane of armor component 3601 is molded separately (see, for example, armor-panel kit 3602 illustrated in FIG. 36B) and then at least two of the planes are connected together (by bolting, by adhesive, by Velcro™ or other suitable means) and placed on the vehicle as described above. In some embodiments, the separately-molded planes of armor are separately placed into vehicle pockets 3630 on vehicle 99. In some embodiments, the separately-molded planes are connected to each other after being placed in pockets 3630 using adhesive or other suitable means, and in other embodiments, the separately-molded planes remain unconnected from each other after they are placed in pockets 3630 (see, for example, FIG. 36C). By having separate pieces in pockets, it is somewhat easier to do a field replacement of individual panels that may have been damaged by enemy-fired projectiles.

FIG. 36B is a cross-section of three sections of an armor-panel kit 3602. In some embodiments, armor-panel kit 3602 includes a first section 3625 that includes a first plane having two layers of metal spheres 3622, wherein the first plane of metal spheres 3622 is held together by being molded within a polymer layer (e.g., polyurethane) 3611. In some embodiments, the first plane of metal spheres 3622 is used to form dual-layer-of-balls plane 3612 of FIG. 36A. In some embodiments, armor-panel kit 3602 includes a second section 3626 that includes a second plane having two layers of metal spheres 3623, wherein the second plane of metal spheres 3623 is held together by polyurethane 3611. In some embodiments, the second plane of metal spheres 3623 is used to form dual-layer-of-balls plane 3613 of FIG. 36A. In some embodiments, armor-panel kit 3602 includes a third section 3627 that includes a third plane having two layers of metal spheres 3624, wherein the third plane of metal spheres 3624 is held together by polyurethane 3611. In some embodiments, the third plane of metal spheres 3624 is used to form dual-layer-of-balls plane 3614 of FIG. 36A.

FIG. 36C is a cross-section of an armor-enhanced combat vehicle 3603, according to an example embodiment of the present invention. In some embodiments, armor-enhanced combat vehicle 3603 includes a vehicle 99 that is protected by a one or more sections of multi-planed armor component 3601 and single-plane armor component 3630. In some embodiments, armor component 3630 and/or multi-planed armor component 3601 each include a plurality of layers of hardened metal spheres held in place by a high-tensile-strength polyurethane such as obtained using Andur 5 DPLM-brand prepolymer. In some embodiments, armor component 3630 and/or multi-planed armor component 3601 each include at least one layer of metal rope (e.g., steel cables). In some embodiments, armor component 3630 and/or multi-planed armor component 3601 each include at least one layer of bainite-hardened steel or steel fabric. In some embodiments, each one of the plurality of sections of armor component 3601 and/or armor component 3630 is held in place on vehicle 99 by placing it in one of a plurality of corresponding vehicle pockets 3630. In some embodiments, the plurality of sections of armor component 3601 are connected to armor component 3630 (by molding additional polyurethane material, by bolting, by adhesive, by Velcro™ or by other suitable means) after the armor components 3601 are placed in pockets 3630. In other embodiments, the plurality of sections of armor component 3601 remain tightly abutted to but unconnected from armor component 3630 after the armor components 3601 are placed in pockets 3630. In some embodiments, a capping metal cover 3631 covers the top of the armor sections 3601 and 3630. In other embodiments, a cover 3631 made of molded-in-place polyurethane covers the top of and holds together the armor sections 3601 and 3630. In some embodiments, polyurethane cover 3631 includes a high-durometer polyurethane such as 93A polyurethane. In some embodiments, vehicle 99 includes underbelly armor 1520. In some embodiments, the first layer of bonding material in underbelly armor 1520 has a high durometer (e.g., 93A-durometer polyurethane) such that elongation and acceleration of the first multi-layer composite armor is mitigated. In some embodiments, bainite-hardened steel and Kevlar® sheeting are placed in the strike-face layer of underbelly armor 1520 in order to substantially stop explosion fragments (e.g., 20 mm fragments) from penetrating underbelly armor 1520.

In some embodiments, the present invention provides an apparatus that includes a first multi-layer composite armor component comprising a plurality of layers of energy-dispersion objects including a first layer that includes a first plurality of energy-dispersion objects and a second layer that includes a second plurality of energy-dispersion objects, wherein the first plurality of energy-dispersion objects are held in place relative to one another in a closely-packed configuration such that each one of the first plurality of energy-dispersion objects touches at least one other energy-dispersion object in the first layer; a plurality of bonding layers affixed to each other including a first layer of bonding material and a second layer of bonding material, wherein the first layer of bonding material has a first durometer value, wherein the first plurality of energy-dispersion objects are held in place relative to one another via the first layer of bonding material, wherein the second bonding layer has a second durometer value, wherein the second plurality of energy-dispersion objects are held in place relative to one another via the second layer of bonding material.

In some embodiments, the apparatus further includes a vehicle and a plurality of other multi-layer composite armor components each substantially similar to the first multi-layer composite armor component, wherein the first multi-layer composite armor component and the plurality of other multi-layer composite armor components are affixed to the vehicle to protect it from incoming projectiles.

In some embodiments, the apparatus further includes a second multi-layer composite armor component substantially similar to the first multi-layer composite armor component, wherein the first multi-layer composite armor component and the second multi-layer composite armor component are affixed to one another such that at least a portion of the first multi-layer composite armor component and the second multi-layer composite armor component overlap one another.

In some embodiments, the first durometer value is substantially similar to the second durometer value.

In some embodiments, the first plurality of energy-dispersion objects is arranged in a hexagonal-closely packed configuration such that each one of the first plurality of energy-dispersion objects touches six other energy-dispersion objects in the first layer.

In some embodiments, the first plurality of energy-dispersion objects is arranged in a square-closely packed configuration such that each one of the first plurality of energy-dispersion objects touches four other energy-dispersion objects in the first layer.

In some embodiments, the first bonding layer includes a polyurethane that has a durometer value of substantially 93A. In some embodiments, the second bonding layer includes a polyurethane that has a durometer value of substantially 59A.

In some embodiments, the first plurality of energy-dispersion objects includes steel spheres. In some embodiments, the first plurality of energy-dispersion objects includes ceramic prisms. In some embodiments, the first plurality of energy-dispersion objects includes ceramic prisms arranged in a hexagonal-closely packed configuration. In some embodiments, the first plurality of energy-dispersion objects includes ceramic prisms arranged in a square-closely packed configuration. In some embodiments, the first plurality of energy-dispersion objects includes ceramic-coated steel spheres.

In some embodiments, the first layer of bonding material fully encapsulates the first layer of energy-dispersion objects. In some embodiments, the first layer of bonding material fully encapsulates the first layer of energy-dispersion objects, wherein the second layer of bonding material fully encapsulates the second layer of energy-dispersion objects, and wherein the second layer of bonding material and the first layer of bonding material are contiguous portions of a single bonding layer formed at one time.

In some embodiments, the first multi-layer composite armor component is fully encapsulated by an exterior layer, wherein the exterior layer includes an ether polyurethane. In some embodiments, the ether polyurethane has a durometer value of substantially 93A. In some embodiments, the ether polyurethane has a substantially black color.

In some embodiments, at least one of the plurality of bonding layers includes an ester polyurethane.

In some embodiments, the present invention provides a method for making a defense against a ballistic projectile, the method including providing a plurality of layers of energy-dispersion objects including a first layer that includes a first plurality of energy-dispersion objects and a second layer that includes a second plurality of energy-dispersion objects; arranging at least one of the plurality of layers of energy-dispersion objects such that energy-dispersion objects within the at least one layer are held in place relative to one another in a closely-packed configuration, wherein each energy-dispersion object in the at least one layer touches at least one other energy-dispersion object in the at least one layer; providing a plurality of bonding layers affixed to each other including a first layer of bonding material and a second layer of bonding material, wherein the first layer of bonding material has a first durometer value, and wherein the second layer of bonding material has a second durometer value; holding the first layer of energy-dispersion objects in place via the first layer of bonding material; and holding the second layer of energy-dispersion objects in place via the second layer of bonding material.

In some embodiments, the first layer of bonding material fully encapsulates the first layer of energy-dispersion objects, wherein the second layer of bonding material fully encapsulates the second layer of energy-dispersion objects, and wherein the second layer of bonding material and the first layer of bonding material are contiguous portions of a single bonding layer formed at one time.

In some embodiments, the method further comprises fully encapsulating the single bonding layer with an exterior layer of ether polyurethane, wherein the ether polyurethane has a substantially black color.

In some embodiments, the method further comprises providing an evacuated mold, wherein the single bonding layer is formed in the evacuated mold.

In some embodiments, the present invention provides a multi-layer composite armor that includes a first multi-layer composite armor component comprising a first strike-face layer that includes at least one ceramic object; a plurality of layers of energy-dispersion objects including a first layer that includes a first plurality of energy-dispersion objects and a second layer that includes a second plurality of energy-dispersion objects, wherein energy-dispersion objects in at least one of the layers are held in place relative to one another in a closely-packed configuration such that each energy-dispersion object in the at least one layer touches at least one other energy-dispersion object in the at least one layer; a plurality of bonding layers affixed to each other including a first layer of bonding material and a second layer of bonding material, wherein the first plurality of energy-dispersion objects are held in place relative to one another via the first layer of bonding material, wherein the second plurality of energy-dispersion objects are held in place relative to one another via the second layer of bonding material, and wherein the strike-face layer is affixed to a strike-face side of the first multi-layer composite armor component.

In some embodiments, the at least one ceramic object includes a plurality of cylindrical ceramic objects arranged horizontally such that each one of the plurality of cylindrical ceramic objects is substantially parallel to a face of the first strike-face layer. In some embodiments, the at least one ceramic object includes a plurality of cylindrical ceramic objects arranged vertically such that each one of the plurality of cylindrical objects is substantially perpendicular to a face of the first strike-face layer. In some embodiments, the at least one ceramic object includes an alumina. In some embodiments, the at least one ceramic object includes a silicon carbide. In some embodiments, the at least one ceramic object includes a plurality of hexagonally-shaped ceramic plates. In some embodiments, the at least one ceramic object includes a plurality of square-shaped ceramic plates.

In some embodiments, the at least one ceramic object of the first strike-face includes a plurality of cylindrical ceramic objects arranged horizontally such that each one of the plurality of cylindrical ceramic objects is substantially parallel to a face of the first strike-face layer, the armor further including a second strike-face layer affixed to an exterior side of the first strike-face layer, wherein the second strike-face layer includes at least one ceramic object, wherein the at least one ceramic object includes a plurality of hexagonally-shaped ceramic objects.

In some embodiments, the present invention provides a method for making a defense against a ballistic projectile, the method including providing a strike-face layer; providing a plurality of layers of energy-dispersion objects including a first layer that includes a first plurality of energy-dispersion objects and a second layer that includes a second plurality of energy-dispersion objects; arranging at least one of the plurality of layers of energy-dispersion objects such that energy-dispersion objects within the at least one layer are held in place relative to one another in a closely-packed configuration, wherein each energy-dispersion object in the at least one layer touches at least one other energy-dispersion object in the at least one layer; providing a plurality of bonding layers affixed to each other including a first layer of bonding material and a second layer of bonding material, wherein the first layer of bonding material has a first durometer value, and wherein the second layer of bonding material has a second durometer value; holding the first layer of energy-dispersion objects in place via the first layer of bonding material; holding the second layer of energy-dispersion objects in place via the second layer of bonding material; and affixing the strike-face layer to a strike-face side of the plurality of layers of energy-dispersion objects.

In some embodiments, the present invention provides a method for making a defense against a ballistic projectile, the method including providing a strike-face layer; providing a plurality of polyurethane composite layers, wherein the plurality of polyurethane composite layers includes a first polyurethane composite layer; providing at least one layer of energy-dispersion objects; encapsulating the at least one layer of energy-dispersion objects within the first polyurethane composite layer; affixing the plurality of polyurethane composite layers to each other such that a multi-layer armor is formed; and affixing the first strike-face layer to a strike-face side of the plurality of polyurethane composite layers.

In some embodiments, the present invention provides an apparatus that includes a first multi-layer composite armor component comprising a plurality of layers of energy-dispersion objects including a first layer that includes a first plurality of energy-dispersion objects and a second layer that includes a second plurality of energy-dispersion objects, wherein energy-dispersion objects in at least one of the layers are held in place relative to one another in a closely-packed configuration such that each energy-dispersion object in the at least one layer touches at least one other energy-dispersion object in the at least one layer; a plurality of bonding layers affixed to each other including a first layer of bonding material and a second layer of bonding material, wherein the first plurality of energy-dispersion objects are held in place relative to one another via the first layer of bonding material, wherein the second plurality of energy-dispersion objects are held in place relative to one another via the second layer of bonding material; and a shock-absorbing layer, wherein the shock-absorbing layer is affixed to a side of the first multi-layer composite armor component that is farthest from a strike-face side of the multi-layer composite armor component, and wherein the shock-absorbing layer includes a contoured surface on a non-strike-face side of the shock-absorbing layer.

In some embodiments, the shock-absorbing layer includes a polyurethane. In some embodiments, the shock-absorbing layer includes a rippled surface configuration on a non-strike-face side of the shock-absorbing layer. In some embodiments, the shock-absorbing layer includes a scalloped surface configuration on a non-strike-face side of the shock-absorbing layer. In some embodiments, the shock-absorbing layer includes an indented surface configuration on a non-strike-face side of the shock-absorbing layer. In some embodiments, the shock-absorbing layer includes a plurality of hemispherical-shaped contours on a non-strike-face side of the shock-absorbing layer.

In some embodiments, the present invention provides a multi-layer composite armor that includes at least one layer of energy-dispersion objects; and a plurality of polyurethane composite layers affixed to each other including a first polyurethane composite layer and a second polyurethane composite layer, wherein the at least one layer of energy-dispersion objects is encapsulated within the first polyurethane composite layer, and wherein a non-strike-face side of the second polyurethane composite layer forms a contoured inner layer of the multi-layer composite armor.

In some embodiments, the present invention provides a method for making a defense against a ballistic projectile, the method including providing a plurality of layers of energy-dispersion objects including a first layer that includes a first plurality of energy-dispersion objects and a second layer that includes a second plurality of energy-dispersion objects; arranging at least one of the plurality of layers of energy-dispersion objects such that energy-dispersion objects within the at least one layer are held in place relative to one another in a closely-packed configuration, wherein each energy-dispersion object in the at least one layer touches at least one other energy-dispersion object in the at least one layer; providing a plurality of bonding layers affixed to each other including a first layer of bonding material and a second layer of bonding material; holding the first layer of energy-dispersion objects in place via the first layer of bonding material; holding the second layer of energy-dispersion objects in place via the second layer of bonding material; providing a shock-absorbing layer, wherein the shock-absorbing layer includes a contoured surface on a non-strike-face side of the shock-absorbing layer; and affixing the shock-absorbing layer to a non-strike-face side of the plurality of layers of energy-dispersion objects.

In some embodiments, the present invention provides a multi-layer composite armor that includes one or more layers of energy-dispersion objects; a plurality of polyurethane composite layers affixed to each other including a first polyurethane composite layer and a second polyurethane composite layer, wherein the first polyurethane composite layer has a first hardness, wherein the one or more layers of energy-dispersion objects is encapsulated within the first polyurethane composite layer, wherein the second polyurethane composite layer is affixed to the first polyurethane composite layer, wherein the second polyurethane composite layer has a second hardness that is less than the first hardness of the first polyurethane composite layer, and wherein a non-strike-face side of the second polyurethane composite layer forms a contoured inner layer of the multi-layer composite armor; one or more containment plates wherein at least one of the one or more containment plates is affixed to a non-strike-face side of the first polyurethane composite layer; and a ceramic layer, wherein the ceramic layer is affixed to the plurality of polyurethane composite layers on a strike-face side of the plurality of polyurethane composite layers, and wherein the ceramic layer has a third hardness that is greater than the first hardness of the first polyurethane composite layer.

In some embodiments, the present invention provides an apparatus that includes a first multi-layer composite armor component comprising a plurality of layers of energy-dispersion objects including a first layer that includes a first plurality of energy-dispersion objects and a second layer that includes a second plurality of energy-dispersion objects, wherein energy-dispersion objects in at least one of the layers are held in place relative to one another in a closely-packed configuration such that each energy-dispersion object in the at least one layer touches at least one other energy-dispersion object in the at least one layer; a plurality of bonding layers affixed to each other including a first layer of bonding material and a second layer of bonding material, wherein the first layer of bonding material has a first durometer value, wherein the first plurality of energy-dispersion objects are held in place relative to one another via the first layer of bonding material, wherein the second bonding layer has a second durometer value, wherein the second plurality of energy-dispersion objects are held in place relative to one another via the second layer of bonding material; a plurality of containment layers including a first containment layer and a second containment layer, wherein the first containment layer is affixed to a non-strike-face side of the first layer of energy-dispersion objects; a strike-face layer that includes at least one ceramic object, wherein the strike-face layer is affixed to a strike-face side of the first multi-layer composite armor component, and wherein the strike-face layer has a third durometer value that is greater than the first durometer value and the second durometer value; and a shock-absorbing layer, wherein the shock-absorbing layer is affixed to a side of the first multi-layer composite armor component that is farthest from a strike-face side of the multi-layer composite armor component, wherein the shock-absorbing layer has a fourth durometer value, and wherein the fourth durometer value is less than the first durometer value and the second durometer value.

In some embodiments, the present invention provides a method for making a defense against a ballistic projectile, the method including providing a strike-face layer; providing a plurality of layers of energy-dispersion objects including a first layer that includes a first plurality of energy-dispersion objects and a second layer that includes a second plurality of energy-dispersion objects; affixing the strike-face layer to a strike-face side of the plurality of layers of energy-dispersion objects; arranging at least one of the plurality of layers of energy-dispersion objects such that energy-dispersion objects within the at least one layer are held in place relative to one another in a closely-packed configuration, wherein each energy-dispersion object in the at least one layer touches at least one other energy-dispersion object in the at least one layer; providing a plurality of bonding layers affixed to each other including a first layer of bonding material and a second layer of bonding material, wherein the first layer of bonding material has a first durometer value, and wherein the second layer of bonding material has a second durometer value; holding the first layer of energy-dispersion objects in place via the first layer of bonding material; holding the second layer of energy-dispersion objects in place via the second layer of bonding material; reinforcing the first layer of energy-dispersion objects such that the plurality of energy-dispersion objects remains substantially confined to the first layer of bonding material upon impact with the ballistic projectile; providing a shock-absorbing layer, wherein the shock-absorbing layer includes a contoured surface on a non-strike-face side of the shock-absorbing layer; and affixing the shock-absorbing layer to a non-strike-face side of the plurality of layers of energy-dispersion objects.

In some embodiments, the present invention provides an apparatus that includes a first multi-layer composite armor component comprising a first steel layer outer strike face; a first fiber-reinforced resilient layer bonded to the steel layer; a basalt-fiber layer bonded to the first fiber-reinforced resilient layer; a second steel layer; and a second fiber-reinforced resilient layer bonded to the second steel layer.

In some embodiments, the apparatus further includes a vehicle, wherein the multi-layer composite armor is affixed to a bottom of the vehicle.

In some embodiments, the present invention provides a layer of armor including a first material; and a second material, wherein the first and second material forming a composite layer.

In some embodiments, the present invention provides an apparatus comprising a multi-layer composite armor that includes a first composite layer that includes a two or more adjacent layers of heavy, hard resilient pieces embedded in a material that is softer than the pieces; and a second composite layer affixed to the first composite layer, wherein the second composite layer includes a steel plate and a fiber-reinforced sound-wave-deadening material bonded to the steel plate.

In some embodiments, the heavy, hard resilient pieces include steel ball bearings. In some embodiments, the heavy, hard resilient pieces include hardened steel energy-dispersion objects. In some embodiments, the fiber-reinforced sound-wave-deadening material includes polyurethane. In some embodiments, the fiber-reinforced sound-wave-deadening material includes polyurethane and basalt fibers. In some embodiments, the fiber-reinforced sound-wave-deadening material includes polyurethane and glass fibers. In some embodiments, the fiber-reinforced sound-wave-deadening material includes polyurethane and steel fibers.

In some embodiments, the invention further includes a vehicle, wherein the multi-layer composite armor is affixed to a side of the vehicle.

In some embodiments, the present invention provides a method including transferring momentum of an incoming projectile to a plurality of separable heavy, hard resilient pieces embedded, in two or more adjacent layers, in a material that is softer than the pieces; and stopping debris resulting from the transferring of momentum with a composite layer that includes an outer steel layer and an inner resilient layer.

In some embodiments, the present invention provides an apparatus that includes a first multi-layer composite armor component, wherein the first multi-layer composite armor component includes a plurality of layers of energy-dispersion objects including a first layer that includes a first plurality of energy-dispersion objects and a second layer that includes a second plurality of energy-dispersion objects, wherein the first plurality of energy-dispersion objects in the first layer are held in place relative to one another in a closely-packed configuration such that each of the first plurality of energy-dispersion object in the first layer touches at least three other energy-dispersion objects in the first layer; a plurality of bonding layers affixed to each other including a first layer of bonding material and a second layer of bonding material, wherein the first layer of bonding material has a first durometer value, wherein the first plurality of energy-dispersion objects are held in place relative to one another via the first layer of bonding material, wherein the second bonding layer has a second durometer value that is less than (softer) the first durometer value, and wherein the second bonding layer is farther from a strike face than the first bonding layer.

In some embodiments, the apparatus further includes a vehicle and a plurality of other multi-layer composite armor components each substantially similar to the first multi-layer composite armor component, wherein the first multi-layer composite armor component and the plurality of other multi-layer composite armor components are affixed to the vehicle to protect it from incoming projectiles.

In some embodiments, the apparatus further includes a second multi-layer composite armor component substantially similar to the first multi-layer composite armor component, wherein the first multi-layer composite armor component and the second multi-layer composite armor component are affixed to one another such that at least a portion of the first multi-layer composite armor component and the second multi-layer composite armor component overlap one another.

In some embodiments, the second bonding layer includes embedded fiber reinforcement. In some embodiments, the embedded fabric reinforcement includes a ballistic fiber. In some embodiments, the second bonding layer includes at least one embedded metal plate. In some embodiments, the second bonding layer includes at least one embedded metal plate reinforced by an embedded ballistic fiber.

In some embodiments, the apparatus further includes a strike-face layer that includes at least one ceramic object. In some embodiments, the at least one ceramic object includes a plurality of hexagonally-shaped ceramic plates.

In some embodiments, the apparatus further includes a shock-absorbing layer, wherein the shock-absorbing layer is affixed to a side of the first multi-layer composite armor component that is farthest from a strike-face side of the multi-layer composite armor component. In some embodiments, the shock-absorbing layer includes a polyurethane, and the shock-absorbing layer includes a scalloped surface configuration on a non-strike-face side of the shock-absorbing layer.

In some embodiments, the first multi-layer composite armor component is fully encapsulated by an exterior layer, and wherein the exterior layer includes ether polyurethane.

In some embodiments, the present invention provides a method for making a defense against a ballistic projectile, wherein the method includes providing a plurality of layers of energy-dispersion objects including a first layer that includes a first plurality of energy-dispersion objects and a second layer that includes a second plurality of energy-dispersion objects; arranging the first plurality of layers of energy-dispersion objects such that each of the first plurality of energy-dispersion objects are held in place relative to one another in a closely-packed configuration, wherein each of the first plurality of energy-dispersion objects touches at least three other energy-dispersion object in the first layer; providing a plurality of bonding layers affixed to each other including a first layer of bonding material and a second layer of bonding material, wherein the first layer of bonding material has a first durometer value, wherein the second layer of bonding material has a second durometer value that is less than (softer) the first durometer value, and wherein the second bonding layer is farther from a strike face than the first bonding layer; and holding the first plurality of energy-dispersion objects in place via the first layer of bonding material.

In some embodiments, the method further includes providing a vehicle; providing a plurality of other multi-layer composite armor components each substantially similar to the first multi-layer composite armor component; and affixing the first multi-layer composite armor component and the plurality of other multi-layer composite armor components to the vehicle to protect it from incoming projectiles.

In some embodiments, the method further includes providing a second multi-layer composite armor component substantially similar to the first multi-layer composite armor component; and affixing the first multi-layer composite armor component and the second multi-layer to one another such that at least a portion of the first multi-layer composite armor component and the second multi-layer composite armor component overlap one another.

In some embodiments, the method further includes embedding fiber reinforcement within the second bonding layer. In some embodiments, the embedded fabric reinforcement includes a ballistic fiber. In some embodiments, the method further includes embedding at least one metal plate within the second bonding layer. In some embodiments, the method further includes embedding at least one metal plate within the second bonding layer; and reinforcing the at least one metal plate with a ballistic fiber.

In some embodiments, the method further includes providing a strike-face layer that includes at least one ceramic object. In some embodiments, the at least one ceramic object includes a plurality of hexagonally-shaped ceramic plates.

In some embodiments, the method further includes providing a shock-absorbing layer; and affixing the shock-absorbing layer to a side of the first multi-layer composite armor component that is farthest from a strike-face side of the multi-layer composite armor component. In some embodiments, the shock-absorbing layer includes a polyurethane, and the shock-absorbing layer includes a scalloped surface configuration on a non-strike-face side of the shock-absorbing layer.

In some embodiments, the method further includes fully encapsulating the first multi-layer composite armor component with an exterior layer, wherein the exterior layer includes ether polyurethane.

In some embodiments, the present invention provides a method for defending against a ballistic projectile that includes transferring momentum of an incoming ballistic projectile to a plurality of separable heavy, hard resilient pieces embedded, in two or more adjacent layers, in a material that is softer than the pieces; and stopping debris resulting from the transferring of momentum with a composite layer that includes an outer steel layer and an inner resilient layer.

In some embodiments, the present invention provides a first multi-layer composite armor component that includes a plurality of layers of energy-dispersion objects including a first layer that includes a first plurality of energy-dispersion objects and a second layer that includes a second plurality of energy-dispersion objects, wherein the first plurality of energy-dispersion objects in the first layer are held in place relative to one another in a closely-packed configuration; and a first layer of bonding material, wherein the first layer of bonding material has a first durometer value, and wherein the first plurality of energy-dispersion objects are held in place relative to one another via the first layer of bonding material. In some embodiments, each of the first plurality of energy-dispersion objects in the first layer touches at least three other energy-dispersion objects in the first layer.

In some embodiments, the apparatus further includes a plurality of other multi-layer composite armor components each substantially similar to the first multi-layer composite armor component; and a vehicle, wherein the first multi-layer composite armor component and the plurality of other multi-layer composite armor components are affixed to the vehicle to protect the vehicle from incoming projectiles.

In some embodiments, the apparatus further includes a second multi-layer composite armor component, wherein the first multi-layer composite armor component and the second multi-layer composite armor component are affixed to one another such that at least a portion of the first multi-layer composite armor component and the second multi-layer composite armor component overlap one another. In some embodiments, the second multi-layer composite armor component is substantially similar to the first multi-layer composite armor component.

In some embodiments, the first bonding layer includes at least one metal plate embedded within the first bonding layer. In some embodiments, the first bonding layer includes fiber reinforcement embedded within the first bonding layer, wherein the first bonding layer includes at least one metal plate embedded within the first bonding layer. In some embodiments, the first bonding layer includes fiber reinforcement embedded within the first bonding layer. In some embodiments, the fiber reinforcement includes a ballistic fiber.

In some embodiments, the first multi-layer composite armor component is fully encapsulated by an exterior layer of encapsulant, and the exterior layer includes ether polyurethane.

In some embodiments, the apparatus further includes a second layer of bonding material, wherein the second bonding layer has a second durometer value that is less than (softer) the first durometer value, and wherein the second bonding layer is farther from a strike-face side of the multi-layer composite armor component than the first bonding layer.

In some embodiments, the apparatus further includes a shock-absorbing layer that has a lower durometer value than the durometer value of the first bonding layer (i.e., the inner (second) shock-absorbing layer is softer than the outer strike face), wherein the shock-absorbing layer is affixed to a side of the first multi-layer composite armor component that is farther from the strike-face side of the multi-layer composite armor component than the second layer of bonding material. In some embodiments, the shock-absorbing layer includes a polyurethane, and the shock-absorbing layer includes a contoured surface configuration on a non-strike-face side of the shock-absorbing layer.

In some embodiments, the apparatus further includes a second layer of bonding material, wherein the second bonding layer has a second durometer value that is less than the first durometer value, wherein the second bonding layer is farther from a strike-face side of the multi-layer composite armor component than the first bonding layer. In some such embodiments, the first bonding layer includes steel-fiber-mesh fabric embedded within the first bonding layer. In some such embodiments, the second bonding layer also includes steel-fiber-mesh fabric embedded within the second bonding layer.

In some embodiments, the first multi-layer composite armor component is used as an underbelly armor (i.e., placed on the underside of a vehicle such that the armor protects against explosions that occur beneath the vehicle). In some embodiments, the first layer of bonding material in the underbelly armor has a high durometer (e.g., 93A-durometer polyurethane) such that elongation and acceleration of the first multi-layer composite armor is mitigated. In some embodiments, bainite-hardened steel and Kevlar® sheeting are placed in the strike-face layer of the underbelly armor in order to substantially stop explosion fragments (e.g., 20 mm fragments) from penetrating the underbelly armor. In some embodiments, the present invention provides a method for making a defense against a ballistic projectile, the method including providing a plurality of layers of energy-dispersion objects including a first layer that includes a first plurality of energy-dispersion objects and a second layer that includes a second plurality of energy-dispersion objects; arranging the first plurality of layers of energy-dispersion objects such that each of the first plurality of energy-dispersion objects are held in place relative to one another in a closely-packed configuration; providing a first layer of bonding material, wherein the first layer of bonding material has a first durometer value; and embedding the first plurality of energy-dispersion objects in the first layer of bonding material. In some embodiments, each of the first plurality of energy-dispersion objects in the first layer touches at least three other energy-dispersion objects in the first layer.

In some embodiments, the method further includes providing a vehicle; providing a plurality of other multi-layer composite armor components each substantially similar to the first multi-layer composite armor component; and affixing the first multi-layer composite armor component and the plurality of other multi-layer composite armor components to the vehicle to protect it from incoming projectiles.

In some embodiments, the method further includes providing a second multi-layer composite armor component; and affixing the first multi-layer composite armor component and the second multi-layer composite armor component to one another such that at least a portion of the first multi-layer composite armor component and the second multi-layer composite armor component overlap one another. In some embodiments, the second multi-layer composite armor component is substantially similar to the first multi-layer composite armor component.

In some embodiments, the method further includes embedding at least one metal plate within the first bonding layer. In some embodiments, the method further includes embedding at least one metal plate within the first bonding layer; and reinforcing the at least one metal plate by embedding fiber reinforcement within the first bonding layer. In some embodiments, the method further includes embedding fiber reinforcement within the first bonding layer. In some embodiments, the fiber reinforcement includes a ballistic fiber.

In some embodiments, the method further includes fully encapsulating the first multi-layer composite armor component with an exterior layer of encapsulant, wherein the exterior layer includes ether polyurethane.

In some embodiments, the method further includes providing a second layer of bonding material, wherein the second bonding layer has a second durometer value that is less than (softer) the first durometer value, and wherein the second bonding layer is farther from a strike-face side of the multi-layer composite armor component than the first bonding layer.

In some embodiments, the method further includes providing a shock-absorbing layer that has a lower durometer value than the durometer value of the first bonding layer; and affixing the shock-absorbing layer to a side of the first multi-layer composite armor component that is farther from a strike-face side of the multi-layer composite armor component than the second layer of bonding material. In some embodiments, the shock-absorbing layer includes a polyurethane, and wherein the shock-absorbing layer includes a contoured surface configuration on a non-strike-face side of the shock-absorbing layer.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. An apparatus comprising:

a first multi-layer composite armor component comprising:

a plurality of layers of energy-dispersion objects including a first layer that includes a first plurality of energy-dispersion objects and a second layer that includes a second plurality of energy-dispersion objects, wherein the first plurality of energy-dispersion objects in the first layer are held in place relative to one another in a closely-packed configuration;

a first layer of bonding material, wherein the first layer of bonding material has a first durometer value, and wherein the first plurality of energy-dispersion objects are held in place relative to one another via the first layer of bonding material; and a second layer of bonding material, wherein the second bonding layer has a second durometer value that is less than the first durometer value, and wherein the second bonding layer is farther from a strike-face side of the multi-layer composite armor component than the first bonding layer.

2. The apparatus of claim 1, further comprising:

a plurality of other multi-layer composite armor components each substantially similar to the first multi-layer composite armor component; and a vehicle, wherein the first multi-layer composite armor component and the plurality of other multi-layer composite armor components are affixed to the vehicle to protect the vehicle from incoming projectiles.

3. The apparatus of claim 1, further comprising a second multi-layer composite armor component, wherein the first multi-layer composite armor component and the second multi-layer composite armor component are affixed to one another such that at least a portion of the first multi-layer composite armor component and the second multi-layer composite armor component overlap one another.

4. The apparatus of claim 1, wherein the first bonding layer includes at least one metal plate embedded within the first bonding layer.

5. The apparatus of claim 1, wherein the first bonding layer includes fiber reinforcement embedded within the first bonding layer, and wherein the first bonding layer includes at least one metal plate embedded within the first bonding layer.

6. The apparatus of claim 1, wherein the first bonding layer includes fiber reinforcement embedded within the first bonding layer.

7. The apparatus of claim 1, wherein the first multi-layer composite armor component is fully encapsulated by an exterior layer of encapsulant, and wherein the exterior layer includes ether polyurethane.

8. The apparatus of claim 1, further comprising a shock-absorbing layer that has a lower durometer value than the durometer value of the first bonding layer, wherein the shock-absorbing layer is affixed to a side of the first multi-layer composite armor component that is farther from the strike-face side of the multi-layer composite armor component than the second layer of bonding material.

9. The apparatus of claim 8, wherein the shock-absorbing layer includes a polyurethane, and wherein the shock-absorbing layer includes a contoured surface configuration on a non-strike-face side of the shock-absorbing layer.

10. A method for making a defense against a ballistic projectile, the method comprising:

forming a first multi-layer composite armor component, wherein the forming of the first multi-layer composite armor component includes:

providing a plurality of layers of energy-dispersion objects including a first layer that includes a first plurality of energy-dispersion objects and a second layer that includes a second plurality of energy-dispersion objects;

arranging the first plurality of layers of energy-dispersion objects such that each of the first plurality of energy-dispersion objects are held in place relative to one another in a closely-packed configuration;

providing a first layer of bonding material, wherein the first layer of bonding material has a first durometer value;

embedding the first plurality of energy-dispersion objects in the first layer of bonding material; and providing a second layer of bonding material, wherein the second bonding layer has a second durometer value that is less than the first durometer value, and wherein the second bonding layer is farther from a strike-face side of the multi-layer composite armor component than the first bonding layer.

11. The method of claim 10, further comprising:

providing a vehicle;

providing a plurality of other multi-layer composite armor components each substantially similar to the first multi-layer composite armor component; and affixing the first multi-layer composite armor component and the plurality of other multi-layer composite armor components to the vehicle to protect it from incoming projectiles.

12. The method of claim 10, further comprising:

providing a second multi-layer composite armor component; and affixing the first multi-layer composite armor component and the second multi-layer composite armor component to one another such that at least a portion of the first multi-layer composite armor component and the second multi-layer composite armor component overlap one another.

13. The method of claim 10, further comprising embedding at least one metal plate within the first bonding layer.

14. The method of claim 10, further comprising:

embedding at least one metal plate within the first bonding layer; and reinforcing the at least one metal plate by embedding fiber reinforcement within the first bonding layer.

15. The method of claim 10, further comprising embedding fiber reinforcement within the first bonding layer.

16. The method of claim 10, further comprising fully encapsulating the first multi-layer composite armor component with an exterior layer of encapsulant, wherein the exterior layer includes ether polyurethane.

17. The method of claim 10, further comprising:

providing a shock-absorbing layer that has a lower durometer value than the durometer value of the first bonding layer; and affixing the shock-absorbing layer to a side of the first multi-layer composite armor component that is farther from a strike-face side of the multi-layer composite armor component than the second layer of bonding material.

18. The method of claim 17, wherein the shock-absorbing layer includes a polyurethane, and wherein the shock-absorbing layer includes a contoured surface configuration on a non-strike-face side of the shock-absorbing layer.

19. An apparatus comprising:

a first multi-layer composite armor component comprising:

a plurality of layers of energy-dispersion objects including a first layer that includes a first plurality of energy-dispersion objects and a second layer that includes a second plurality of energy-dispersion objects, arranged such that each of the first plurality of energy-dispersion objects are held in place relative to one another in a closely-packed configuration;

means for holding the first plurality of energy-dispersion objects in place in a first layer, wherein the means for holding the first plurality of energy-dispersion objects in place has a first durometer value, and wherein the first layer includes steel fiber mesh fabric embedded within the first layer; and a second layer that includes a bonding material having a second durometer value that is less than the first durometer value, and wherein the second layer includes steel fiber mesh fabric embedded within the second layer.

20. The apparatus of claim 19, further comprising a vehicle, wherein the first multi-layer composite armor component is affixed to the vehicle to protect the vehicle from incoming projectiles.

21. An apparatus comprising:

a first multi-layer composite armor component comprising:

a plurality of layers of energy-dispersion objects including a first layer that includes a first plurality of energy-dispersion objects and a second layer that includes a second plurality of energy-dispersion objects, wherein the first plurality of energy-dispersion objects in the first layer are held in place relative to one another in a closely-packed configuration;

a first layer of bonding material, wherein the first layer of bonding material has a first durometer value, and wherein the first plurality of energy-dispersion objects are held in place relative to one another via the first layer of bonding material; and a second layer of bonding material, wherein the second bonding layer has a second durometer value that is less than the first durometer value, wherein the second bonding layer is farther from a strike-face side of the multi-layer composite armor component than the first bonding layer, wherein the first bonding layer includes steel fiber mesh fabric embedded within the first bonding layer, and wherein the second bonding layer includes steel fiber mesh fabric embedded within the second bonding layer.

22. The apparatus of claim 21, further comprising a vehicle, wherein the first multi-layer composite armor component is affixed to the vehicle to protect the vehicle from incoming projectiles.

* * * * *